US008214188B2

(12) United States Patent
Bailey et al.

(10) Patent No.: US 8,214,188 B2
(45) Date of Patent: Jul. 3, 2012

(54) METHODS AND SYSTEMS FOR MODELING, DESIGNING, AND CONDUCTING DRILLING OPERATIONS THAT CONSIDER VIBRATIONS

(75) Inventors: Jeffrey R. Bailey, Houston, TX (US); Erika A. O. Biediger, Houston, TX (US); Lei Wang, Sugar Land, TX (US); Shankar Sundararaman, Houston, TX (US); Mehmet Deniz Ertas, Bethlehem, PA (US); Vishwas Gupta, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 13/121,633

(22) PCT Filed: Sep. 30, 2009

(86) PCT No.: PCT/US2009/059040

§ 371 (c)(1), (2), (4) Date: Mar. 29, 2011

(87) PCT Pub. No.: WO2010/059295

PCT Pub. Date: May 27, 2010

(65) Prior Publication Data

US 2011/0214878 A1 Sep. 8, 2011

Related U.S. Application Data

(60) Provisional application No. 61/117,015, filed on Nov. 21, 2008, provisional application No. 61/117,016, filed on Nov. 21, 2008, provisional application No. 61/117,021, filed on Nov. 21, 2008.

(51) Int. Cl.

| | |
|---|---|
| ***G01V 1/40*** | (2006.01) |
| ***G01V 3/18*** | (2006.01) |
| ***G01V 5/04*** | (2006.01) |
| ***G01V 9/00*** | (2006.01) |
| ***G06F 17/50*** | (2006.01) |

(52) U.S. Cl. ..... 703/10; 702/6

(58) Field of Classification Search ..... 703/10, 703/7; 702/6

See application file for complete search history.

(56) References Cited

U.S. PATENT DOCUMENTS 4,903,245 A 2/1990 Close et al.

(Continued)

OTHER PUBLICATIONS

W. Eang, A. Gupta, "Transmissibility Scale-up in Reservoir Simulation" University of Oklahoma, The Petrolium Society, 1999, pp. 1-14.*

(Continued)

*Primary Examiner* — Dwin M Craig

(74) *Attorney, Agent, or Firm* — ExxonMobil Upstream Research Company—Law Department

(57) ABSTRACT

A method and apparatus associated with the production of hydrocarbons is disclosed. The method, which relates to modeling and operation of drilling equipment, includes constructing one or more surrogates for at least a portion of a bottom hole assembly (BHA) and calculating performance results from each of the one or more surrogates. The calculated results of the modeling may include one or more vibration performance indices that characterize the BHA vibration performance of the surrogates for operating parameters and boundary conditions, which may be substantially the same as conditions to be used, being used, or previously used in drilling operations. The selected BHA surrogate may then be utilized in a well construction operation and thus associated with the production of hydrocarbons.

66 Claims, 27 Drawing Sheets

U.S. PATENT DOCUMENTS

| | | | | |
|---|---|---|---|---|
| 5,159,577 | A | 10/1992 | Twist | |
| 5,313,829 | A | 5/1994 | Paslay et al. | |
| 5,321,981 | A | 6/1994 | Macpherson | |
| 5,358,059 | A | 10/1994 | Ho | |
| 5,402,677 | A | 4/1995 | Paslay et al. | |
| 5,448,911 | A | 9/1995 | Mason | |
| 5,560,439 | A | 10/1996 | Delwiche et al. | |
| 5,721,376 | A | 2/1998 | Pavone et al. | |
| 5,842,149 | A | 11/1998 | Harrell et al. | |
| 5,844,132 | A | 12/1998 | Fabret et al. | |
| 5,852,235 | A | 12/1998 | Pavone et al. | |
| 6,021,377 | A | 2/2000 | Dubinsky et al. | |
| 6,206,108 | B1 | 3/2001 | MacDonald et al. | |
| 6,227,044 | B1 | 5/2001 | Jarvis | |
| 6,233,524 | B1 | 5/2001 | Harrell et al. | |
| 6,256,603 | B1 * | 7/2001 | Celniker | 703/10 |
| 6,363,780 | B1 | 4/2002 | Rey-Fabret et al. | |
| 6,382,331 | B1 | 5/2002 | Pinckard | |
| 6,424,919 | B1 | 7/2002 | Moran et al. | |
| 6,438,495 | B1 | 8/2002 | Chau et al. | |
| 6,443,242 | B1 | 9/2002 | Newman et al. | |
| 6,467,557 | B1 | 10/2002 | Krueger et al. | |
| 6,603,472 | B2 | 8/2003 | Allen et al. | |
| 6,662,110 | B1 | 12/2003 | Bargach et al. | |
| 6,691,802 | B2 | 2/2004 | Schultz et al. | |
| 6,722,450 | B2 | 4/2004 | Schultz et al. | |
| 6,732,052 | B2 | 5/2004 | Macdonald et al. | |
| 6,785,641 | B1 | 8/2004 | Huang | |
| 6,817,425 | B2 | 11/2004 | Schultz et al. | |
| 6,968,909 | B2 | 11/2005 | Aldred et al. | |
| 7,020,597 | B2 | 3/2006 | Oliver et al. | |
| 7,054,750 | B2 | 5/2006 | Rodney et al. | |
| 7,082,371 | B2 | 7/2006 | Griffin et al. | |
| 7,082,821 | B2 | 8/2006 | Chen et al. | |
| 7,114,578 | B2 | 10/2006 | Hutchinson | |
| 7,139,689 | B2 | 11/2006 | Huang | |
| 7,140,452 | B2 | 11/2006 | Hutchinson | |
| 7,172,037 | B2 | 2/2007 | Dashevskiy et al. | |
| 7,219,747 | B2 | 5/2007 | Gleitman et al. | |
| 7,251,590 | B2 | 7/2007 | Huang et al. | |
| 7,261,167 | B2 | 8/2007 | Goldman et al. | |
| 7,316,278 | B2 | 1/2008 | Hutchinson | |
| 7,357,196 | B2 | 4/2008 | Goldman et al. | |
| 7,413,032 | B2 | 8/2008 | Krueger | |
| 7,464,013 | B2 | 12/2008 | Huang et al. | |
| 7,645,124 | B2 | 1/2010 | Garlow | |
| 7,730,967 | B2 | 6/2010 | Ballantyne et al. | |
| 7,748,474 | B2 | 7/2010 | Watkins et al. | |
| 2004/0221985 | A1 | 11/2004 | Hill et al. | |
| 2005/0096847 | A1 | 5/2005 | Huang | |
| 2005/0133272 | A1 | 6/2005 | Huang et al. | |
| 2005/0197813 | A1 | 9/2005 | Grayson | |
| 2005/0273304 | A1 | 12/2005 | Oliver et al. | |
| 2006/0149518 | A1 | 7/2006 | Oliver et al. | |
| 2006/0195307 | A1 | 8/2006 | Huang et al. | |
| 2007/0005316 | A1 | 1/2007 | Paez | |
| 2007/0021857 | A1 | 1/2007 | Huang | |
| 2007/0025017 | A1 | 2/2007 | Sakano | |
| 2007/0067147 | A1 | 3/2007 | Huang | |
| 2008/0156531 | A1 | 7/2008 | Boone et al. | |
| 2008/0164062 | A1 | 7/2008 | Brackin et al. | |
| 2008/0230272 | A1 | 9/2008 | Chen et al. | |
| 2008/0255817 | A1 | 10/2008 | Pabon et al. | |
| 2009/0114445 | A1 | 5/2009 | Dashevskiy | |
| 2009/0229882 | A1 | 9/2009 | Quernheim et al. | |
| 2010/0032165 | A1 | 2/2010 | Bailey et al. | |

OTHER PUBLICATIONS

Aarrestad, T.V. et al., "Drillstring Vibrations: Comparison Between Theory and Experiments on a Full-Scale Research Drilling Rig", SPE 14760, Feb. 10-12, 1986, pp. 311-321, 1986 IADC/SPE Drilling Conf., Dallas, TX.

Aarrestad, T.V. et al., "An Experimental and Theoretical Study of a Coupling Mechanism Between Longitudinal and Torsional Drillstring Vibrations at the Bit", Oct. 5-8, 1986, SPE 15563, pp. 12-18, 1986 SPE Annual Tech. Conf. & Exh., New Orleans, LA.

Allen, M.B., "BHA Lateral Vibrations: Case Studies and Evaluation of Important Parameters", SPE 16110, Mar. 15-18, 1987, pp. 531-535, 1987 SPE/IADC Drilling Conf., New Orleans, LA.

Armagost, W.K. et al., "The Successful Use of Anti-Whirl Technology in Conventional Coring", SPE 27473, Feb. 15-18, 1994, pp. 397-407, 1994 IADC/SPE Drilling Conf., Dallas, TX.

Ashton, J.P. et al., "In-Situ Heat System Stimulates Paraffinic-Crude Producers in Gulf of Mexico", SPE 15660, Oct. 5-8, 1986, pp. 157-160, 1986 SPE Annual Tech. Conf. & Exh., New Orleans, LA.

Apostal, M.C. et al., "A Study to Determine the Effect of Damping on Finite-Element-Based, Forced-Frequency-Response Models for Bottomhole Assembly Vibration Analysis", SPE 20458, Sep. 23-26, 1990, pp. 537-550, 68$^{th}$ Annual Technical Conf. and Exh. of the Society of Petroleum Engineers, New Orleans, LA.

Bailey, J.R., et al., "Drilling Vibrations Modeling and Field Validation", SPE 112650, Mar. 4-6, 2008, 15 pages, 2008 IADC/SPE Drilling Conf., Orlando, FL.

Baird, J.A. et al., "GEODYN2: A Bottomhole Assembly/Geological Formation Dynamic Interaction Computer Program", SPE 14328, Sep. 22-25, 1985, pp. 1-11, 60$^{th}$ Annual Technical Conf. and Exh. of the Society of Petroleum Engineers, Las Vegas, NV.

Baumgart, A., "Stick-Clip and Bit-Bounce of Deep-Hole Drillstrings", Jun. 2000, pp. 78-82, vol. 122, Transactions of the ASME.

Behr, S.M. et al., "3D PDC Bit Model Predicts Higher Cutter Loads", SPE 21928, Mar. 11-14, 1991, pp. 253-258, 1991 SPE/IADC Drilling Conf., Amsterdam, The Netherlands.

Besaisow, A.A. et al., "Development of a Surface Drillstring Vibration Measurement System", SPE 14327, Sep. 22-25, 1985, pp. 1-14, 60$^{th}$ Annual Technical Conf. and Exh. of the Society of Petroleum Engineers, Las Vegas, NV.

Besaisow, A.A., et al., "A Study of Excitation Mechanisms and Resonances Inducing Bottomhole-Assembly Vibrations", SPE 15365, Oct. 5-8, 1986, pp. 93-101, 1986 SPE Annual Tech. Conf. & Exh., New Orleans, LA.

Besaisow, A.A. et al., "Application of ADAMS (Advanced Drillstring Analysis and Measurement System) and Improved Drilling Performance", SPE 19998, Feb. 27-Mar. 2, 1990, pp. 717-722, 1990 IADC/SPE Drilling Conf., Houston, TX.

Besson, A. et al., "Optimization of the Drilling Performance in the 17½-in. Section of an Exploration Well in the Overthrust of Southern Italy", SPE 23910, Feb. 18-21, 1992, pp. 621-630, 1992 IADC/SPE Drilling Conf., New Orleans, LA.

Booer, A.K. et al., "Drillstring Imaging—An Interpretation of SSPE Drilling & Completion", SPE 23889, Feb. 18-21, 1992, pp. 93-98, 1992 IADC/SPE Drilling Conf., New Orleans, LA.

Brakel, J.D., "Prediction of Wellbore Trajectory Considering Bottom Hole Assembly and Drillbit Dynamics", Thesis, 1987, pp. 28-61, UMI Dissertation Services.

Brett, J.F. et al., "Bit Whirl: A New Theory of PDC Bit Failure", SPE 19571, Oct. 8-11, 1989, pp. 521-536, 64$^{th}$ Annual Technical Conf. and Exh. of the Society of Petroleum Engineers, San Antonio, TX.

Brett, J.F., "The Genesis of Torsional Drillstring Vibrations", SPE 21943, 1991, pp. 168-174, 1991 SPE/IADC Drilling Conf., Amsterdam, The Netherlands.

Burgess, T.M., "Improving BHA Tool Reliability with Drillstring Vibration Models: Field Experience and Limitations", SPE 16109, Mar. 15-18, 1987, pp. 517-530, 1987 SPE/IADC Drilling Conf., New Orleans, LA.

Burgess, T.M. et al., "Wellsite Action on Drilling Mechanics Information Improves Economics", SPE 29431, Feb. 28-Mar. 2, 1995, pp. 855-871, 1994 SPE/IADC Drilling Conf., Amsterdam, The Netherlands.

Chen, David C.K. et al., "Maximizing Drilling Performance with State-of-the-Art BHA Program", SPE 104502, Feb. 20-22, 2007, pp. 1-13, 2007 SPE/IADC Drilling Conf., Amsterdam, The Netherlands.

Chen, S.L., et al., "Field Investigation of the Effects of Stick-Slip, Lateral, and Whirl Vibrations on Roller Cone Bit Performance", SPE 56439, Oct. 3-6, 1999, pp. 1-10, 1999 SPE Annual Technical Conf. and Exh., Houston, TX.

Chen, S.L., et al., "An Improved Transfer Matrix Technique as Applied to BHA Lateral Vibration Analysis", 1995, pp. 93-105, vol. 185(1), Journal of Sound and Vibration.

Chin, W.C., "Predicting and Avoiding Catastrophic Drillstring Failure", SPE 19445, Aug. 17, 1989, pp. 1-12, SPE Publications.
Chin, W.C., *Wave Propagation in Petroleum Engineering*, 1994, pp. 159-162, 170-176, 226-230, 240-242, 254-263, Gulf Publishing Company.
Clayer, F. et al., "The Effect of Surface and Downhole Boundary Conditions on the Vibration of Drillstrings", Sep. 23-26, 1990, SPE 20447, pp. 431-442, 65th Annual Technical Conf. and Exh. of the Society of Petroleum Engineers, New Orleans, LA.
Clayton, R.I. et al., "Development of Whirl Resistant PDC Bits", SPE 26954, Apr. 27-29, 1994, pp. 625-637, III Latin American/Caribbean Petroleum Engineering Conf., Buenos Aires, Argentina.
Close, D.A. et al., "Measurement of BHA Vibration Using MWD", SPE 17273, Feb. 26-Mar. 2, 1988, pp. 659-668, 1988 IADC/SPE Drilling Conf., Dallas, TX.
Cobern, M.E. et al., "Downhole Vibration Monitoring & Control System Quarterly Technical Report #2", Apr. 1, 2003, pp. 3-19, DOE Award No. DE-FC26-02NT41664, OSTI ID: 821466, APS Technology Inc.
Cook, R.L. et al., "First Real Time Measurements of Downhole Vibrations, Forces, and Pressures Used to Monitor Directional Drilling Operations", SPE 18651, Feb. 28-Mar. 3, 1989, 1989 SPE/IADC Drilling Conf., New Orleans, LA.
Cutt, R.N. et al., "Beryl Field: Extracting Maximum Value from a Mature Asset Through the Evolution of Technology", SPE 92763, Feb. 23-25, 2005, pp. 1-9, SPE/IADC Drilling Conf., Amsterdam, The Netherlands.
Dareing, D.W., "Longitudinal and Angular Drill-String Vibrations with Damping", Sep. 22-25, 1968, pp. 1-9, Ref. B-C, Paper No. 68-Pet-30, Petroleum Mechanical Engineering and First Pressure Vessel and Piping Conf., Dallas, TX.
Dareing, D.W., "Drill Collar Length is a Major Factor in Vibration Control", SPE 11228, Sep. 26-29, 1983, pp. 637-644, 1982 SPE Annual Tech. Conf. & Exh., New Orleans, LA.
Dashevskiy, D. et al., "Application of Neural Networks for Predictive Control in Drilling Dynamics", SPE 56442, Oct. 3-6, 1999 pp. 1-8, 1999 SPE Annual Technical Conf. and Exh., Houston, TX.
Dawson, R. et al., "Drillstring Stick-Slip Oscillations", Jun. 14-18, 1987, pp. 1-6, 1987 SEM Spring Conf., Houston TX.
Desmette, S. et al., "Isubs: A New Generation of Autonomous Instrumented Downhole Tool", SPE 92424, Feb. 23-25, 2005, pp. 1-7, SPEC/IADC Drilling Conf., Amsterdam, The Netherlands.
Dufeyte, M.P. et al., "Detection and Monitoring of the Slip-Stick Motion: Field Experiments", SPE 21945, Mar. 11-14, 1991, pp. 429-438, 1991 SPE/IADC Drilling Conf., Amsterdam, The Netherlands.
Dunayevsky, V.A. et al., "Dynamic Stability of Drillstrings Under Fluctuating Weight on Bit", SPE 14329, Sep. 22-23, 1985, pp. 84-92, 1985 SPE Annual Tech. Conf. & Exh., Las Vegas, NV.
Dupriest, F.E. et al., "Maximizing Drill Rates with Real-Time Surveillance of Mechanical Specific Energy", SPE 92194, Feb. 23-25, 2005, pp. 1-11, SPE/IADC Drilling Conf., Amsterdam, The Netherlands.
Dykstra, M.W., et al., "Experimental Evaluations of Drill Bit and Drill String Dynamics", SPE 28323, Sep. 25-28, 1994, pp. 319-334, 69th Annual Technical Conf. and Exh. of the Society of Petroleum Engineers, New Orleans, LA.
Dykstra, M.W. et al., "Drillstring Component Mass Imbalance: A Major Source of Downhole Vibrations", SPE 29350, Feb. 28-Mar. 2, 1995, pp. 234-241, 1995 SPE/IADC Drilling Conf., Amsterdam, The Netherlands.
Dykstra, M.W. et al., "Improving Drilling Performance by Applying Advanced Dynamics Models", SPE 67697, Feb. 27-Mar. 1, 2001, pp. 1-18, SPE/IADC Drilling Conf., Amsterdam, The Netherlands.
Dykstra, M.W., "Nonlinear Drill String Dynamics", Dissertation, 1996, pp. 74-92, 148-149, 172-178, 185-186, The University of Tulsa.
Field, D.J. et al., "Techniques for Successful Application of Dynamic Analysis in the Prevention of Field-Induced Vibration Damage in MWD Tools", SPE 25773, Feb. 23-25, 1993, pp. 901-913, SPE/IADC Drilling Conf., Amsterdam, The Netherlands.
Fear, M.J. et al., "Experience in the Detection and Suppression of Torsional Vibration From Mud Logging Data", SPE 28908, Oct. 25-27, 1994, pp. 433-448, 1997 European Petroleum Conf., London, U.K.
Fear, M.J. et al., "The Destruction of PDC Bits by Severe Slip-Stick Vibration", SPE 37639, Mar. 4-6, 1997, pp. 1-11, SPE/IADC Drilling Conf., Amsterdam, The Netherlands.
Firpo, S.E., "Mechanical Behavior of Two-Dimensional Drill Strings in Inclined Holes", Thesis, 1986, pp. 3-12, Rice University.
Fontenot, E.P., "Drilling a 26-in. Diameter Hole to 12,550 ft: A Case History", SPE 15365, Oct. 5-8, 1986, pp. 1-12, 61st Annual Technical Conf. and Exh. of the Society of Petroleum Engineers, New Orleans, LA.
Gallagher, J. et al., "Performance Drilling: A Practical Solution to Drillstring Vibration", SPE 27538, Feb. 15-18, 1994, pp. 961-970, IADC/SPE Drilling Conf., Dallas, TX.
Grindhaug, G. et al., "Planning and Detailed BHA Vibration Modeling Leads to Performance Step Change Drilling Deviated 24-in. Hole Section, Offshore Norway", SPE 99126, Feb. 21-23, 2006, pp. 1-12, IADC/SPE Drilling Conf., Miami, FL.
Halsey, G.W. et al., "Drillstring Torsional Vibrations: Comparison Between Theory and Experiment on a Full-Scale Research Drilling Rig", SPE 15564, Oct. 5-8, 1986, pp. 1-10, 61st Annual Technical Conf. and Exh. of the Society of Petroleum Engineers, New Orleans, LA.
Hanson, J.M. et al., "Dynamics Modeling of PDC Bits", SPE 29401, Feb. 28-Mar. 2, 1995, pp. 589-604, SPE/IADC Drilling Conf., Amsterdam, The Netherlands.
Heisig, G. et al., "Lateral Drillstring Vibrations in Extended-Reach Wells", SPE 59235, Feb. 23-25, 2000, pp. 1-11, 2000 IADC/SPE Drilling Conf., New Orleans, LA.
Henneuse, H., "Surface Detection of Vibrations and Drilling Optimization: Field Experience", SPE 23888, Feb. 18-21, 1992, pp. 409-423, 1992 IADC/SPE Drilling Conf., New Orleans, LA.
Howard, J.A. et al., "Systematic Tracking of Fatigue and Crack Growth to Optimize Drillstring Reliability", SPE 25775, Feb. 23-25, 1993, pp. 927-939, 1993 SPE/IADC Drilling Conf., Amsterdam, The Netherlands.
Jansen, J.D., "Whirl and Chaotic Motion of Stabilized Drill Collars", SPE 20930, Oct. 22-24, 1990, pp. 107-114, 1990 European Petroleum Conf., The Hague.
Jansen, J.D. et al., "Active Damping of Torsional Drillstring Vibrations with a Hydraulic Top Drive", SPE 28911, Oct. 25-27, 1994, pp. 250-254, 1994 European Petroleum Conf., London, England.
Jansen, J.D., "Nonlinear Dynamics of Oilwell Drillstrings", Jun. 16, 1993, pp. 38-39, 44, 49-55, 67-69, 96-108, 136-140, 173, 177, Delft University Press.
Javanmardi, K. et al., "Application of Soft-Torque Rotary Table in Mobile Bay", SPE 23913, Feb. 18-21, 1992, pp. 645-650, 1992 IADC/SPE Drilling Conf., New Orleans, LA.
Jogi, P. et al., Visualization of BHA Dynamics Improves Understanding of Downhole Drilling Conditions, SPE 99181, Feb. 21-23, 2006, pp. 1-10, IADC/SPE Drilling Conf., Miami, FL.
Kenner, J.V. et al., "Dynamic Analysis Reveals Stability of Roller Cone Rock Bits", SPE 28314, Sep. 25-28, 1994, pp. 227-236, SPE 69th Annual Technical Conf. and Exh.
Kreisle, L.F. et al., "Mathematical Analysis of the Effect of a Shock Sub on the Longitudinal Vibrations of an Oilwell Drill String", SPE 2778, Dec. 1970, pp. 349-356, SPE Journal, v 10.
Kriesels, P.C. et al., "Cost Savings through an Integrated Approach to Drillstring Vibration Control", SPE 57555, Nov. 8-10, 1999, pp. 1-12, 1999 SPE/IADC Middle East Drilling Technology Conf.
Kyllingstad, A. et al., "A Study of Slip/Stick Motion of the Bit", SPE 16659, Sep. 27-30, 1987, pp. 369-373, 1987 SPE Annual Tech. Conf. & Exh., Dallas, TX.
Kyllingstad, A., et al., "A New Stick-Slip Prevention System", SPE 119660, Mar. 17-19, 2009, 14 pages, SPE/IADC Drilling Conf., Amsterdam, The Netherlands.
Lee, H.Y., "Drillstring Axial Vibration and Wave Propagation in Boreholes", 1991, pp. 55-71, 116-122, Massachusetts Institute of Technology.

Leine, R.I. et al., "Stick-Slip Whirl Interaction in Drillstring Dynamics", Apr. 2002, pp. 209-220, Journal of Vibration and Acoustics, v 124.
Li, C., "An Analytical Study of Drill String Vibrations", SPE 15975, 1987, pp. 1-20, Society of Petroleum Engineers.
Li, Z., et al., "Fundamental Equations for Dynamic Analysis of Rod and Pipe String in Oil-Gas Wells and Application in Static Buckling Analysis", 2002, 10 pages, JCPT.
Lin, Y.-Q., et a., "Stick-Slip Vibration of Drill Strings", Feb. 1991, pp. 38-43, vol. 113, Transactions of the ASME.
McCAIN, J.R, W.D. et al., "The Coefficient of Isothermal Compressibility of Black Oils at Pressures Below the Bubblepoint", SPE 15664, Sep. 1988, pp. 659-662, SPE Formation Evaluation.
Macpherson, J.D. et al., "Surface Measurement and Analysis of Drillstring Vibrations While Drilling", SPE 25777, Feb. 23-25, 1993, pp. 953-963, 1993 SPE/IADC Drilling Conf., Amsterdam, The Netherlands.
Millheim, K.K. et al., "The Effect of Bottomhole Assembly Dynamics on the Trajectory of a Bit", SPE 9222, Sep. 21-24, 1980, pp. 2323-2338, SPE 55th Annual Tech. Conf. & Exhibition, Dallas, TX.
Mitchell, R.F. et al., "Case Studies of BHA Vibration Failure", SPE 16675, Sep. 27-30, 1987, pp. 237-250, 62nd Annual Technical Conf. and Exh. of the Society of Petroleum Engineers, Dallas, TX.
Murray, P.J. et al., "Slimhole Vibration Case Study", SPE 28325, Sep. 25-28, 1994, pp. 347-356, SPE 69th Annual Technical Conf. and Exh., New Orleans, LA.
Neubert, M. et al., "Verification of an Advanced Analysis Model with Downhole Bending Moment Measurements", SPE 93864, Apr. 5-7, 2005, 2005 Asia Pacific Oil & Gas Conf. & Exh., Jakarta, Indonesia.
Nicholson, J.W., "An Integrated Approach to Drilling Dynamics Planning, Identification, and Control", SPE 27537, Feb. 15-18, 1994, pp. 947-960, IADC/SPE Drilling Conf., Dallas, TX.
Parfitt, S.H.L. et al., "A Model for Shock Sub Performance Qualification", SPE 29354, Feb. 28-Mar. 2, 1995, pp. 215-225, 1995 SPE/IADC Drilling Conf., Amsterdam, The Netherlands.
Paslay, P.R., "Drill String Vibrations due to Intermittent Contact of Bit Teeth," 1962, pp. 1-8, Transactions of the ASME, Paper No. 62-Pet-13.
Pavone, D.R. et al., "Application of High Sampling Rate Downhole Measurements for Analysis and Cure of Stick-Slip in Drilling", SPE 28324, Sep. 25-28, 1994, pp. 335-345, SPE 69th Annual Technical Conf. and Exh., New Orleans, LA.
Perreau, P.J. et al., "New Results in Real Time Vibrations Prediction", SPE 49479, Oct. 11-14, 1998, pp. 190-200, 8th Abu Dhabi International Petroleum Exh. and Conf., Abu Dhabi, U.A.E.
Poletto, F. et al., "Seismic While Drilling—Fundamentals of Drill-Bit Seismic for Exploration, Chpt. 4—General Theory: Drill-String Waves and Noise Fields", 2004, pp. 163-212, vol. 35, Seismic Exploration.
Rajnauth, J. et al., "Reduce Torsional Vibration and Improve Drilling Operations", SPE 81174, Apr. 27-30, 2003, pp. 1-13, SPE Latin American and Caribbean Petroleum Engineering Conf., Port-of-Spain, Trinidad, West Indies.
Reid, D. et al., "Analysis of Drillstring Failure", SPE 29351, Feb. 28-Mar. 2, 1995, pp. 187-196, 1995 SPE/IADC Drilling Conf., Amsterdam, The Netherlands.
Rewcastle, S.C. et al., "Real-Time Downhole Shock Measurements Increase Drilling Efficiency and Improve MWD Reliability", SPE 23890, Feb. 18-21, 1992, pp. 433-442, 1992 IADC/SPE Drilling Conf., New Orleans, LA.
Richard, T., et al., "A Simplified Model to Explore the Root Cause of Stick-Slip Vibrations in Drilling Systems with Drag Bits", 2007, pp. 432-456, vol. 305, Journal of Sound and Vibration.
Robnett, E.W., et al., "Analysis of the Stick-Slip Phenomenon Using Downhole Drillstring Rotation Data", SPE 52821, Mar. 9-11, 1999, pp. 1-12, 1999 SPE/IADC Drilling Conf., Amsterdam, The Netherlands.
Roukema, J.C., et al., "Generalized Modeling of Drilling Vibrations. Part II: Chatter Stability in Frequency Domain", 2007, pp. 1474-1485, vol. 47, Int'l. Journal of Machine Tools & Mfg.
Salman, M. et al., "Rotary Drilling US-Khuff Formation with PDC Bits", SPE 53341, Feb. 20-23, 1999, pp. 1-7, 1999 SPE Middle East Oil Show, Bahrain.
Samuel, G.R. et al., "Vibration Analysis, Model Prediction, and Avoidance: A Case History", SPE 102134, Oct. 16-18, 2006, pp. 1-7, 2006 SPE/IADC Indian Drilling Technology Conf. and Exh., Mumbai, India.
Sananikone, P. et al., "A Field Method for Controlling Drillstring Torsional Vibrations", SPE 23891, Feb. 18-21, 1992, pp. 443-452, 1992 IADC/SPE Drilling Conf., New Orleans, LA.
Sathuvalli, U.B. et al., "Advanced Assessment of Drillpipe Fatigue and Application to Critical Well Engineering", SPE 92591, Feb. 23-25, 2005, pp. 1-11, SPE/IADC Drilling Conf., Amsterdam, The Netherlands.
Serrarens, A.F.A., "H-∞ Control as Applied to Torsional Drillstring Dynamics", Mar. 19, 1977, Master Thesis, pp. 23-54, Eindhoven University of Technology, The Netherlands.
Schmalhorst, B. et al., "Drilling Dynamics in the Presence of Mud Flow", SPE 59236, Feb. 23-25, 2000, pp. 1-12, 2000 IADC/SPE Drilling Conf., New Orleans, LA.
Sinor, L.A. et al., "Field Testing of Low-Friction-Gauge PDC Bits", SPE 20416, Sep. 23-26, 1990, pp. 21-27, 1990 SPE Annual Tech. Conf. & Exh., New Orleans, LA.
Skaugen, E., "The Effects of Quasi-Random Drill Bit Vibrations Upon Drillstring Dynamic Behavior", SPE 16660, Sep. 27-30, 1987, pp. 105-116, 62$^{nd}$ Annual Technical Conf. & Exh. of the Society of Petroleum Engineers, Dallas, TX.
Skaugen E. et al., "Performance Testing of Shock Absorbers", SPE 15561, Oct. 5-8, 1986, pp. 1-12, 61$^{st}$ Annual Technical Conf. & Exh. of the Society of Petroleum Engineers, New Orleans, LA.
Sotomayor, G. P.G. et al., "Drill String Vibration: How to Identify and Supress", SPE 39002, Aug. 30-Sep. 3, 1997, pp. 1-11, Fifth Latin American and Caribbean Petroleum Engineering Conf. & Exh., Rio de Janeiro, Brazil.
Sowers, S.F., et al., "Roller Roamers Improve Drilling Performance in Wells Limited by Bit and Bottomhole Assembly Vibrations", SPE 119375, Mar. 17-19, 2009, 8 pages, SPE/IADC Drilling Conf., Amsterdam, The Netherlands.
Spanos, P.D. et al., "Advances in Dynamic Bottomhole Assembly Modeling and Dynamic Response Determination", SPE 23905, Feb. 18-21, 1992, pp. 581-590, 1992 IADC/SPE Drilling Conf., New Orleans, LA.
Spanos, P.D., et al., "Bottom-Hole Assembly Modeling and Dynamic Response Determination", Sep. 1997, pp. 153-158, vol. 119, Journal of Energy Resources Technology.
Thomas, S. et al., "Expanding Application of PDC into Harder, More Abrasive Formations: Performance Step Change in Saudi Arabia", SPE 92435, Feb. 23-25, 2005, pp. 1-12, SPE/IADC Drilling Conf., Amsterdam, The Netherlands.
Tucker, R.W. et al., On the Effective Control of Torsional Vibrations in Drilling Systems, 1999, pp. 101-122, v. 224(1), Journal of Sound and Vibration.
Van Oort, E. et al., "Drilling More Stable Wells Faster and Cheaper with PDC Bits and Water Based Muds", SPE 59192, Feb. 23-25, 2000, pp. 1-16, 2000 IADC/SPE Drilling Conf., New Orleans, LA.
Vandiver, J.K. et al., "Case Studies of the Bending Vibration and Whirling Motion of Drill Collars", SPE 18652, Feb. 28-Mar. 3, 1989, pp. 282-290, 1989 SPE/IADC Drilling Conf., New Orleans, LA.
Viguie, R. et al., "Using Targeted Energy Transfer to Stabilize Drill-String Systems", 2007, 12 pages, www.dct.tue.nl\New\Wouw\IMAC2007_Viguie.
Warren, T.M. et al., "Torsional Resonance of Drill Collars with PDC Bits in Hard Rock", SPE 49204, Sep. 27-30, 1998, pp. 625-637, 1998 SPE Annual Technical Conf. & Exh., New Orleans, LA.
Warren, T.M. et al., "Simultaneous Drilling and Reaming with Fixed Blade Reamers", SPE 30474, Oct. 22-25, 1995, pp. 251-261, SPE Annual Technical Conf. & Exh., Dallas, TX.
Warren, T.M. et al., "Development of a Whirl-Resistant Bit", SPE 19572, Oct. 8-11, 1989, pp. 267-274, 1989 SPE Annual Tech. Conf. & Exh., San Antonio, TX.
Williams, J.B. et al., "An Analysis of Predicted Wellbore Trajectory Using a Three-Dimensional Model of a Bottomhole Assembly with Bent Sub, Bent Housing, and Eccentric Contact Capabilities", SPE 19545, Oct. 8-11, 1990, pp. 273-285, 64$^{th}$ Annual Technical Conf. and Exh. of the Society of Petroleum Engineers, San Antonio, TX.

Wolf, S.F. et al.,"Field Measurements of Downhole Drillstring Vibrations", SPE 14330, Sep. 22-25, 1985, pp. 1-12, 60th Annual Technical Conf. and Exh. of the Society of Petroleum Engineers, Las Vegas, NV.

Worford, S.W. et al., "Shock Absorbers-Are They Necessary?", SPE 11406, Feb. 20-23, 1983, pp. 383-387 & Appendix, IADC/SPE 1983 Drilling Conf., New Orleans, LA.

Yigit, A.S. et al., "Mode Localization May Explain Some of BHA Failures", SPE 39267, Nov. 23-25, 1997, pp. 187-196, 1997 SPE/IADC Middle East Drilling Technology Conf., Bahrain.

Yigit, A.S., et al., "Stick-Slip and Bit-Bounce Interaction of Oil-Well Drillstrings", Dec. 2006, pp. 268-27, vol. 128, Transactions of the ASME.

Zambudio, C.A. et al., "Effect of Shock Absorber on Drag Bit Chatter", SPE 17194, Feb. 28-Mar. 2, 1988, pp. 153-160, 1988 IADC/SPE Drilling Conf., Dallas, TX.

Zamudio, C.A. et al., "Self-Excited Vibrations in Drillstrings", SPE 16661, Sep. 27-30, 1987, pp. 117-124, 62nd Annual Technical Conf. and Exh. of the Society of Petroleum Engineers, Dallas, TX.

* cited by examiner

2310

| | A | B | C | D | E |
|---|---|---|---|---|---|
| 1 | depth | wob | rpm | rop | mse |
| 2 | 6000 | 10600.4 | 87.42734 | 21.57391 | 35200.14 |
| 3 | 6001 | 10469.29 | 80.93806 | 19.93606 | 28742.56 |
| 4 | 6002 | 10977.88 | 80.30625 | 19.25371 | 26362.07 |
| 5 | 6003 | 10547.13 | 81.00431 | 18.26779 | 28800.57 |
| 6 | 6004 | 10868.41 | 88.40511 | 22.07111 | 34976.24 |
| 7 | 6005 | 10427.28 | 88.17861 | 18.66668 | 36581.03 |
| 8 | 6006 | 10709.65 | 80.31921 | 18.56332 | 27496.1 |
| 9 | 6007 | 10192.68 | 89.85539 | 18.82523 | 39402 |
| 10 | 6008 | 10114.99 | 89.61298 | 18.68884 | 39609.2 |
| 11 | 6009 | 10533.82 | 89.48103 | 21.0887 | 37716.95 |
| 12 | 6010 | 10056.64 | 86.66617 | 21.3486 | 36842.9 |
| 13 | 6011 | 10851.66 | 81.30296 | 21.25888 | 27368.26 |
| 14 | 6012 | 10746.78 | 80.36914 | 17.75059 | 26949.14 |
| 15 | 6013 | 10667.17 | 88.78165 | 22.52675 | 35888.51 |
| 16 | 6014 | 10193.86 | 88.23132 | 18.8149 | 37337.84 |

2312 2312

METHODS AND SYSTEMS FOR MODELING, DESIGNING, AND CONDUCTING DRILLING OPERATIONS THAT CONSIDER VIBRATIONS

CROSS REFERENCE TO RELATED APPLICATIONS

This application is the National Stage of International Application No. PCT/US09/59040, filed 30 Sep. 2009, which claims the benefit of U.S. Provisional Application Nos. 61/117,015; 61/117,016; 61/117,021; each of which was filed on 21 Nov. 2008, and each of which is incorporated herein by reference in their entirety for all purposes.

FIELD

The present disclosure provides methods and systems for modeling, designing, and conducting drilling operations that consider vibrations, which may be experienced by a drilling system. In particular, the present disclosure provides systems and methods for modeling bottom hole assembly (BHA) vibration performance during drilling to enable improved design and operation for enhanced drilling rate of penetration, to reduce downhole equipment failure, to extend current tool durability and/or to enhance overall drilling performance. BHA modeling may be used to enhance hydrocarbon recovery by drilling wells more efficiently.

BACKGROUND

This section is intended to introduce various aspects of related technology, which may be associated with exemplary embodiments of the present techniques. This discussion is believed to be helpful in providing information to facilitate a better understanding of particular aspects of the present techniques. Accordingly, it should be understood that this section should be read in this light, and not necessarily as admissions of prior art.

The production of hydrocarbons, such as oil and gas, has been performed for many years. To produce these hydrocarbons, one or more wells are typically drilled into subterranean locations, which are generally referred to as subsurface formations or basins. The wells are formed to provide fluid flow paths from the subterranean locations to the surface. The drilling operations typically include the use of a drilling rig coupled to a drillstring and bottom hole assembly (BHA), which may include a drill bit or other rock cutting devices, drill collars, stabilizers, measurement while drilling (MWD) equipment, rotary steerable systems (RSS), hole opening and hole reaming tools, bi-center bits, roller reamers, shock subs, float subs, bit subs, heavy-weight drill pipe, mud motors, and other components known to those skilled in the art. Once drilling operations are complete, the produced fluids, such as hydrocarbons, are processed and/or transported to delivery locations. As is well understood, drilling operations for the preparation of production wells, injection wells, and other wells are very similar. The present methods and systems may be used in cooperation with providing wells for hydrocarbon production, for injection operations, or for other purposes.

During the drilling operations, various limiters may hinder the rate of penetration (ROP). For instance, vibrations during drilling operations have been identified as one factor that limits the ROP. These vibrations may include lateral, axial and torsional vibrations, which may be present in a coupled or an uncoupled form. Axial vibrations occur as a result of bit/rock interactions and longitudinal drillstring dynamics;

this mode may propagate to surface or may be dampened out by contact with the wellbore. Torsional vibrations may involve fluctuations in the torque at the bit and subsequent propagation uphole as a disturbance in the rotary motion of the drillstring. BHA lateral vibrations involve beam bending dynamics in the stiff pipe near the bit and do not usually propagate directly to the surface. However, lateral vibrations may couple to the axial and torsional vibrations and be experienced at the surface. Some authors have identified lateral vibrations as the most destructive vibrational mode to drilling equipment. The identification of the different types and amplitudes of the vibrations may be provided from downhole sensors in MWD equipment to provide either surface readout of downhole vibrations or stored data that can be downloaded at the surface after the "bitrun" or drilling interval is complete.

As drilling operations are expensive, processes for optimizing drilling operations based on the removal or reduction of system inefficiencies, or founder limiters, such as vibrations, may be beneficial. The downhole failure of a BHA or BHA component may be expensive and significantly increase the costs of drilling a well. The costs of BHA failures may include replacement equipment and additional time for a round-trip of the drillstring in the event of a washout (e.g., loss of drillstem pressure) with no parting of the drillstring. Further compounding these costs, sections of the wellbore may be damaged, which may result in sidetracks around the damaged sections of the wellbore. While many factors affect the durability of a BHA, vibrations have been identified as a factor that impacts equipment durability.

Accordingly, design tools (e.g., software applications and modeling programs) may be utilized to examine the drill string and BHA configurations and proposed drilling operations before implementation in a drilling operation. For example, vibrational tendencies may be identified along with drilling conditions, configuration designs, materials, and other operational variables that may affect the vibrational tendencies of the drill string and/or BHA during drilling operations. For example, modeling programs may represent the static force interactions in a BHA as a function of stabilizer placement. Although there have been numerous attempts to model BHA dynamics, there is a need for model-based design tools to simulate BHA designs for evaluating vibration effects as described herein.

In the numerous references cited in this application, there are both time and frequency-domain models of drilling assemblies. Because of the interest in direct force calculations for bit design and the rapid increase in computational capability, recent activity has focused on the use of direct time domain simulations and the finite element methods, including both two-dimensional and three-dimensional approaches. However, these simulations still require considerable calculation time, and therefore the number of cases that can be practically considered is limited. The finite element method has also been used for frequency-domain models, in which the basic approach is to consider the eigenvalue problem and solve for the critical frequencies and mode shapes. Only a couple of references have used the forced-frequency response approach, and these authors chose different model formulations than those discussed herein, including a different selection of boundary conditions. One reference used a similar condition at the bit in a finite element model, but a different boundary condition was specified at the top of the bottom hole assembly. This reference did not proceed further to develop the design procedures and methods disclosed herein.

Further, as part of a modeling system developed by ExxonMobil, a vibration performance index was utilized to provide guidance on individual BHA designs. A steady-state forced-frequency response dynamic model was developed to analyze a single BHA in batch mode from a command line interface, using output text files for graphical post-processing using an external software tool, such as Microsoft Excel™. This method was difficult to use, and the limitations of the interface impeded its application. The model has been utilized in some commercial applications within the United States since 1992 to place stabilizers to reduce the predicted vibration levels, both in an overall sense and specifically within designed rotary speed ranges. This model provided an End-Point Curvature index for a single BHA configuration. The End-Point Curvature index was limited to looking at performance from the perspective of a single point at the top of the BHA model. Moreover, the operational limitations of this prior model limited its application to individual BHA configurations for the determination of stabilizer placement. It was not capable of considering multiple BHA configurations conveniently or of conveniently varying a plurality of parameters for optimizing one or more factors other than the stabilizer location.

Other related material may be found in the following: G. Heisig et al., "Lateral Drillstring Vibrations in Extended-Reach Wells", SPE 59235, 2000; P. C. Kriesels et al., "Cost Savings through an Integrated Approach to Drillstring Vibration Control", SPE/IADC 57555, 1999; D. Dashevskiy et al., "Application of Neural Networks for Predictive Control in Drilling Dynamics", SPE 56442, 1999; A. S. Yigit et al., "Mode Localization May Explain Some of BHA Failures", SPE 39267, 1997; M. W. Dykstra et al., "Drillstring Component Mass Imbalance: A Major Source of Downhole Vibrations", SPE 29350, 1996; J. W. Nicholson, "An Integrated Approach to Drilling Dynamics Planning, Identification, and Control", SPE/IADC 27537, 1994; P. D. Spanos and M. L. Payne, "Advances in Dynamic Bottomhole Assembly Modeling and Dynamic Response Determination", SPE/IADC 23905, 1992; M. C. Apostal et al., "A Study to Determine the Effect of Damping on Finite-Element-Based, Forced Frequency-Response Models for Bottomhole Assembly Vibration Analysis", SPE 20458, 1990; F. Clayer et al., "The Effect of Surface and Downhole Boundary Conditions on the Vibration of Drillstrings", SPE 20447, 1990; D. Dareing, "Drill Collar Length is a Major Factor in Vibration Control", SPE 11228, 1984; A. A. Besaisow, et al., "Development of a Surface Drillstring Vibration Measurement System", SPE 14327, 1985; M. L. Payne, "Drilling Bottom-Hole Assembly Dynamics", Ph.D. Thesis, Rice University, May 1992; A. Besaisow and M. Payne, "A Study of Excitation Mechanisms and Resonances Inducing Bottomhole-Assembly Vibrations", SPE 15560, 1988; and U.S. Pat. No. 6,785,641.

The prior art does not provide tools to support a design process as disclosed herein (i.e. a direct characterization of the drilling vibration behavior for myriad combinations of rotary speed and weight on bit), and there are no references to design indices or figures of merit to facilitate comparison of the behaviors of different assembly designs. Accordingly, there is a need for such software tools and design metrics to design improved bottom hole assembly configurations and drilling operations to reduce drilling vibrations.

SUMMARY

The technologies of the present disclosure are directed to methods and systems for representing vibrational performance of drilling equipment. In some implementations, the methods consist of: a) constructing at least one surrogate representing at least a portion of a bottom hole assembly; b) associating at least two virtual sensors with each of the at least one surrogates such that the at least two sensors are spaced longitudinally from each other along each bottom hole assembly; c) utilizing at least one frequency-domain model to calculate at least one state of the at least two virtual sensors during one or more simulated drilling operations for each of the at least one surrogates; d) calculating a transmissibility index between the at least two virtual sensors for each of the at least one surrogates, wherein the transmissibility index is based at least in part on at least one of the calculated states; and e) using the calculated transmissibility index for each of the at least one surrogates to determine the transmissibility of vibrations within the bottom hole assembly.

Each of the steps outlined above may be carried out with various adjustments and/or specifics within the scope of the present disclosure. For example, the calculated at least one state may comprise at least one of displacement, tilt angle, bending moment, and shear force. One or more of these calculated states may be used to calculate accelerations of the at least two virtual sensors, which, in some implementations, may be used to calculate the transmissibility index, such as by ratio. Similarly, the calculated transmissibility index may be a ratio between any one or more of the calculated states or derivations therefrom.

Depending on how the transmissibility index is calculated, its numerical value may have different meanings. In implementations where the transmissibility index is calculated as a ratio, a transmissibility index greater than one may predict that vibrations would increase between a first virtual sensor and a second virtual sensor. Similarly, a transmissibility index less than 1 may predict that vibrations would decrease between a first virtual sensor and a second virtual sensor.

In some implementations, at least one of the virtual sensors may be associated with a bit of the at least one bottom hole assembly surrogate and the transmissibility index may be calculated for a plurality of points along the surrogate. In such implementations, the calculated transmissibility indices may produce a plot wherein peaks of the transmissibility plot indicate locations of local peak vibration in the surrogate bottom hole assembly.

In some implementations, the methods may further include: f) drilling at least a portion of a well with a bottom hole assembly at least substantially embodying a surrogate used to calculate a transmissibility index while measuring acceleration at least at two sensors disposed along the embodied bottom hole assembly; g) calculating a measured transmissibility index using the measured accelerations; and h) comparing the measured transmissibility index with the transmissibility index of the surrogate. Moreover, some implementations may include updating the at least one surrogate to represent a different bottom hole assembly configuration and repeating steps (b)-(e) from above. Additionally or alternatively, the methods may include modifying drilling operations on the well based at least in part on the measured transmissibility index and the surrogate transmissibility index. Still further, some implementations may include updating one or more of the at least one surrogate, the at least two virtual sensors, the at least one frequency-domain model, and the transmissibility index calculations based at least in part on the comparison of the measured transmissibility index and the transmissibility index of the at least one surrogate.

Additionally or alternatively, the present disclosure provides methods of drilling a well for use in the production of hydrocarbons. For example, a suitable method may include: a) constructing at least one surrogate representing at least a portion of a bottom hole assembly, wherein the at least one surrogate includes at least two virtual sensors; b) calculating a transmissibility index between the at least two virtual sensors for each of the at least one surrogates; c) selecting an optimized bottom hole assembly configuration for a drilling operation based at least in part on the calculated transmissibility index; and d) drilling a well with drilling equipment incorporating a bottom hole assembly at least substantially embodying the selected bottom hole assembly configuration. In some implementations, the step of drilling the well may be conducted according to a drilling plan developed based at least in part on the calculated transmissibility index. Additionally or alternatively, the step of selecting an optimized bottom hole assembly configuration may comprise selecting different bottom hole assembly configurations for different portions of the drilling operation.

As with all of the implementations described herein, the methods and systems may be implemented and/or utilized in the production of hydrocarbons. For example, the methods may include the step of producing hydrocarbons from a well drilled with drilling equipment incorporating a bottom hole assembly at least substantially embodying a bottom hole assembly surrogate for which a transmissibility index was calculated.

Any one or more of the methods described above may include one or more steps adapted to be performed by a computer-based modeling system. Accordingly, the present disclosure is further directed to modeling systems. An exemplary modeling system may include a processor; a memory coupled to the processor; and a set of computer readable instructions accessible by the processor. The set of computer readable instructions may be configured to: a) construct at least one surrogate representing at least a portion of a bottom hole assembly, wherein the at least one surrogate includes at least two virtual sensors; b) calculate a transmissibility index between the at least two virtual sensors for each of the at least one surrogates; and c) output the transmissibility index for use in selecting an optimized bottom hole assembly configuration for a drilling operation based at least in part on the calculated transmissibility index. An exemplary system may include instructions adapted to calculate the transmissibility index utilizing at least one frequency-domain model to calculate at least one state of the at least two virtual sensors during one or more simulated drilling operations for each of the at least one surrogates. Additionally or alternatively, systems within the present disclosure may provide the output as a graphical representation of the transmissibility index of a bottom hole assembly configuration at one or more points along the bottom hole assembly configuration.

The technologies of the present disclosure are further directed to methods and systems for representing vibrational performance of drilling equipment. In some implementations, the methods consist of: a) constructing at least one surrogate representing at least a portion of a bottom hole assembly disposed in a well; b) utilizing a frequency-domain model to calculate a sideforce at least at one contact point between the bottom hole assembly and the well, wherein the sideforce is calculated as a function of rotational speed for each surrogate; c) determining at least one sideforce slope index as a function of rotational speed for the at least one contact point; and d) displaying the calculated sideforce slope index as a function of rotational speed.

Each of the steps outline above may be carried out with various adjustments and/or specifics within the scope of the present disclosure. For example, the frequency-domain model used to calculate the sideforce may consider the coefficient of friction to be non-constant over the rotational speeds considered for at least one of the contact forces. Additionally or alternatively, the at least one sideforce slope indices may be determined graphically and/or numerically. In some implementations, the determined sideforce slope index may be a combined index representative of a plurality of contact points between the bottom hole assembly and the well.

Depending on how the sideforce slope index is calculated, its numerical value may have different meanings. In some implementations, a non-zero sideforce slope index may indicate a greater potential for vibration in that region of the bottom hole assembly. In some implementations, the absolute value of the sideforce slope index may be plotted as function of rotational speed to determine a quantified potential for vibration, which may be used to identify one or more contact points having greater potential for vibration.

Additionally or alternatively, the present disclosure provides methods of drilling a well for use in the production of hydrocarbons. For example, a suitable method may include: a) constructing at least one surrogate representing at least a portion of a bottom hole assembly disposed in a well; b) determining at least one sideforce slope index as a function of rotational speed for at least one contact point between the bottom hole assembly and the well; c) selecting an optimized bottom hole assembly configuration for a drilling operation based at least in part on the determined at least one sideforce slope index; and d) drilling a well with drilling equipment incorporating a bottom hole assembly at least substantially embodying the selected bottom hole assembly configuration. In some implementations, the step of drilling the well may be conducted according to a drilling plan developed based at least in part on the determined at least one sideforce slope index. Additionally or alternatively, the step of selecting an optimized bottom hole assembly configuration may comprise selecting different bottom hole assembly configurations for different portions of the drilling operation.

As with all of the implementations described herein, the methods and systems may be implemented and/or utilized in the production of hydrocarbons. For example, the methods may include the step of producing hydrocarbons from a well drilled with drilling equipment incorporating a bottom hole assembly at least substantially embodying a bottom hole assembly surrogate for which a sideforce slope index was calculated.

Any one or more of the methods described above may include one or more steps adapted to be performed by a computer-based modeling system. Accordingly, the present disclosure is further directed to modeling systems. An exemplary modeling system may include a processor; a memory coupled to the processor; and a set of computer readable instructions accessible by the processor. The set of computer readable instructions may be configured to: An exemplary system may include instructions adapted to: a) construct at least one surrogate representing at least a portion of a bottom hole assembly disposed in a well; b) determining at least one sideforce slope index as a function of rotational speed for at least one contact point between the bottom hole assembly and the well; and d) output the at least one sideforce slope index for use in selecting an optimized bottom hole assembly configuration for a drilling operation based at least in part on the determined at least one sideforce slope index. In some implementations, the step of determining a sideforce slope index utilizes at least one frequency-domain model to calculate a sideforce at least at one contact point. Additionally or alternatively, systems within the present disclosure may provide the output as a graphical representation of the sideforce slope index of a bottom hole assembly configuration at one or more points along the bottom hole assembly configuration.

Additionally or alternatively, the technologies of the present disclosure are directed to methods of modeling drilling equipment to represent vibrational performance of the drilling equipment. In some implementations, the method includes a) identifying two or more weighted fundamental excitation modes for a drilling bottom hole assembly; b) constructing at least one surrogate representing at least a portion of a bottom hole assembly; c) utilizing a frequency-domain model to simulate a response of the at least one surrogate to excitations corresponding with the identified fundamental excitation modes; d) determining one or more performance indices for the simulated surrogate; and e) utilizing the one or more performance indices in selecting at least one of one or more bottom hole assembly configurations and one or more drilling plans for use in drilling operations. In some implementations, each fundamental excitation mode may be weighted relative to at least one other fundamental excitation mode. Additionally or alternatively, the excitation modes may be related to at least one vibration-related drilling parameter.

One or more of the determined performance indices may be based at least in part on the simulated response of the surrogate at least at two fundamental excitation modes and on the relative weight of the at least two fundamental excitation modes. The one or more performance indices may be selected from at least one of an end point curvature index, a BHA strain energy index, an average transmitted strain energy index, a transmitted strain energy index, a root-mean-square BHA sideforce index, a root-mean-square BHA torque index, a total BHA sideforce index, a total BHA torque index, a sideforce slope index, a transmissibility index, and any mathematical combination thereof. Other suitable performance indices may be identified.

In some implementations of the present methods, the methods may further include drilling a well using at least one of a) the selected one or more bottom hole assembly configurations and b) the selected one or more drilling plans.

The two or more fundamental excitation modes may be identified in a variety of suitable manners. For example, the fundamental excitation modes may be identified from field data using a method including: a) obtaining field-data dynamic measurements of at least one dynamic state of a drilling bottom hole assembly, wherein each of the measurements is associated with at least one node in the bottom hole assembly; processing the field-data measurements to obtain one or more windows having frequency-domain spectra of at least one of the measured dynamic states; and c) identifying two or more fundamental excitation modes in the one or more windows. The fundamental excitation modes may correspond to regions of the frequency-domain spectra having spectral peaks or accumulations. Additionally, each of the two or more fundamental excitation modes is weighted relative to at least one other fundamental excitation mode.

Continuing with the exemplary field data-based method, the at least one dynamic state may be selected from one or more of rotary speed, displacement, velocity, acceleration, bending strain, bending moment, tilt angle, and force. The field-data may be collected using one or more near-bit sensors. In some implementations, the field-data measurements may be processed using one or more Fourier transforms to provide frequency-domain spectra. Additionally or alternatively, in some implementations, the one or more windows each may present measured data for an interval in a drilling history, wherein the interval is for at least one of a period of time, a depth range, and a rotary speed applied during the drilling. For example, the one or more windows may present intervals of nearly constant rotary speed and the one or more identified fundamental excitation modes may be associated with one or more multiples of the rotary speed having spectral peaks. The field data-based methods may further include drilling a well using at least one of a) the selected one or more bottom hole assembly configurations and b) the selected one or more drilling plans.

In some implementations, the fundamental excitation modes may be identified from both simulated data and field data. An exemplary method may include: a) obtaining measurements of at least one parameter of a drilling bottom hole assembly indicative of vibrational performance, wherein the measurements relate to one or more nodes on the drilling bottom hole assembly; b) constructing a surrogate representing at least a portion of the drilling bottom hole assembly; c) utilizing a frequency-domain model to simulate a response of the surrogate to dynamic excitations at one or more reference nodes corresponding to the nodes on the drilling bottom hole assembly, wherein a response is simulated for each of at least two excitation modes; d) determining a vibrational performance index for each of the at least two excitation modes based at least in part on the response of the surrogate to the dynamic excitations; e) comparing the at least two determined vibrational performance indices with the obtained measurements to determine the relative contribution of each excitation mode to the measured vibration performance; and f) weighting each of the excitation modes according to the respective relative contributions to determine at least two fundamental excitation modes, which are weighted relative to each other.

Continuing with the example utilizing both field and simulated data, the at least one measured parameter may be selected from one or more of rate of penetration, mechanical specific energy, measured downhole acceleration, measured downhole velocity, bending moment, bending strain, shock count, and stick-slip vibrations. Such parameters may be collected in any suitable manner using a variety of equipment and methods readily available. In some implementations, the dynamic excitations of the surrogate may be applied by perturbing at least one model state selected from displacement, tilt angle, moment, and force. Additionally or alternatively, in some implementations, the at least two determined vibrational performance indices may be summed with multiplicative non-negative coefficients to obtain a combined surrogate performance index for comparison with the obtained measurements. The surrogate vibrational performance index may be compared with the obtained measurements while varying the non-negative coefficients for each performance index until differences between the combined performance index and the obtained measurements are at least substantially minimized. When those differences are minimized, excitation coefficients are established corresponding to at least two weighted fundamental excitation modes. As with the other methods described herein, the methods utilizing both field and simulated data may further include drilling a well using at least one of a) the selected one or more bottom hole assembly configurations and b) the selected one or more drilling plans.

The methods described herein may be implemented and/or utilized in the production of hydrocarbons. For example, the methods may include the step of producing hydrocarbons from a well drilled using at least one of a) the selected one or more bottom hole assembly configurations and b) the selected one or more drilling plans.

BRIEF DESCRIPTION OF THE DRAWINGS

The foregoing and other advantages of the present technique may become apparent upon reading the following detailed description and upon reference to the drawings in which.

DETAILED DESCRIPTION

Figure 1:
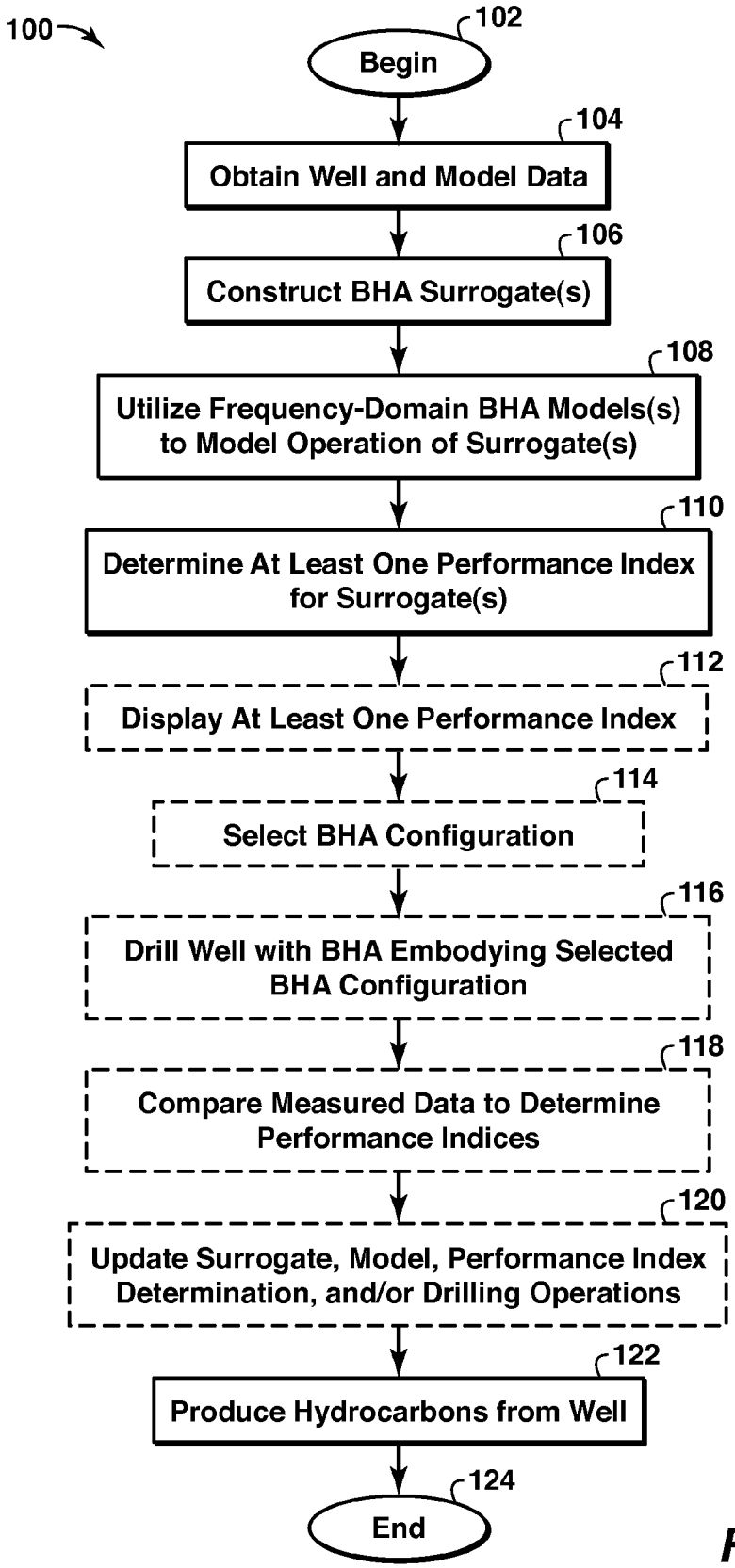
FIG. 1 is an exemplary flow chart for modeling BHA surrogates.

In the following detailed description section, the specific embodiments of the present techniques are described in connection with preferred embodiments. However, to the extent that the following description is specific to a particular embodiment or a particular use of the present techniques, this is intended to be for exemplary purposes only and simply provides a concise description of the exemplary embodiments. Moreover, to the extent that a particular feature or aspect of the present systems and methods are described in connection with a particular embodiment or implementation, such features and/or aspects may similarly be included or used in connection with other embodiments or implementations described herein or otherwise within the scope of the invention claimed in this or related applications. Accordingly, the invention is not limited to the specific embodiments described below, but rather, it includes all alternatives, modifications, and equivalents falling within the true scope of the appended claims.

The present disclosure is directed to methods and systems for modeling, designing, and utilizing bottom hole assemblies to evaluate, analyze, design, and assist in the drilling of wells and in the production of hydrocarbons from subsurface formations. Under the present techniques, a modeling system may include software or modeling programs that characterize the vibration performance of one or more candidate BHA's graphically in what is referred to as "design mode." In some implementations, the vibration performance of two or more candidate BHA's may be displayed graphically and simultaneously to facilitate comparison of the candidate BHA's. The BHA used in a drilling system may be selected based on one or more relative vibration performance indices for different BHA surrogates. These indices may include point indices, such as an end-point curvature index, and interval indices, such as a BHA strain energy index, an average transmitted strain energy index, a transmitted strain energy index, a root-mean-square (RMS) BHA sideforce index, an RMS BHA torque index, a total BHA sideforce index, a total BHA torque index, a transmissibility index, and a sideforce slope index, which are discussed further below, in addition to specific static design objectives for the respective assembly.

Further, the present disclosure provides methods and systems that utilize a "log mode" display to compare predicted vibration characteristics with measured data under specific operating conditions. The same indices used in the design mode may be presented in a log mode display to compare measured drilling data with the indices to assist in assessing the BHA vibration performance and to gain an understanding of how to evaluate the different vibration performance metrics by comparison with field performance data (e.g., measured data). For example, and as will be better understood from the description herein, one or more of the data sets from the design mode, including the vibration performance indices, may be compared against measured data and/or data derived from measured data. The comparison may reveal helpful information such as the components of the BHA most likely contributing to the vibrations, the drilling conditions that will avoid vibrations, relative contributions of particular indices, excitation modes, and/or vibrational modes to the actual performance, and other information to aid in improving the modeling process, the BHA design process, and/or the development of drilling operational plans. Additionally or alternatively, this same data may be plotted in a format similar to that used for the vibration performance indices, with rotary speed and/or bit weight on the independent axes, showing the relationships of the measured data to the vibration performance indices. Since this data is normally obtained in a Drilling Vibrations Data Test, this plot is referred to as the "DVDT" display.

Turning now to the drawings, and referring initially to FIG. 1, an exemplary flow chart 100 of a process of modeling and operating a drilling system in accordance with certain aspects of the present techniques is described. In this process, candidate BHA configurations are represented by surrogates that can be utilized in modeling programs. The modeling programs of the present disclosure provide graphical and/or numerical representations of the how the BHA configuration would operate during implementations under one or more operating conditions. The graphical and/or numerical representations may be presented in the form of one or more indices, which may be evaluated on an absolute or comparative basis to identify a preferred BHA for given operating conditions and/or a preferred set of operating conditions for a given BHA.

The flow chart begins at block 102. At block 104, data may be obtained for use in the methods of the present disclosure. The data may include well operating parameters (e.g., weight on bit (WOB) range, rotary speed range (e.g., rotations per minute (RPM)), nominal borehole diameter, hole enlargement, hole angle, drilling fluid density, depth, and the like). Some model-related parameters may also be obtained, such as the vibrational excitation modes to be modeled (specified as integer and/or non-integer multiples of the rotary speed and/or specific vibration frequencies), element length, boundary conditions, and number of "end-length" elements and the end-length increment value. Then, one or more BHA surrogates may be constructed, as shown in block 106. The construction of the BHA surrogates includes identifying BHA design parameters (e.g., drill collar dimensions and mechanical properties, stabilizer dimensions and locations in the BHA, drill pipe dimensions, length, and the like). As will be described more thoroughly below, the BHA surrogate may be constructed in a variety of suitable manners provided that the surrogate can be modeled using frequency-domain models.

In block 108, the operation of the BHA surrogate is modeled using one or more frequency-domain models. The modeling of the BHA surrogates may include consideration of the static solutions and the dynamic solutions. The modeling may include two dimensional models and/or three dimensional models, both of which are described in better detail below. The frequency-domain models provide various data about the operation of the BHA surrogate, which can be used to generate at least one vibration performance index. FIG. 1 illustrates at block 110 the step of determining at least one vibration performance index for a BHA surrogate. Examples of illustrative vibration performance indices are provided below together with examples of possible uses and interpretations of such indices. At least one index is then displayed or otherwise presented to a user or an operator, which is represented by block 112 in FIG. 1. The display or presentation of the vibration performance index may communicate the index to the user in any suitable manner and in any suitable format. For example, the vibration performance index may be presented in numerical and/or graphical formats. Additionally, the index may be presented on a computer display, on a printed page, transmitted to a remote location for presentation, stored for later retrieval, etc. With experience, a BHA design engineer may appreciate the design tradeoffs and, by comparing vibration performance index results for different designs, may develop BHA designs with improved operating performance and/or identify better operating parameters. An example of the design iteration process is described further below.

FIG. 1 further illustrates that following the determination and display of a vibration performance index, various optional steps may be included in the methods within the scope of the present disclosure. Once modeled, one of the BHA configurations represented by a surrogate may be selected, as shown in block 114. The selection may be based on a comparison of multiple BHA surrogates. That is, the modeling of the BHA surrogates may include different displays of the calculated state vectors (e.g., displacement, tilt, bending moment, lateral shear force of the beam, and BHA/wellbore contact forces and torques) as a function of the operating parameters (e.g., RPM, WOB, etc.), distance to the bit, and BHA configuration. The displayed results or solutions, including the vibration performance indices, may include detailed 3-dimensional state vector plots intended to illustrate the vibrational tendencies of alternative BHA configurations. The selection of a BHA configuration may include selecting a preferred BHA configuration in addition to identifying a preferred operating range for the preferred configuration. The selection may be based on the relative and/or absolute performance of the BHA configurations, which may be evaluated using a variety of indices, including end-point curvature index, BHA strain energy index, average transmitted strain energy index, transmitted strain energy index, RMS BHA sideforce index, RMS BHA torque index, total BHA sideforce index, total BHA torque index, transmissibility index, sideforce slope index, and any mathematical combination thereof. In some implementations, the selection of a BHA configuration may include the selection of a configuration that had been represented by one or more of the BHA surrogates. Additionally or alternatively, the selected BHA configuration may incorporate features or aspects from two or more of the BHA surrogates.

Continuing with the schematic flow chart 100 of FIG. 1, the methods of the present disclosure may optionally include drilling a well with a bottom hole assembly embodying the selected BHA configuration, such as represented by block 116. The drilling of the well may include forming the well to access a subsurface formation with the drilling equipment.

In some implementations, measured data may then be compared with calculated data and/or determined vibration performance indices for the selected BHA configuration, as shown in block 118. That is, as the drilling operations are being performed or at some time period following the drilling operations, sensors may be used to collect measured data associated with the operation of the drilling equipment. For example, the measured data may include but is not limited to RPM, WOB, axial, lateral, and stick/slip vibration measurements, drilling performance as determined by the Mechanical Specific Energy (MSE), or other appropriate derived quantities. Downhole data may be either transmitted to the surface in real-time or it may be stored in the downhole equipment and received when the equipment returns to the surface. The measured data and/or data derived from the measured data may be compared with calculated data and/or vibration performance indices from the modeling system for the selected BHA configuration.

The comparison of the measured data (or data derived from the measured data) with the model data and vibration performance indices can be used in a variety of manners, some examples of which are described in more detail herein. An illustrative and non-exhaustive list of such uses includes 1) updating the surrogate to better represent the BHA configuration; 2) updating the frequency-domain model to better simulate the response of the BHA during drilling operations under a variety of conditions; 3) updating the calculations and/or parameters used to determine one or more vibration performance indices; 4) updating the drilling operations plans for a selected bottom hole assembly configuration, such as represented by box 120 in FIG. 1; and 5) using measured vibration data to determine the model input excitation, simulating the response of the surrogates with this input, and comparing the model results with other measured data that is considered to be the system output response. The feedback process facilitates modeling validation and verification. It also helps to determine which of the vibration performance indices warrant greater weighting in the BHA configuration selection process, thus providing learning aids to advance the development of the BHA configuration selection process. Additionally or alternatively, the comparison between the model results and the measurements may enable the vibration performance indices to more accurately predict or indicate the vibrational tendencies of a BHA surrogate, such as by allowing one or more input parameters of a vibration performance index to be further refined or tuned. One example of such vibration performance index improvements includes weighting the various vibrational excitation modes to more accurately consider the modes that are most relevant.

Once the wellbore is formed, hydrocarbons may be produced from the well, as shown in block 122. The production of hydrocarbons may include completing the well with a well completion, coupling tubing between the well completion and surface facilities, and/or other known methods for extracting hydrocarbons from a wellbore. The process ends at block 124.

Beneficially, the present techniques may be utilized to design, construct, and/or utilize equipment that can reduce the impact of limiters that may hinder drilling operations. In some implementations, two or more BHA configurations may be compared simultaneously with concurrent calculation and display of model results for two or more surrogates. With this comparison, the merits of alternative BHA configurations can be evaluated. Further, in implementations where the calculated model data and the measured data are associated with the selected BHA configuration, other limiters that may be present during the drilling of the wellbore may be identified and addressed in a timely manner to further enhance drilling operations. For example, if the primary limiter appears to be torsional stick/slip vibrations and the sources of torque in the BHA due to contact forces have been minimized, another possible mitigator is to choose a less aggressive bit that generates less torque for a given applied weight on bit. An example of the modeling of two or more BHA configuration surrogates is described in greater detail below in FIG. 2.

Figure 2:
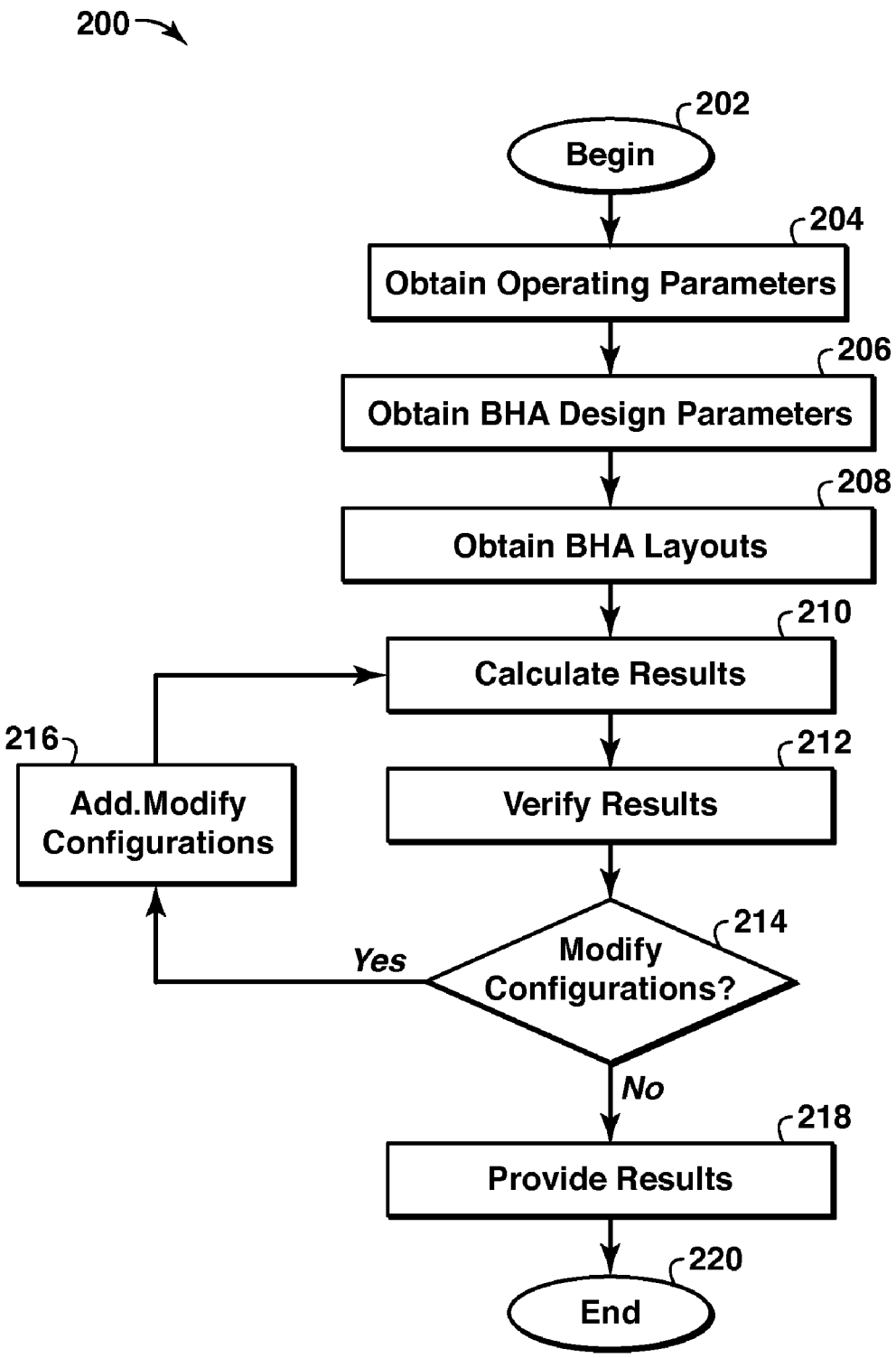
FIG. 2 is an exemplary flow chart for modeling BHA surrogates.

FIG. 2 is an exemplary flow chart 200 of the modeling of two or more BHA surrogates in accordance with certain aspects of the present techniques. For exemplary purposes, in this flow chart, the modeling of the two or more BHA surrogates is described as being performed by a modeling system. The modeling system may include a computer system that operates a modeling program. The modeling program may include computer readable instructions or code that compares two or more BHA surrogates, which is discussed further below. While FIG. 2 is directed to the comparison of two or more BHA surrogates, the present methods and systems are useful in modeling a single BHA surrogate to identify operational and/or design parameters that can be modified to improve performance by reducing vibrations.

The flow chart 200 begins at block 202. To begin, the BHA layout and operating parameters are obtained for use in the modeling operations introduced above. At block 204, operating parameters may be obtained. The operating parameters, such as the anticipated ranges of WOB, RPM and wellbore inclination, may be obtained from a user entering the operating parameters into the modeling system or accessing a file having the operating parameters. For the static model, the condition of the BHA model end-point (e.g., end away from the drill bit) can be set to either a centered condition (e.g., the pipe is centered in the wellbore) or an offset condition (e.g., the pipe is laying on the low side of the wellbore).

The BHA design parameters are then obtained, as shown in block 206. The BHA design parameters may include available drill collar dimensions and mechanical properties, dimensions of available stabilizers, drill pipe dimensions, length, and the like. For example, if the drilling equipment is a section of tubing or pipe, the BHA design parameters may include the inner diameter (ID), outer diameter (OD), length and bending moment of inertia of the pipe, and the pipe material properties. Also, the modeling system may model drilling equipment made of steel, non-magnetic material, Monel, aluminum, titanium, etc. If the drilling equipment is a stabilizer or under-reamer, the BHA design parameters may include blade OD, blade length, and/or distance to the blades from the ends.

At block 208, the initial BHA surrogates are obtained. Obtaining of the BHA surrogates may include accessing a stored version of a previously modeled or utilized BHA configuration or BHA surrogate, interacting with the modeling system to specify or create a BHA surrogate from the BHA design parameters, or entering a proposed BHA configuration into the model that was provided by the drilling engineer or drilling service provider. The BHA surrogates specify the positioning of the equipment and types of equipment in the BHA, usually determined as the distance to the bit of each component.

Once the different BHA surrogates are obtained and/or constructed, the results for the selected BHA surrogates are calculated/modeled, as shown in block 210. The calculations may include calculation of the static states to determine force and tilt angle at the bit and static stabilizer contact forces, calculation of dynamic vibration performance indices, calculation of dynamic state values for specific excitation modes as a function of rotary speed, weight on bit, and distance to bit, and the like. More specifically, the calculations may include the dynamic lateral bending (e.g., flexural mode) and eccentric whirl dynamic response as perturbations about a static equilibrium, which may be calculated using the State Transfer Matrix method described below or other suitable method. This flexural or dynamic lateral bending mode may be referred to as "whirl." The static responses may include the state vector response (e.g., displacement, tilt, bending moment, shear force, and contact forces or torques) as a function of distance from the bit, WOB, fluid density, and wellbore inclination (e.g., angle or tilt angle). For the dynamic response values, the state variables may be calculated as a function of distance from the drill bit, WOB, RPM, excitation mode, and end-lengths. For the lateral bending and eccentric whirl, the model states (e.g., displacement, tilt, bending moment, shear force, and contact forces or torques) may be calculated and displayed as functions of distance from the bit for specified WOB, RPM, excitation mode, and end-length.

As used herein, the "excitation mode" is the integer and/or non-integer multiple of the rotary speed or specific excitation frequency at which the system is being excited (for example, it is well known that a roller cone bit provides a three times multiple axial excitation, which may couple to the lateral mode). The "end-length" is the length of pipe added to the top of the BHA, often in the heavy-weight drillpipe, to evaluate the vibrational energy being transmitted uphole. Because the response may be sensitive to the location of the last nodal point, one computational approach is to evaluate a number of such possible locations for this nodal point for the purpose of computing the response. Then these different results may be averaged (by root-mean-square (RMS) or another averaging method) to obtain the overall system response for the parametric set of the various excitation modes and end-lengths for each RPM and WOB. Additionally or alternatively, the "worst case" maximum value may also be presented, which is described further below.

Once the results are calculated, the results are displayed as shown in block 210. When the present methods are implemented for direct comparison of two or more BHA surrogates, the results may be displayed simultaneously on one or more display screens and/or windows or may be displayed in a common window. As described above, the results may similarly be transmitted to remote locations for display or stored for later retrieval. The display may be on a screen or other audiovisual medium or may be printed. Additionally, the display may include graphical and/or numerical representations of the results.

Continuing with the flow chart of FIG. 2, the results are verified, as shown in block 212. The calculation result verification process may include determining by examination that, for example, there were no numerical problems encountered in the simulation and that all excitation modes were adequately simulated throughout the requested range of rotary speeds, bit weights, and end-lengths. In some implementations, the calculation result verification process may include discarding and/or discounting numerically divergent results in calculating one or more vibration performance indices. Other methods of verifying the results may be implemented.

At block 214, FIG. 2 illustrates that a determination may be made whether the BHA configurations represented by the surrogates and/or other parameters are to be modified. If the BHA configurations or specific parameters are to be modified, the BHA configurations and/or parameters may be modified in block 216. The modifications may include changing specific aspects in the operating parameters, BHA surrogates, BHA design parameters and/or adding a new BHA surrogate. As a specific example, the WOB, RPM and/or excitation mode may be changed to model another set of operating conditions. The BHA configurations and corresponding surrogates are typically adjusted by altering the distance between points of stabilization, by changing the sizes or number of stabilizers and drill collars, by relocating underreamers or cross-overs to a different position in the BHA surrogate, and the like. Once the modifications are complete, the results may be recalculated in block 210, and the process may be iterated to further enhance performance.

However, if the BHA configurations and/or parameters are not to be modified, the results are provided, as shown in block 218. Providing the results may include storing the results in memory, printing a report of the results, and/or displaying the results on a monitor. For example, a side-by-side graphical comparison of selected BHA surrogates and/or preferred operating parameters may be displayed by the modeling system. The results of one or more of the calculated static and dynamic responses for specified WOB, RPM, excitation mode, end-lengths, and vibration indices may be displayed on two-dimensional or three-dimensional plots. Similarly, the results may be displayed as results for a single BHA surrogate, a comparison of results for two or more BHA surrogates, and/or a comparison of modeling results and measured data during actual drilling operations. While FIG. 2 illustrates that the method ends at block 220, additional steps may follow, such as the implementation of drilling operations incorporating the information learned during the methods of FIG. 2.

Beneficially, the modeling of the BHA surrogates may enhance drilling operations by providing a BHA more suitable to the drilling environment. For example, if one of the BHA surrogates is based on drilling equipment utilized in a certain field, then other surrogates may be modeled and directly compared with the previously utilized BHA surrogate. That is, one of the BHA surrogates may be used as a benchmark for comparing the vibration tendencies of other BHA surrogates. In this manner, the BHA surrogates may be compared, either simultaneously or as additional surrogates are modeled, to determine a BHA surrogate that reduces the effect of limiters, such as vibrations. To the extent that the modeling system is adapted to compare more than two different BHA surrogates, additional proposed BHA surrogates can be compared against each other or against a baseline surrogate. The comparative approach may be found to be more practical in some implementations. The relevant question to answer for the drilling engineer relates to which configuration of BHA components operates with the lowest vibrations over the operating conditions for a particular drilling operation. A preferred approach to address this design question is to model several alternative configurations and then select the one that performs in an optimal manner over the expected operating range or to operate the selected configuration at operating parameters suggested by the present methods. Such approach can be accomplished iteratively or through direct and simultaneous comparison of the several configurations.

Exemplary BHA Surrogates

As described above, BHA surrogates are representations of actual BHA configurations that can be input into the modeling systems to simulate the operation or response of the represented BHA configuration in a drilling operation. Accordingly, BHA surrogates, as representations of actual equipment, incorporate one or more assumptions and/or simplifications to allow the equipment to be mathematically modeled. As with most mathematical representations of actual equipment, the representation can be constructed in a variety of manners, some of which may be different but equal in application. Similarly, some of the different surrogate construction techniques may result in different surrogates that are more or less appropriate for different uses.

The present methods encompass the use of any suitable surrogate that can be used in a frequency-domain model of drilling operations to simulate drilling and associated vibrations. Exemplary surrogates include a lumped parameter surrogate and a distributed mass surrogate. In a lumped parameter surrogate, the BHA configuration is represented by point masses connected by massless beam and damper elements. In a distributed mass surrogate, the BHA configuration is represented by a beam having a distributed mass. Depending on the manner in which the BHA surrogate is constructed, the frequency-domain model(s) used to model the operation of the surrogate may vary, such as the selection of a 2D or a 3D frequency-domain model.

As suggested above, the BHA surrogates may be constructed in a variety of manners and the frequency-domain models may vary within the scope of the present disclosure. Through implementation of the present methods, it may be determined that one type of surrogate and/or one type of frequency-domain model more accurately represents actual drilling operations for a particular BHA configuration, for particular operating conditions, or for particular environments. For example, it may be found that 2D lumped parameter surrogates and associated modeling results correspond sufficiently closely to measured data for a particular BHA configuration or drilling application. As another example, it may be found that 3D distributed mass surrogates and associated frequency-domain modeling results more closely correspond to measured data for a particular type of vibration or for a particular excitation mode. Accordingly, methods within the scope of the present disclosure include methods where different BHA surrogates and different frequency-domain models are used to represent one or more BHA configurations in a single drilling operation. Additionally or alternatively, mathematical combinations of different surrogates and/or frequency-domain models may be used to improve the accuracy of the modeling results as compared to measured data.

Exemplary Lumped Parameter BHA Vibration Models

As an example, one exemplary implementation of a BHA vibration model is described. However, it should be noted that other BHA models, for example using one or more of the calculation methods discussed above, may also be used to form a comparative vibration performance index in a similar manner. As used herein, "BHA vibration model" refers to the use of a BHA surrogate and associated frequency-domain modeling principles to model or simulate the vibrations of a drilling operation using the BHA configuration represented by the BHA surrogate. These methods may include but are not limited to two-dimensional or three-dimensional finite element modeling methods. For example, calculating the results for one or more BHA configurations may include generating a surrogate or mathematical model for each BHA configuration; calculating the results of the surrogate for specified operating parameters and boundary conditions; identifying the displacements, tilt angle (first spatial derivative of displacement), bending moment (calculated from the second spatial derivative of displacement), and beam shear force (calculated from the third spatial derivative of displacement) from the results of the surrogate simulation; and determining state vectors and matrices from the identified outputs of the surrogate simulation. In more complex models, these state vectors may be assigned at specific reference nodes, for example at the neutral axis of the BHA cross-section, distributed on the cross-section and along the length of the BHA, or at other convenient reference locations. As such, the state vector response data, calculated from the finite element model results, may then be used to calculate vibration performance indices to evaluate BHA configurations and to compare with alternative BHA configurations, as described herein.

The BHA vibration model described in this section is a lumped parameter model, which is one embodiment of a mathematical model, implemented within the framework of state vectors and transfer function matrices. The state vector represents a complete description of the BHA system response at any given position in the BHA surrogate, which is usually defined relative to the location of the bit. The transfer function matrix relates the value of the state vector at one location with the value of the state vector at some other location. The total system state includes a static solution plus a dynamic perturbation about the static state. The linear nature of the model for small dynamic perturbations facilitates static versus dynamic decomposition of the system. The dynamic model presented in this section is one variety in the class of forced frequency response models, with specific matrices and boundary conditions as described below. Other dynamic models may be developed for BHA vibration models utilizing alternative BHA surrogates and/or alternative operating parameters.

Transfer function matrices may be multiplied to determine the response across a series of elements in the model. Thus, a single transfer function can be used to describe the dynamic response between any two points. A lumped parameter model yields an approximation to the response of a continuous system. Discrete point masses in the BHA surrogate are connected by massless springs and/or dampers to other BHA surrogate mass elements and, in one variation, to the wellbore at points of contact by springs and, optionally, damper elements. The masses are free to move laterally within the constraints of the applied loads, including gravity.

Matrix and State Vector Formulation

For lateral motion of a lumped parameter model in a plane, the state vector includes the lateral and angular deflections, as well as the beam bending moment and shear load. The state vector u is extended by a unity constant to allow the matrix equations to include a constant term in each equation that is represented. The state vector u may then be written as equation (e1) as follows:

$$u = \begin{pmatrix} y \\ \theta \\ M \\ V \\ 1 \end{pmatrix} \tag{e1}$$

Where y is lateral deflection of the beam from the centerline of the assembly, θ is the angular deflection or first spatial derivative of the displacement, M is the bending moment that is calculated from the second spatial derivative of the displacement, and V is the shear load of the beam that is calculated from the third spatial derivative of the displacement. For a three-dimensional model, the state vector defined by equation (e1) may be augmented by additional states to represent the displacements and derivatives along an orthogonal axis at each node. The interactions between the motions at each node may, in the general case, include coupled terms.

By linearity, the total response may be decomposed into a static component $u^s$ and a dynamic component $u^d$ (e.g., $u=u^s+u^d$).

In the forced-frequency response methods, the system is assumed to oscillate at the frequency ω of the forced input, which is a characteristic of linear systems. Then, time and space separate in the dynamic response and, using superposition, the total displacement of the beam at any axial point x for any time t may be expressed by the equation (e2):

$$u(x,t)=u^s(x)+u^d(x)\sin(\omega t) \tag{e2}$$

State vectors $u_i$ (for element index i ranging from 1 to N) may be used to represent the state of each mass element, and the state vector $u_0$ is used to designate the state at the bit. Transfer function matrices are used to relate the state vector $u_i$ of one mass element to the state $u_{i-1}$ of the preceding mass element. If there is no damping in the model, then the state vectors are real-valued. However, damping may be introduced and then the state vectors may be complex-valued, with no loss of generality.

Because state vectors are used to represent the masses, each mass may be assumed to have an associated spring and/or damper connecting it to the preceding mass in the model. With the notation $M_i$ denoting a mass transfer matrix, and a beam bending element transfer matrix represented by $B_i$ the combined transfer function $T_i$ is shown by the equation (e3) below.

$$T_i=M_iB_i \tag{e3}$$

Numerical subscripts are used to specify each mass-beam element pair. For example, the state vector $u_1$ may be calculated from the state $u_o$ represented by the equation (e4).

$$u_1=M_1B_1u_0=T_1u_0, \text{ and thus } u_i=T_iu_{i-1} \tag{e4}$$

These matrices can be cascaded to proceed up the BHA to successive locations. For example, the state vector $u_2$ may be represented by the equation (e5).

$$u_2=T_2u_1=T_2T_1u_0 \tag{e5}$$

While continuing up to a contact point, the state vector $u_N$ may be represented by equation (e6).

$$u_N=T_N u_{N-1}=T_N T_{N-1} \ldots T_1 u_0 \quad \text{(e6)}$$

Accordingly, within an interval between contact points, the state $u_j$ at any mass element can be written in terms of any state below that element $u_i$ using a cascaded matrix $S_{ij}$ times the appropriate state vector by the equation (e7):

$$u_j=S_{ij}u_i \text{ where for } i<j,\ S_{ij}=T_j T_{j-1} \ldots T_{i+1} \quad \text{(e7)}$$

Consideration of the state vector solution at the contact points will be discussed below.

Formulation of Mass Matrices

The mass transfer function matrix for the static problem is derived from the balance of forces acting on a mass element m. Generally, each component of the BHA is subdivided into small elements, and this lumped mass element is subjected to beam shear loads, gravitational loading (assuming inclination angle $\phi$), wellbore contact with a stiffness k, and damping force with coefficient b. The general force balance for the element may be written as equation (e8) using the "dot" and "double dot" notations to represent the first and second time derivatives, or velocity and acceleration, respectively.

$$m\ddot{y}=V_i-V_{i-1}-mg\sin\phi-ky-b\dot{y}=0 \quad \text{(e8)}$$

The lumped mass element transfer function matrix under static loading includes the lateral component of gravity (mg sin $\phi$) and either a contact spring force or, alternatively, a constraint applied in the solution process, in which case the value of k is zero. In the static case, the time derivatives are zero, and thus inertial and damping forces are absent. The static mass matrix may be written as the following equation (e9).

$$M_S=\begin{pmatrix} 1 & 0 & 0 & 0 & 0 \\ 0 & 1 & 0 & 0 & 0 \\ 0 & 0 & 1 & 0 & 0 \\ k & 0 & 0 & 1 & (mg\sin\phi) \\ 0 & 0 & 0 & 0 & 1 \end{pmatrix} \quad \text{(e9)}$$

In lateral dynamic bending, the forces applied to the mass consist of the beam shear forces, wellbore contact, and damping loads. Again, the wellbore contact may be either the result of a spring force or an applied constraint relation. However, because the dynamic perturbation about the static state is sought (using the principle of linear superposition), the gravitational force is absent from the dynamic mass matrix.

In the dynamic example, the applied loads may be unbalanced, leading to an acceleration of the mass element. The mass times lateral acceleration equals the force balance of the net shear load, spring contact, and damping forces, resulting in the equation (e10).

$$m\ddot{y}=V_i-V_{i-1}-ky-b\dot{y} \quad \text{(e10)}$$

Assuming a complex harmonic forced response $y^d \sim e^{i\omega t}$, where i represents the imaginary number equal to $\sqrt{-1}$, the solution to equation (e10) may be found in equation (e11).

$$V_i=V_{i-1}+(k+ib\omega-m\omega^2) \quad \text{(e11)}$$

The lumped mass element transfer function matrix $M_B$, for the lateral bending mode dynamic perturbation, is then written by the following equation (e12).

$$M_B=\begin{pmatrix} 1 & 0 & 0 & 0 & 0 \\ 0 & 1 & 0 & 0 & 0 \\ 0 & 0 & 1 & 0 & 0 \\ (k+ib\omega-m\omega^2) & 0 & 0 & 1 & 0 \\ 0 & 0 & 0 & 0 & 1 \end{pmatrix} \quad \text{(e12)}$$

The mass matrix in the dynamic whirl model involves a constant-magnitude force which resembles the gravitational force in the static mass matrix. It is assumed that each drill collar has a slightly unbalanced mass, generating a centrifugal force proportional to this unbalanced mass times the square of the rotational frequency. For a small value $\epsilon$ which represents the dimensionless off-axis distance of the unbalanced mass, the equation of motion for forced response is given by equation (e13).

$$m\ddot{y}=V_i-V_{i-1}+\epsilon m\omega^2-ky-b\dot{y} \quad \text{(e8)}$$

The radial displacement does not change with time for this simplified whirl mode example, and thus the acceleration and velocity may be set to zero. This represents a steady rotational motion, not unlike a rotating gravitational load, in contrast to the lateral bending mode in which the displacement oscillates through a zero value. The resulting whirl matrix is represented in equation (e14).

$$M_W=\begin{pmatrix} 1 & 0 & 0 & 0 & 0 \\ 0 & 1 & 0 & 0 & 0 \\ 0 & 0 & 1 & 0 & 0 \\ k & 0 & 0 & 1 & (\varepsilon m\omega^2) \\ 0 & 0 & 0 & 0 & 1 \end{pmatrix} \quad \text{(e14)}$$

The value $\epsilon$ may take either positive or negative signs in order to represent the shape of the whirl response being modeled. The first whirl mode is generally represented by alternating signs on successive intervals of BHA components as one proceeds up the borehole.

The lumped parameter mass m is defined as the mass of the element piece of the respective BHA component. In addition, the mass of the drill collar, pipe, or other BHA component is effectively increased by the drilling fluid contained within the collar and that which is entrained by the BHA element as it vibrates. The technique of "added mass" may be used to approximate this phenomenon. For this purpose, a crude approximation is to increase the dynamic collar mass by 10%, leading to a slight reduction in natural frequency. This is a representative value only, and calibration of model results with field data may indicate alternative values for the "added mass" effect that may be used in the model. Note that it is not appropriate to apply the added mass to the static solution. As noted above, depending on the solution method, the spring constant may be omitted if the solution is to apply a constraint relationship such that the BHA model is not permitted to extend outside the wellbore by more than a very small amount.

If the constraint model is not used, then the contact stiffness k in the above relations should be included explicitly. In this example, a factor to be considered in the choice of wellbore contact stiffness k when modeling dynamic excitation is that the value of k should be chosen sufficiently high for the mass m such that the natural frequency $\sqrt{k/m}$ is greater than the maximum excitation frequency $\omega$ to be evaluated, so that resonance due to this contact representation is avoided. Thus, for an excitation mode of n times the rotary speed, the contact stiffness k may be greater than $m(n\omega)^2$ (e.g., $k>m(n\omega)^2$).

Alternatively, and in the preferred embodiment, compliance at the points of contact between BHA and wellbore may be neglected and a fixed constraint relationship applied in the solution method, with k=0 in the matrices above. This approach is described further below.

Formulation of Stiffness Matrix

The Euler-Bernoulli beam bending equation for a uniform beam with constant Young's modulus E, bending moment of inertia I, and axial loading P may be written as the fourth-order partial differential equation (e15).

$$EI\frac{\partial^4 y}{\partial x^4} - P\frac{\partial^2 y}{\partial x^2} = 0 \tag{e15}$$

The characteristic equation for the general solution is represented by equation (e16)

$$y=e^{\beta x} \tag{e16}$$

This equation expresses the lateral displacement as the exponential power of a parameter β times the distance x from a reference point, in which the term β is to be found by replacing this solution in equation (e15) and solving with equations (e17) and (e18) below.

$$\beta^2\left(\beta^2 - \frac{P}{EI}\right) = 0 \tag{e17}$$

$$\beta = 0, \pm\sqrt{\frac{P}{EI}} \tag{e18}$$

Note that β is either real (beam in tension), imaginary (beam in compression), or 0 (no axial loading). The appropriate particular solution is a constant plus linear term in x. Thus, the displacement of an axially loaded beam may be represented by the equation (e19).

$$y=a+bx+ce^{\beta x}+de^{-\beta x} \tag{e19}$$

where the constants a, b, c, and d are found by satisfying the boundary conditions.

The remaining components of the state vector are determined by the following equations in the spatial derivatives of lateral displacement with the axial coordinate x (e20).

$$\theta = \frac{\partial y}{\partial x}\ M = EI\frac{\partial^2 y}{\partial x^2}\ V = -EI\frac{\partial^3 y}{\partial x^3} \tag{e20}$$

The resulting beam bending stiffness transfer function matrix B may be represented by the following equation (e21).

$$B = \begin{pmatrix} 1 & L & \left(\frac{-2+e^{\beta L}+e^{-\beta L}}{2P}\right) & \left(\frac{2\beta L - e^{\beta L}+e^{-\beta L}}{2P\beta}\right) & 0 \\ 0 & 1 & \left(\frac{e^{\beta L}-e^{-\beta L}}{2\beta EI}\right) & \left(\frac{2-e^{\beta L}-e^{-\beta L}}{2P}\right) & 0 \\ 0 & 0 & \left(\frac{e^{\beta L}+e^{-\beta L}}{2}\right) & \left(\frac{-e^{\beta L}+e^{-\beta L}}{2\beta}\right) & 0 \\ 0 & 0 & \left(\frac{-\beta e^{\beta L}+\beta e^{-\beta L}}{2}\right) & \left(\frac{e^{\beta L}+e^{-\beta L}}{2}\right) & 0 \\ 0 & 0 & 0 & 0 & 1 \end{pmatrix} \tag{e21}$$

Boundary Conditions and System Excitation

With the mass and beam element transfer functions defined, the boundary conditions and system excitation are determined to generate frequency-domain model predictions. Separate boundary conditions are used to model the static bending, dynamic lateral bending, and eccentric whirl problems.

In each of these examples of lumped parameter BHA vibration models, the solution proceeds from the bit to the first stabilizer or other contact point, then from the first stabilizer to the second stabilizer or other contact point, and so on, proceeding uphole one solution interval at a time (e.g., from the bit as the starting interval). Finally, the interval from the top contact point to the end point is solved. As suggested, contact points are often provided by stabilizers, but may be provided by other BHA components, such as an underreamer, or perhaps even by contact of one or more BHA components at intermediate points between specific contact points, such as drill collars resting on the wall between stabilizers. For convenience and brevity herein, the exemplary stabilizer will be used to refer to the variety of BHA components that may provide a contact point. The end point is the upper node of the BHA model, and it may be varied to consider different possible nodal points at the "end-length." An appropriate lateral displacement for this end point is assumed in the static model, based on the amount of clearance between the pipe and the wellbore.

In these methods, the states in each solution interval are determined by three conditions at the lower element (bit or bottom stabilizer in the interval), and one condition at the upper element (end point or top stabilizer in the interval). With these four conditions and the overall matrix transfer function from the lower to the upper element, the remaining unknown states at the lower element may be calculated.

Beginning at the bit, the displacement of the first stabilizer is used to determine the bit state, and thus all states up to the first stabilizer are determined using the appropriate transfer function matrices. By continuity, the displacement, tilt, and moment are now determined at the first stabilizer point of contact. The beam shear load is undetermined, as this state does not have a continuity constraint because there is an unknown side force acting between the stabilizer and the wellbore. The displacement of the next stabilizer is used to provide the fourth condition necessary to obtain the solution over the next interval, and thus the complete state at the stabilizer is determined. The contact force between stabilizer and wellbore may be calculated as the difference between this state value and the prior shear load calculation from the previous BHA section. Using the cascaded matrix formulation in equation (e22)

$$\begin{pmatrix} y_j \\ \theta_j \\ M_j \\ V_j \\ 1 \end{pmatrix} = S_{ij}\begin{pmatrix} y_i \\ \theta_i \\ M_i \\ V_i \\ 1 \end{pmatrix} \text{ with the conditions } \begin{pmatrix} V_i \cdot \text{unknown} \\ y_j = 0 \end{pmatrix} \tag{e22}$$

Then the unknown shear load at the lower stabilizer is calculated using an equation (e23) to obtain zero displacement at the upper position.

$$0=S_{11}y_i+S_{12}\theta_i+S_{13}M_i+S_{14}V_i+S_{15} \tag{e23}$$

The beam shear load is discontinuous across the contact points, and the sideforce at such a node may be calculated as the difference between the value obtained by propagating the states from below, $V_i^-$, and the value calculated to satisfy the constraint relation for the next segment, $V_i^+$. Therefore, the contact sideforce may be represented by the equation (e24).

$$F_i = V_i^+ - V_i^- \tag{e24}$$

For the static example, the tilt and sideforce are unknown at the bit. A trial bit tilt angle is used to generate a response and the state vectors are propagated uphole from one contact point to the next, finally reaching the end-point. The final value for the bit tilt angle and sideforce are determined by iterating until the appropriate end condition is reached at the top of the model, for instance a condition of tangency between the pipe and borehole wall. Alternatively, the solution may start at an uphole point of tangency and proceed downhole to the bit, iterating to convergence on the bit condition by varying the distance to the point of tangency. Other convergence methods may also be selected.

Additionally or alternatively, the stabilizer configuration or the configuration of another element of the BHA surrogate may suggest an additional constraint. For example, for full-gauge stabilizers, it may be appropriate to further constrain the BHA vibration model to a tilt angle of zero. Such a constraint may be appropriate due to the interactions between the full-gauge stabilizers and the wellbore wall. A BHA vibration model incorporating this additional constraint will result in an increase in the reaction sideforces in the model and a discontinuity in the bending moment will occur to represent the reaction torque due to the fixed tilt angle constraint. Additionally, equation (e22) above will be modified with the additional constraint as equation (e22') for the node j where the tilt constraint applies.

$$\begin{pmatrix} y_j \\ \theta_j \\ M_j \\ V_j \\ 1 \end{pmatrix} = S_{ij} \begin{pmatrix} y_i \\ \theta_i \\ M_i \\ V_i \\ 1 \end{pmatrix} \text{ with the conditions } \begin{pmatrix} y_j = 0 \\ \theta_j = 0 \\ M_j \text{ unknown} \\ V_i \text{ unknown} \end{pmatrix} \tag{e22'}$$

For the dynamic models (flexural bending, whirl, and twirl), a reference bit excitation sideforce is applied, e.g., $V_{bit}$=const. The first stabilizer is assumed to be constrained by the pinned condition (e22) or by the built-in condition (e22'). If applying (e22), two more conditions are specified to uniquely solve the equations from the bit up to the first stabilizer. One choice for the boundary conditions is to assume that for small lateral motion, the tilt and moment at the bit are zero. This set of boundary conditions may be written as shown in equation (e25):

$$y_{stab} = \theta_{bit} = M_{bit} = 0 \; V_{bit} = \text{const} \tag{e25}$$

An alternate set of boundary conditions may be considered by assuming that the tilt angle at the first stabilizer is zero as in (e22'), equivalent to a cantilevered condition. One selection for the remaining constraint is to assume that there is no moment at the bit. This alternate set of boundary conditions may be written as shown in equation (e26):

$$y_{stab} = \theta_{stab} = M_{bit} = 0 \; V_{bit} = \text{const} \tag{e26}$$

As is well understood, the bit may be excited in a variety of manners leading to dynamic vibrations. The bit excitation by way of an applied sideforce described above is one common manner. The present methods may be adapted to provide BHA vibration models for other forms of bit excitation as well. As one exemplary modification to accommodate or consider an alternative form of bit excitation, the bit may be excited by an applied moment at the bit, such as may occur in drilling operations when the bit is penetrating a laminated formation. The BHA vibration model may be run utilizing an applied excitation frequency for an applied moment at the bit at any multiple of the rotary speed. In some implementations, it may be preferred to run the model multiple times utilizing various multiples of the rotary speed and considering averages, maximums, and/or historical/measured data to provide a more robust and/or accurate model. For example, while a 1× multiple of the rotary speed may be the most likely excitation frequency, the model may be run using various multiples, including non-integer multiples such as 1.5×, 1.75×, etc. Additionally and alternatively, a fixed excitation frequency can be applied to the bit to represent certain excitation sources that are constant in frequency and not multiples of the rotary speed. One example is the drilling fluid pressure which has pressure pulses in accordance with the stroke rate of the mud pumps. These pulses may cause lateral motion at the bit due to the time-varying pressure drop through the bit nozzles.

When the excitation is modeled as an applied moment at the bit, equations (e25) and (e26) above will be changed to correspond to the changed excitation mode. For the boundary conditions identified above in connection with equations (e25) and (e26), the boundary conditions for applied moment at the bit may be written as in equations (e25') and (e26'), as seen below.

$$y_{stab} = y_{bit} = V_{bit} = 0 \; M_{bit} = \text{const} \tag{e25'}$$

$$y_{stab} = \theta_{stab} = V_{bit} = 0 \; M_{bit} = \text{const} \tag{e26'}$$

Regardless of the form of excitation applied, which may include one or more of those described above and/or other common excitations, the solution marches uphole one stabilizer at a time. The solution, or rather the implementation of the model, terminates at the last node of the BHA surrogate, which is arbitrarily chosen but may be located at different "end-lengths" in the dynamic case. By selecting different end-lengths and RMS-averaging the results, vibration performance indices may be formed that are robust. To guard against strong resonance at an individual nodal point, the maximum result may be examined as well, and conversely, the minimum value may be examined to evaluate possible preferred operating regions. These techniques of RMS-averaging and examining the maximum may be preferred when determining a vibration performance index that is sensitive to the selection of a nodal point location. For example, an end-point curvature index and other point indices may be more sensitive to nodal point locations than the interval indices described herein. Being less sensitive to the end location and condition, the interval indices may be preferred in some implementations. It should further be noted, as indicated above, that BHA contact with the borehole at locations between stabilizers may optionally be treated as a nodal point in this analysis method, and the solution propagation modified accordingly.

Exemplary Distributed Mass BHA Vibration Models

As introduced above, bottom hole assemblies can be represented by surrogates of a variety of construction methods. The exemplary model described above considered a lumped parameter BHA vibration model in great detail. As an illustration of other BHA surrogates and associated frequency-domain models that may be used in BHA vibration models within the scope of the present disclosure, an exemplary distributed mass BHA vibration model will now be described with reference to the discussions above.

As with the discussion above, the system state vector for a distributed mass BHA vibration model is written as equation (e27):

$$u = \begin{pmatrix} y \\ \theta \\ M \\ V \\ 1 \end{pmatrix} = \begin{pmatrix} \text{lateral deflection} \\ \text{angular deflection} \\ \text{bending moment} \\ \text{shear load} \\ \text{unity constant} \end{pmatrix} \tag{e27}$$

By linearity, the total response may be decomposed into static and dynamic components. In the forced-frequency response method, the system is assumed to oscillate at the frequency of the forced input; this is a characteristic of linear systems. Then time and space separate in the dynamic response, and, using superposition, one may write the state vector as a function of time and space as equation (e28):

$$u(x,t)=u^s(x)+u^d(x)\sin(\omega t) \tag{e28}$$

While many of the principles from the above lumped parameter discussion are relevant to this distributed mass example, several of the factors and relationships described above depended on the mass of the BHA as represented in the surrogates. As the distributed mass BHA surrogate does not simplify the BHA configuration as point mass and springs and/or dampers, several of the relationships described above are adapted to correspond with the construction of the BHA surrogate, as will be seen below. The relations to describe the beam deflections depend on the beam properties (E and I) and the distributed weight per unit length, W. The axial load, P, is also a factor that translates directly from the lumped parameter model to the distributed mass model. As with the above example, the present example will consider both the static case and the dynamic case (or dynamic perturbations around the static solution).

Static Case Solution

Considering first the impact of the distributed mass on the static solution described above for the lumped parameter model, a primary difference between the lumped parameter model and the distributed mass model lies in the transfer matrices used in the models. In the above discussion the BHA surrogate was represented by both a mass transfer matrix and a beam bending element transfer matrix (see equation (e3)). However, in the distributed mass models, the mass is distributed along the length of the beam and the two elements (mass and beam bending) can be considered together in a single transfer function, as seen below. Additionally, the relevant mass effect is the component of gravity orthogonal to the axis of the wellbore. Accordingly, it is necessary to adjust the material weight per unit length by the sine of the inclination angle, $\phi$. Therefore, using the term $W=(-\rho Ag)$ for density $\rho$, cross-sectional area A, and gravitational constant g, equation (e15) from above is modified as equation (e29):

$$EI\frac{d^4 y}{dx^4} - P\frac{d^2 y}{dx^2} - W\sin(\varphi) = 0 \tag{e29}$$

Assuming an exponential solution to the homogeneous equation of the form $e^{\beta x}$ (see equation (e16) above) yields a characteristic equation with the solution for $\beta$ of the form shown above as equation (e18) and repeated here for convenience as equation (e30):

$$\beta = 0, \pm\sqrt{\frac{P}{EI}} \tag{e30}$$

The term $\beta$ is either real (beam in tension), imaginary (beam in compression), or zero (no axial loading). The particular solution is the sum of linear and quadratic terms in x plus a constant, and the homogeneous solution includes exponential functions with both possible values for $\beta$. Thus, the displacement of an axially loaded beam may be represented by the equation (e31):

$$y=ax^2+bx+c+de^{\beta x}+fe^{-\beta x} \tag{e31}$$

As before, the derivatives can be identified relative to the system state variables, $$\theta = \frac{\partial y}{\partial x} \quad M = EI\frac{\partial^2 y}{\partial x^2} \quad V = -EI\frac{\partial^3 y}{\partial x^3} \tag{e32}$$

The matrix that relates the state vector at x=0 to the state at x=L for the lateral beam bending of a distributed mass with axial loading is then written as equation (e33). Here, we denote the matrix as T to identify the distributed mass matrix with the combined mass and stiffness matrix as shown in (e3). The subsequent matrix operations to obtain the solution then follow as described above, with a simple change in the matrix calculations to reflect the distributed mass model surrogates.

$$T_S = \tag{e33}$$

$$\begin{pmatrix} 1 & L & \left(\frac{-2+e^{\beta L}+e^{-\beta L}}{2P}\right) & \left(\frac{2\beta L-e^{\beta L}+e^{-\beta L}}{2P\beta}\right) & \left(\frac{-(\beta L)^2-2+e^{\beta L}+e^{-\beta L}}{2P\beta^2}\right)\cdot W\sin(\varphi) \\ 0 & 1 & \left(\frac{e^{\beta L}-e^{-\beta L}}{2\beta EI}\right) & \left(\frac{2-e^{\beta L}-e^{-\beta L}}{2P}\right) & \left(\frac{-2\beta L+e^{\beta L}-e^{-\beta L}}{2P\beta}\right)\cdot W\sin(\varphi) \\ 0 & 0 & \left(\frac{e^{\beta L}+e^{-\beta L}}{2}\right) & \left(\frac{-e^{\beta L}+e^{-\beta L}}{2\beta}\right) & \left(\frac{-2+e^{\beta L}+e^{-\beta L}}{2\beta^2}\right)\cdot W\sin(\varphi) \\ 0 & 0 & \left(\frac{-\beta e^{\beta L}+\beta e^{-\beta L}}{2}\right) & \left(\frac{e^{\beta L}+e^{-\beta L}}{2}\right) & \left(\frac{-e^{\beta L}+e^{-\beta L}}{2\beta}\right)\cdot W\sin(\varphi) \\ 0 & 0 & 0 & 0 & 1 \end{pmatrix}$$

For a beam in compression, P is negative, $\beta$ is imaginary, and we have equations (e34):

$$\beta = i\lambda \quad \lambda = \pm\sqrt{\frac{-P}{EI}} \quad \lambda^2 = \frac{-P}{EI} \tag{e34}$$

$$e^{i\lambda L}+e^{-i\lambda L} = 2\cos(\lambda L) \quad e^{i\lambda L}-e^{-i\lambda L} = 2i\sin(\lambda L)$$

and the beam matrix equation reduces to equation (e35):

$$T_{S,COMP} = \begin{pmatrix} 1 & L & \left(\frac{\cos(\lambda L)-1}{P}\right) & \left(\frac{\lambda L - \sin(\lambda L)}{P\lambda}\right) & \left(\frac{1-\cos(\lambda L)}{\lambda^2} - \frac{L^2}{2}\right)\cdot\frac{W\sin(\varphi)}{P} \\ 0 & 1 & \left(\frac{\sin(\lambda L)}{\lambda EI}\right) & \left(\frac{1-\cos(\lambda L)}{P}\right) & \left(\frac{\sin(\lambda L)-\lambda L}{\lambda}\right)\cdot\frac{W\sin(\varphi)}{P} \\ 0 & 0 & \cos(\lambda L) & \left(\frac{-\sin(\lambda L)}{\lambda}\right) & EI\cdot(\cos(\lambda L)-1)\cdot\frac{W\sin(\varphi)}{P} \\ 0 & 0 & \lambda\sin(\lambda L) & \cos(\lambda L) & \lambda\cdot EI\cdot\sin(\lambda L)\cdot\frac{W\sin(\varphi)}{P} \\ 0 & 0 & 0 & 0 & 1 \end{pmatrix} \tag{e35}$$

For a beam in tension, β is real-valued and we have equations (e36):

$$e^{\beta L}+e^{-\beta L}=2\cos h(\beta L)\quad e^{\beta L}-e^{-\beta L}=2\sin h(\beta L) \tag{e36}$$

and the beam matrix equation reduces to equation (e37):

$$T_{S,TENS} = \begin{pmatrix} 1 & L & \left(\frac{\cosh(\beta L)-}{P}\right) & \left(\frac{\beta L - \sinh(\beta L)}{P\beta}\right) & \left(\frac{\cosh(\beta L)-1}{\beta^2} - \frac{L^2}{2}\right)\cdot\frac{W\sin(\varphi)}{P} \\ 0 & 1 & \left(\frac{\sinh(\beta L)}{\beta EI}\right) & \left(\frac{1-\cosh(\beta L)}{P}\right) & \left(\frac{\sinh(\beta L)-\beta L}{\beta}\right)\cdot\frac{W\sin(\varphi)}{P} \\ 0 & 0 & \cosh(\beta L) & \left(\frac{-\sinh(\beta L)}{\beta}\right) & EI\cdot(\cosh(\beta L)-1)\cdot\frac{W\sin(\varphi)}{P} \\ 0 & 0 & -\beta\sinh(\beta L) & \cosh(\beta L) & (-\beta)\cdot EI\cdot\sinh(\beta L)\cdot\frac{W\sin(\varphi)}{P} \\ 0 & 0 & 0 & 0 & 1 \end{pmatrix} \tag{e37}$$

For a beam with no axial loading, the differential equation is simplified because the term involving P drops out. The solution is a fourth-order polynomial, and the corresponding matrix result is the following equation (e38):

$$T_{S,ZERO} = \begin{pmatrix} 1 & L & \frac{L^2}{2EI} & (-1)\cdot\frac{L^3}{6EI} & \frac{W\sin(\varphi)\cdot L^4}{24EI} \\ 0 & 1 & \frac{L}{EI} & (-1)\cdot\frac{L^2}{2EI} & \frac{W\sin(\varphi)\cdot L^3}{6EI} \\ 0 & 0 & 1 & (-L) & \frac{W\sin(\varphi)\cdot L^2}{2} \\ 0 & 0 & 0 & 1 & (-L)\cdot W\sin(\varphi) \\ 0 & 0 & 0 & 0 & 1 \end{pmatrix} \tag{e38}$$

Having identified the beam matrices for the different conditions under which the BHA surrogate may be placed during the simulations, the matrices may be used to calculate the static solutions using methods analogous to those described above.

Dynamic Bending Solution

Turning now to consider the dynamic perturbation about the static solution, by separation of variables, the total displacement is the product of a function of space and a function of time, as seen in equation (e39):

$$u^d(x,t)=y(x)\tau(t) \tag{e39}$$

The components of the total displacement that are a function of time can be further described by equations (e40):

$$\frac{d^2\tau_1}{dt^2} = -\omega_n^2\tau \quad \tau(t) = A\cos(\omega_n t) + B\sin(\omega_n t) \tag{e40}$$

With reference to the above discussions as a framework, the dynamic equation for an interval with a constant axial load P, weight per unit length W, and gravitational constant g may be written as equation (e41):

$$EI\frac{d^4y}{dx^4} - P\frac{d^2y}{dx^2} - \frac{W}{g}\omega_n^2 y = 0 \tag{e41}$$

Writing y as an exponential function of x, the characteristic polynomial is equation (e42):

$$r^4 - \frac{P}{EI}r^2 - \frac{W\omega_n^2}{g\cdot EI} = 0 \tag{e42}$$

This fourth-order equation has two solutions, κ and λ, shown in equations (e43):

$$\kappa^2 = \left[\frac{P^2}{4(EI)^2} + \frac{W\omega_n^2}{g\cdot EI}\right]^{1/2} + \frac{P}{2EI}$$
$$\lambda^2 = \left[\frac{P^2}{4(EI)^2} + \frac{W\omega_n^2}{g\cdot EI}\right]^{1/2} - \frac{P}{2EI} \tag{e43}$$

The solution to the equation can be given in general form as equation (e44):

$$y(x)=c_1\cos h(\kappa x)+c_2\sin h(\kappa x)+c_3\cos(\lambda x)+c_4\sin(\lambda x) \tag{e44}$$

Within an element, the position x=0 can be chosen at one face, and the opposite face is then at x=L. At the origin, the cosine functions have unity value, and the sine functions are zero, which can be presented in normalized state vector form as equation (e45):

$$\begin{pmatrix} y_o \\ \theta_o \\ M_o \\ V_o \end{pmatrix} = \begin{bmatrix} 1 & 0 & 1 & 0 \\ 0 & \kappa & 0 & \lambda \\ \kappa^2 EI & 0 & (-\lambda^2)EI & 0 \\ 0 & (-\kappa^3)EI & 0 & \lambda^3 EI \end{bmatrix}\cdot\begin{pmatrix} c_1 \\ c_2 \\ c_3 \\ c_4 \end{pmatrix} \tag{e45}$$

This matrix is invertible, so the coefficients can be solved for in terms of the state vector at one face of the element, as shown in equation (e46).

$$\begin{pmatrix} c_1 \\ c_2 \\ c_3 \\ c_4 \end{pmatrix} = \left(\frac{1}{\lambda^2+\kappa^2}\right)\begin{bmatrix} \lambda^2 & 0 & \frac{1}{EI} & 0 \\ 0 & \frac{\lambda^2}{\kappa} & 0 & \left(\frac{-1}{\kappa\cdot EI}\right) \\ \kappa^2 & 0 & \left(\frac{-1}{EI}\right) & 0 \\ 0 & \frac{\kappa^2}{\lambda} & 0 & \frac{1}{\lambda EI} \end{bmatrix}\cdot\begin{pmatrix} y_o \\ \theta_o \\ M_o \\ V_o \end{pmatrix} \tag{e46}$$

The state vector at location x=L can now be determined, using equation (e47)

$$\begin{pmatrix} y_L \\ \theta_L \\ M_L \\ V_L \end{pmatrix} = \left(\frac{1}{\lambda^2+\kappa^2}\right) \begin{bmatrix} \cosh(\kappa L) & \sinh(\kappa L) & \cos(\lambda L) & \sin(\lambda L) \\ \kappa\sinh(\kappa L) & \kappa\cosh(\kappa L) & -\lambda\sin(\lambda L) & \lambda\cos(\lambda L) \\ \kappa^2 EI\cdot\cosh(\kappa L) & \kappa^2 EI\cdot\sinh(\kappa L) & -\lambda^2 EI\cdot\cos(\lambda L) & -\lambda^2 EI\cdot\sin(\lambda L) \\ -\kappa^3 EI\cdot\sinh(\kappa L) & -\kappa^3 EI\cdot\cosh(\kappa L) & -\lambda^3 EI\cdot\sin(\lambda L) & \lambda^3 EI\cdot\cos(\lambda L) \end{bmatrix} \cdot \begin{bmatrix} \lambda^2 & 0 & \frac{1}{EI} & 0 \\ 0 & \frac{\lambda^2}{\kappa} & 0 & \left(\frac{-1}{\kappa\cdot EI}\right) \\ \kappa^2 & 0 & \left(\frac{-1}{EI}\right) & 0 \\ 0 & \frac{\kappa^2}{\lambda} & 0 & \frac{1}{\lambda EI} \end{bmatrix} \cdot \begin{pmatrix} y_o \\ \theta_o \\ M_o \\ V_o \end{pmatrix} \tag{e47}$$

The matrices may be multiplied to obtain equations (e48), for which the components of the transfer function matrix T are written individually.

$$\begin{pmatrix} y_L \\ \theta_L \\ M_L \\ V_L \end{pmatrix} = \left(\frac{1}{\lambda^2+\kappa^2}\right)\cdot T \cdot \begin{pmatrix} y_o \\ \theta_o \\ M_o \\ V_o \end{pmatrix} \tag{e48}$$

$$T_{11} = \lambda^2\cosh(\kappa L) + \kappa^2\cos(\lambda L)$$

$$T_{12} = \frac{\lambda^2}{\kappa}\sinh(\kappa L) + \frac{\kappa^2}{\lambda}\sin(\lambda L)$$

$$T_{13} = \frac{1}{EI}(\cosh(\kappa L) - \cos(\lambda L))$$

$$T_{14} = \frac{1}{EI}\left(\frac{\sin(\lambda L)}{\lambda} - \frac{\sinh(\kappa L)}{\kappa}\right)$$

$$T_{21} = \kappa\lambda\cdot(\lambda\sinh(\kappa L) - \kappa\sin(\lambda L))$$

$$T_{22} = \lambda^2\cosh(\kappa L) + \kappa^2\cos(\lambda L)$$

$$T_{23} = \frac{1}{EI}(\kappa\sinh(\kappa L) + \lambda\sin(\lambda L))$$

$$T_{24} = \frac{1}{EI}(\cos(\lambda L) - \cosh(\kappa L))$$

$$T_{31} = \lambda^2\kappa^2 EI(\cosh(\kappa L) - \cos(\lambda L))$$

$$T_{32} = \lambda\kappa\cdot EI(\lambda\sinh(\kappa L) - \kappa\sin(\lambda L))$$

$$T_{33} = \kappa^2\cosh(\kappa L) + \lambda^2\cos(\lambda L)$$

$$T_{34} = (-\kappa\sinh(\kappa L) - \lambda\sin(\lambda L))$$

$$T_{41} = (-\lambda^2\kappa^2 EI(\kappa\sinh(\kappa L) + \lambda\sin(\lambda L)))$$

$$T_{42} = \lambda^2\kappa^2 EI(\cos(\lambda L) - \cosh(\kappa L))$$

$$T_{43} = \lambda^3\sin(\lambda L) - \kappa^3\sinh(\kappa L)$$

$$T_{44} = \kappa^2\cosh(\kappa L) + \lambda^2\cos(\lambda L)$$

In the absence of contact within the element, when all of the states are known at the first location (x=0), the states at a second location can be calculated (x=L). Just as in the above solution for the lumped parameter model, the intermediate states and matrices may be combined so that the calculation comprises a matrix relationship from one contact point to the next. However, the shear load $V_o$ is not known because there will be a dynamic sideforce at the first contact point to match the constraint at the second contact, namely that the displacement is equal to zero for the dynamic perturbation. The four known quantities then facilitate calculation of the unknowns in the same manner as for the lumped parameter model.

Additionally and alternatively, it should be noted that the variables M and V may be normalized to new variables μ and v, respectively, by dividing by a scale factor $EI_o$ that is characteristic of the BHA. The terms in the equations above, and the corresponding static and dynamic computations, may then be adjusted by the scale factor for the new state vector in the scaled variables, $(y\ \theta\ \mu\ v\ 1)^T$. In all other respects, the solution methods for the continuous mass equations are the same as those for the lumped parameter model.

Three Dimensional Frequency-Domain Models

The models and methods described above are essentially two-dimensional, considering the lateral dynamic bending vibration in a plane for the "flex" mode and the centrifugal effects in the "twirl" mode. By extending these methods to include both transverse coordinates, and by preserving the frequency-domain approach, advanced models can be developed to provide a three-dimensional representation to more accurately represent these bending and centrifugal vibrations. These revised and improved models would consider the dynamic effects of angular momentum and its effect on the BHA vibrations, including the gravitational effects. The following discussion provides an example of extending the above methods into a three-dimensional frequency-domain model. The teachings of the following examples can be adapted in a variety of ways depending on the configuration of the bottom hole assembly being considered. Additionally or alternatively, certain assumptions or conventions utilized in the exemplary methods below can be adjusted with alternative assumptions and/or conventions without departing from the scope of the present disclosure and claims.

Figure 3A:
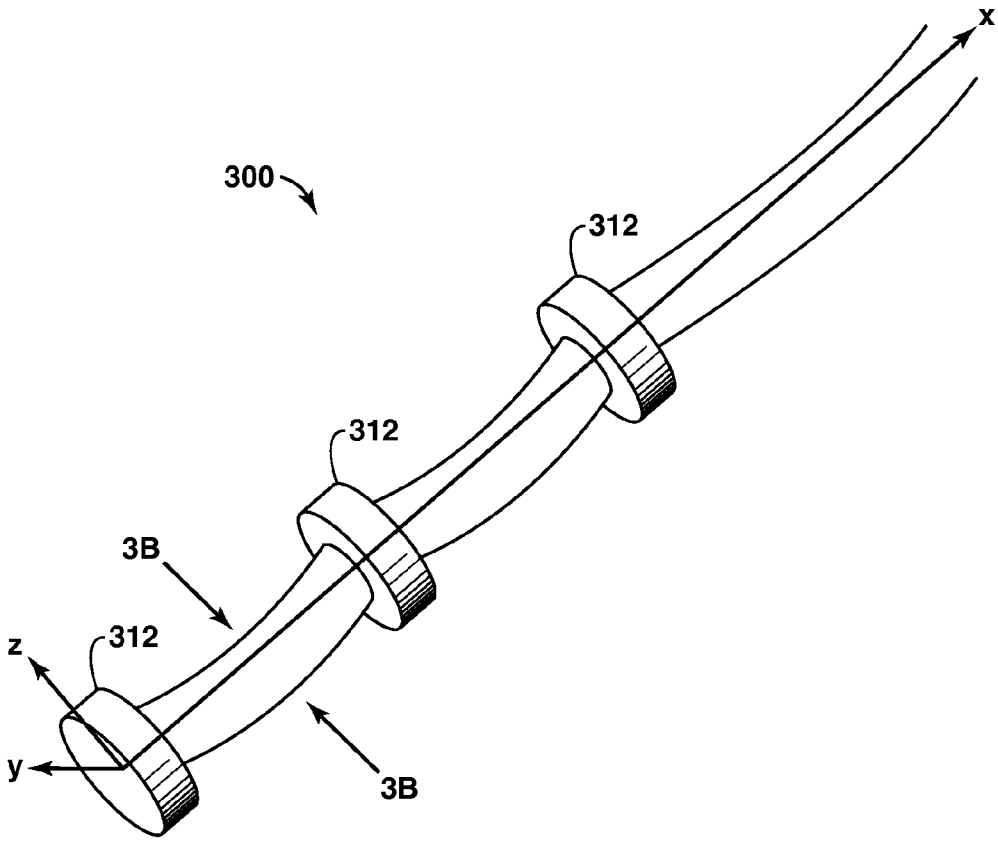
FIG. 3A illustrates a perspective view of a bottom hole assembly.
Figure 3B:
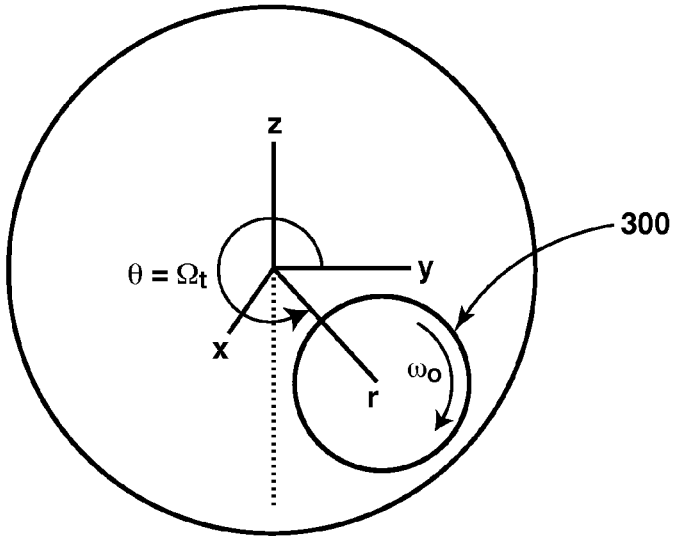
FIG. 3B illustrates a cross section of the bottom hole assembly of FIG. 3A.

FIGS. 3A-D provide a schematic view of a conventional bottom hole assembly 300 with drill collars and stabilizers 312. FIG. 3A illustrates a perspective view of the bottom hole assembly 300 as it may be bent during rotation; FIG. 3B illustrates a top-view looking downhole at a cross section of the bottom hole assembly 300. As illustrated in FIG. 3, the x-axis is oriented uphole, the z-axis is in the vertical plane orthogonal to x, and the y-axis forms the third orthogonal direction in a right-handed system. A short section of this bottom hole assembly rotates about the centerline of the wellbore with frequency, Ω, at a distance, r, from the axis, as best seen in FIG. 3B. To consider periodic motion, the distance r will be defined as a function of the rotation angle about the centerline. The pipe, or segment of the bottom hole assembly, is "turning to the right" looking down the wellbore, for the purposes of discussion at angular velocity $\omega_o$, which is in the negative sense.

Figure 3C:
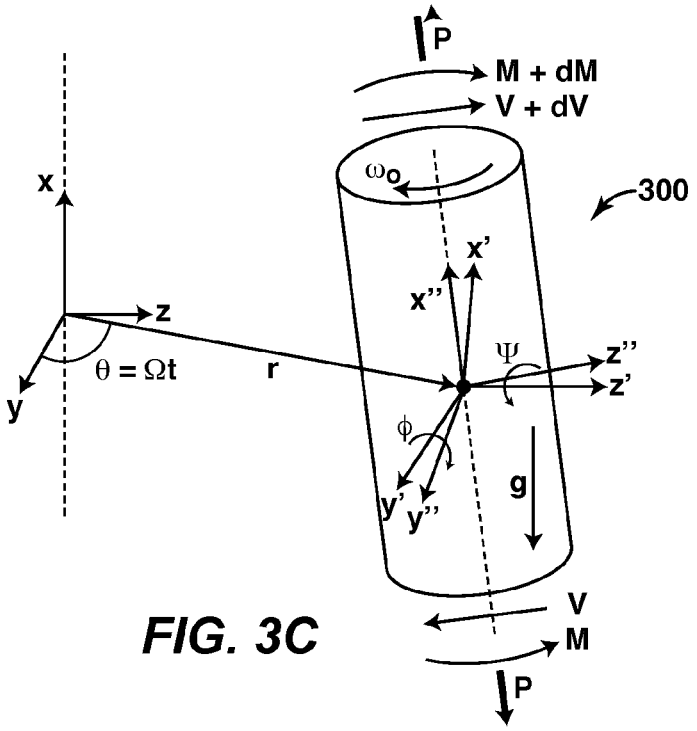
FIGS. 3C and 3D provide schematic illustrations of a beam element model of a section of bottom hole assembly.

The bottom hole assembly section is subjected to an applied axial loading P, shear load V at one end and V+dV at the other end, and bending moments M and M+dM, respectively, as best seen in FIG. 3C. The loads applied to this element at the ends of the section arise from the connection to similar bottom hole assembly elements above and below this bottom hole assembly section. While the representation in FIG. 3C can appear complex, starting with the fundamental physics allows the scenario of FIG. 3C to be understood in its basic elements. For example, the net force $\Sigma\vec{F}$ is equal to the rate of change of linear momentum $\vec{P}$, and the net torque $\Sigma\vec{M}$ is equal to the rate of change of angular momentum $\vec{H}$. In equation form, these relationships can be written as equations (e49):

$$\frac{d}{dt}(\vec{P}) = \sum \vec{F} \quad \frac{d}{dt}(\vec{H}) = \sum \vec{M} \tag{e49}$$

Kinematics

With continuing reference to FIG. 3C, the center of mass of the element is located at position $\vec{R}(t)$, which can be calculated by equation (e50), using $\theta=\Omega t$:

$$\vec{R}(t)=r(t)\cos(\Omega t)\vec{j}+r(t)\sin(\Omega t)\vec{k} \tag{e50}$$

According to the conventions of the present exemplary methods, the pipe section is revolving about the centerline of the well at a rate, $\Omega$, and the pipe is spinning at rotary speed $(-\omega_o)$ about its own axis, relative to the uphole positive x-axis. Accordingly, the total angular velocity vector relative to the inertial reference frame may be written as equations (e51) where the angles $\phi$ and $\psi$ represent the rotation angles about the y' and z' axes respectively:

$$\vec{\omega}_I=-\omega_o\cdot\vec{i}''+\Omega\cdot\vec{i}$$

$$\vec{\omega}_I=\omega_o\cdot(\vec{i}+\psi\cdot\vec{j}-\phi\cdot\vec{k})+\Omega\cdot\vec{i}$$

$$\vec{\omega}_I=(-\omega_o+\Omega)\cdot\vec{i}-\psi\omega_o\vec{j}+\phi\omega_o\cdot\vec{k} \tag{e51}$$

Figure 3D:
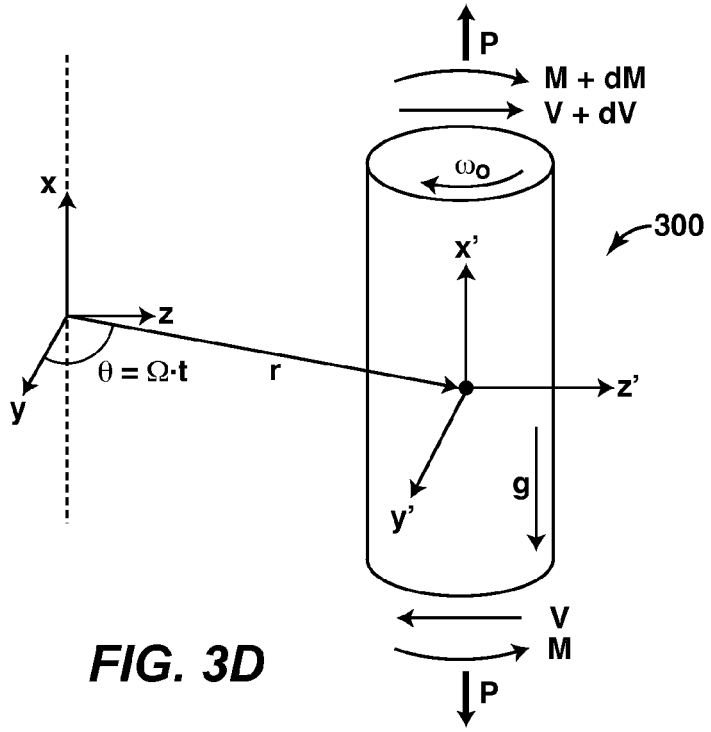

For the purposes of the present example, the motion is assumed to be in a plane. While small bending strains may be present, for the present illustration all of the angular velocity is assumed to be directed along the wellbore axis, such as shown in FIG. 3D. Accordingly, the kinematics simplify and we can write the angular velocity vector as equation (e52):

$$\vec{\omega}_I=(-\omega_o+\Omega)\cdot\vec{i} \tag{e52}$$

Since the allowable motions in these exemplary methods are constrained to the y-z plane and the motions can be resolved in a bottom hole assembly section body coordinate system that is rotating about the borehole centerline (but not spinning with the bottom hole assembly), the derivative operator applied to a vector $\vec{Q}$ may be written as equation (e53):

$$\frac{d\vec{Q}}{dt} = \left(\frac{\partial\vec{Q}}{\partial t}\right)_{rel} - \Omega Q_z\vec{j} + \Omega Q_y\vec{k} \tag{e53}$$

Additionally, the position vector may be written as equation (e54):

$$\vec{R} = \begin{pmatrix} 0 \\ R_y \\ R_z \end{pmatrix} = \begin{pmatrix} 0 \\ r\cos(\theta) \\ r\sin(\theta) \end{pmatrix} \tag{e54}$$

Then we may write the velocity as equations (e55):

$$\frac{d\vec{R}}{dt} = \begin{pmatrix} 0 \\ v_y \\ v_z \end{pmatrix} \text{ for } \begin{matrix} v_y = \dot{r}\cos(\theta) - r\Omega\sin(\theta) \\ v_z = \dot{r}\sin(\theta) + r\Omega\cos(\theta) \end{matrix} \tag{e55}$$

And the acceleration may be written as equations (e56):

$$\frac{d^2\vec{R}}{dt^2} = \begin{pmatrix} 0 \\ a_y \\ a_z \end{pmatrix} \text{ for } \begin{matrix} a_y = \ddot{r}\cos(\theta) - 2\dot{r}\Omega\sin(\theta) - r\Omega^2\cos(\theta) \\ a_z = \ddot{r}\sin(\theta) + 2\dot{r}\Omega\cos(\theta) - r\Omega^2\sin(\theta) \end{matrix} \tag{e56}$$

For $\theta=0$, velocity and acceleration may be written as equations (e57):

$$\frac{d\vec{R}}{dt} = \begin{pmatrix} 0 \\ \dot{r} \\ r\Omega \end{pmatrix} \quad \frac{d^2\vec{R}}{dt^2} = \begin{pmatrix} 0 \\ \ddot{r} - r\Omega^2 \\ 2\dot{r}\Omega \end{pmatrix} \tag{e57}$$

And for $\theta=\pi/2$, velocity and acceleration may be written as equations (e58):

$$\frac{d\vec{R}}{dt} = \begin{pmatrix} 0 \\ -r\Omega \\ \dot{r} \end{pmatrix} \quad \frac{d^2\vec{R}}{dt^2} = \begin{pmatrix} 0 \\ -2\dot{r}\Omega \\ \ddot{r} - r\Omega^2 \end{pmatrix} \tag{e58}$$

Linear Momentum

Using the equations derived above, the equations for linear momentum are simply written as equations (e59):

$$\frac{d\vec{P}}{dt} = \frac{d}{dt}\left(m\frac{d\vec{R}}{dt}\right) = m\frac{d^2\vec{R}}{dt^2} = m\begin{pmatrix} 0 \\ a_y \\ a_z \end{pmatrix} = \sum \vec{F} \tag{e59}$$

Angular Momentum

The total angular momentum may also be developed using the principles and methods described above. For example, the total angular momentum is the sum of the angular momentum of the center of mass about the borehole axis plus a term used to represent the spinning bottom hole assembly section, which can be written as equation (e60):

$$\vec{H}=(mr^2\Omega-I_x\omega_o)\cdot\vec{i} \tag{e60}$$

There are no components in the orthogonal directions, and the moments of inertia are defined along a principal component system of the bottom hole assembly section, so the relation for the derivative results in the equation (e61):

$$\frac{d}{dt}(\vec{H}) = 2mr\dot{r}\Omega\cdot\vec{i} = \sum \vec{M} \tag{e61}$$

Without including the terms involving the inclination angles of the element, there are no additional terms along the y and z directions to be considered in this exemplary method and model. Other models within the scope of the present methods may relax the assumptions regarding the ranges of allowable motions.

Formulation of the Differential Equations of Motion

Figure 4:
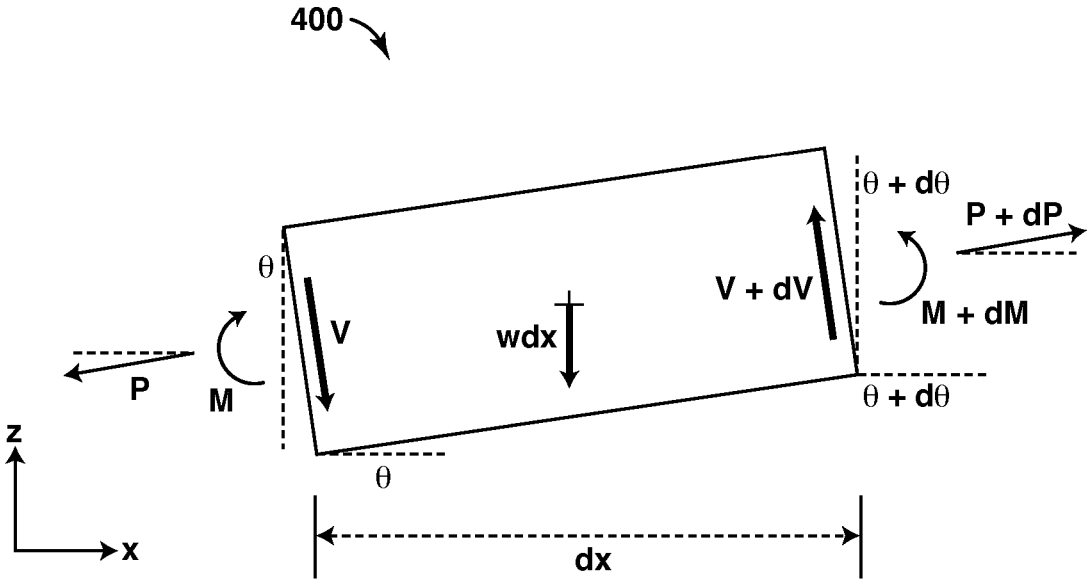
FIG. 4 provides a schematic illustration of a beam element model of a section of bottom hole assembly.

With the foregoing equations and discussion as a backdrop, the differential equations of motion for a representative bottom hole assembly section can be formulated. FIG. 4 provides a schematic illustration of a beam element model 400 of a section of bottom hole assembly with uniform properties (density $\rho$ and cross-section A) in a wellbore inclined at an angle $\phi$. The gravitational force component per unit length in the z-direction is therefore ($-\rho Ag\sin(\phi)$). The element is oriented at an angle θ relative to the wellbore axis. The axial load is applied perpendicular to the cross-section of the element, and the shear load is parallel to the end face of the element. A differential increment in force or moment is assumed at the right-hand end of the beam. A force and moment balance on this element will provide the differential equation of motion for the beam in the z-direction.

Assuming small angles and neglecting higher order terms, and allowing for a force imbalance in the z-direction, the acceleration of the beam in the z-direction can be written as equation (e62), again using the term $W=(-\rho Ag)$:

$$-P\theta-V+W\sin(\phi)dx+(V+dV)+(P+dP)(\theta+d\theta)=(\rho Adx)a_z \quad \text{(e62)}$$

Simplifying, the acceleration of the beam may be written as equation (e63):

$$W\sin(\varphi)+\frac{dV}{dx}+P\frac{d\theta}{dx}=(\rho A)a_z \quad \text{(e63)}$$

Continuing with the development of the equations of motion in the z-direction, it can be assumed that the moments balance to zero for the modeled element and that neglecting higher order terms is appropriate, the moments in the z-direction may be written as equations (e64):

$$-M+(M+dM)+W\sin(\varphi)dx\frac{dx}{2}+(V+dV)dx=0 \quad \text{(e64)}$$

$$\frac{dM}{dx}+V=0$$

The moment can be related to the deformation of the element and the EI product, as seen in equations (e65) and (e66):

$$M=EI\frac{d^2z}{dx^2} \quad \text{(e65)}$$

$$EI\frac{d^4z}{dx^4}+\frac{dV}{dx}=0 \quad \text{(e66)}$$

Combining the moment balance with the force balance in the z-direction, the motion in the z-direction may be written as equation (e67):

$$EI\frac{d^4z}{dx^4}-P\frac{d^2z}{dx^2}-W\sin(\varphi)+(\rho A)a_z=0 \quad \text{(e67)}$$

The equations of motion in the y-dimension may be similarly derived. However, because there is no gravitational load in the transverse y-dimension, the corresponding equation is written as equation (e68):

$$EI\frac{d^4y}{dx^4}-P\frac{d^2y}{dx^2}+(\rho A)a_y=0 \quad \text{(e68)}$$

It should be noted that (e56) provides relationships for $a_y$ and $a_z$ in terms of r, θ, and Ω to be used with (e67) and (e68).

Solving the Differential Equations of Motion

The above discussion provides the differential equations of motion for the three-dimensional frequency-domain models. As one example, the exemplary equations above for the z-axis are identified as inhomogeneous differential equations because of the presence of the gravitational term. The inhomogeneous differential equation can be solved by combining the solution for the homogeneous case plus a term for the particular solution to reflect the gravity effect. The above discussion combining the static and dynamic solutions for distributed mass BHA vibration model provides a general solution for the inhomogeneous differential equation that can be represented by equation (e69), which is analogous to equation (e44) from above.

$$z(x)=ax^2+c_1\cos h(\kappa x)+c_2\sin h(\kappa x)+c_3\cos(\lambda x)+c_4\sin(\lambda x) \quad \text{(e69)}$$

Where, as before, the terms κ and λ are defined by equations (e70) and are the same for both the z-dimension and the y-dimension.

$$\kappa^2=\left[\frac{P^2}{4(EI)^2}+\frac{W\omega_n^2}{g\cdot EI}\right]^{1/2}+\frac{P}{2EI} \quad \text{(e70)}$$

$$\lambda^2=\left[\frac{P^2}{4(EI)^2}+\frac{W\omega_n^2}{g\cdot EI}\right]^{1/2}-\frac{P}{2EI}$$

As before, the derivatives can be identified relative to the system state variables, $$\frac{dz}{dx}=\theta_z\quad M_z=EI\frac{d^2z}{dx^2}\quad V_z=-EI\frac{d^3z}{dx^3} \quad \text{(e71)}$$

Within an element, the position x=0 can be chosen at one face, and the opposite face is then at x=L. At the origin, the cosine functions have unity value, and the sine functions are zero. In normalized state vector form, the equations for z and its derivatives may be written in matrix form as equation (e72):

$$\begin{pmatrix} z_o \\ \theta_o \\ M_o \\ V_o \\ 1 \end{pmatrix}=\begin{bmatrix} 1 & 0 & 1 & 0 & 0 \\ 0 & \kappa & 0 & \lambda & 0 \\ \kappa^2EI & 0 & (-\lambda^2)EI & 0 & 2a\cdot EI \\ 0 & (-\kappa^3)EI & 0 & \lambda^3EI & 0 \\ 0 & 0 & 0 & 0 & 1 \end{bmatrix}\cdot\begin{pmatrix} c_1 \\ c_2 \\ c_3 \\ c_4 \\ 1 \end{pmatrix} \quad \text{(e72)}$$

Where the entity a is defined as follows in equation (e73):

$$a=\frac{-W\sin(\varphi)}{2P} \quad \text{(e73)}$$

Equation (e73) includes the effects of gravity and axial loading and may be identified as a term in the static solution.

As with the discussion above for the dynamic bending of a distributed mass model, the matrix in (e72) is invertible, so that the coefficients can be solved for in terms of the state vector at one face of the element, as seen in equation (e74).

$$\begin{pmatrix} c_1 \\ c_2 \\ c_3 \\ c_4 \\ 1 \end{pmatrix} = \left(\frac{1}{\lambda^2+\kappa^2}\right)\cdot \begin{bmatrix} \lambda^2 & 0 & \frac{1}{EI} & 0 & \left(\frac{-2a}{EI}\right) \\ 0 & \frac{\lambda^2}{\kappa} & 0 & \left(-\frac{1}{\kappa EI}\right) & 0 \\ \kappa^2 & 0 & \left(-\frac{1}{EI}\right) & 0 & \frac{2a}{EI} \\ 0 & \frac{\kappa^2}{\lambda} & 0 & \frac{1}{\lambda EI} & 0 \\ 0 & 0 & 0 & 0 & \lambda^2+\kappa^2 \end{bmatrix} \cdot \begin{pmatrix} z_o \\ \theta_o \\ M_o \\ V_o \\ 1 \end{pmatrix} \tag{e74}$$

The state vector at location x=L can now be determined using equation (e75).

$$\begin{pmatrix} z_L \\ \theta_{Z,L} \\ M_{Z,L} \\ V_{Z,L} \\ 1 \end{pmatrix} = \left(\frac{1}{\lambda^2+\kappa^2}\right) \begin{bmatrix} \cosh(\kappa L) & \sinh(\kappa L) & \cos(\lambda L) & \sin(\lambda L) & aL^2 \\ \kappa\sinh(\kappa L) & \kappa\cosh(\kappa L) & -\lambda\sin(\lambda L) & \lambda\cos(\lambda L) & 2aL \\ \kappa^2 EI\cosh(\kappa L) & \kappa^2 EI\sinh(\kappa L) & -\lambda^2 EI\cos(\lambda L) & -\lambda^2 EI\sin(\lambda L) & 2a \\ -\kappa^3 EI\sinh(\kappa L) & -\kappa^3 EI\cosh(\kappa L) & -\lambda^3 EI\sin(\lambda L) & \lambda^3 EI\cos(\lambda L) & 0 \\ 0 & 0 & 0 & 0 & 1 \end{bmatrix} \cdot \begin{bmatrix} \lambda^2 & 0 & \frac{1}{EI} & 0 & \left(\frac{-2a}{EI}\right) \\ 0 & \frac{\lambda^2}{\kappa} & 0 & \left(-\frac{1}{\kappa EI}\right) & 0 \\ \kappa^2 & 0 & \left(-\frac{1}{EI}\right) & 0 & \frac{2a}{EI} \\ 0 & \frac{\kappa^2}{\lambda} & 0 & \frac{1}{\lambda EI} & 0 \\ 0 & 0 & 0 & 0 & \lambda^2+\kappa^2 \end{bmatrix} \cdot \begin{pmatrix} z_o \\ \theta_{Z,o} \\ M_{Z,o} \\ V_{Z,o} \\ 1 \end{pmatrix} \tag{e75}$$

Carrying out the multiplication of terms as before, $$\begin{pmatrix} z_L \\ \theta_{Z,L} \\ M_{Z,L} \\ V_{Z,L} \\ 1 \end{pmatrix} = \left(\frac{1}{\lambda^2+\kappa^2}\right)\cdot T \cdot \begin{pmatrix} z_o \\ \theta_{Z,o} \\ M_{Z,o} \\ V_{Z,o} \\ 1 \end{pmatrix} \tag{e76}$$

$$T_{11} = \lambda^2\cosh(\kappa L) + \kappa^2\cos(\lambda L)$$

$$T_{12} = \frac{\lambda^2}{\kappa}\sinh(\kappa L) + \frac{\kappa^2}{\lambda}\sin(\lambda L)$$

$$T_{13} = \frac{1}{EI}(\cosh(\kappa L) - \cos(\lambda L))$$

$$T_{14} = \frac{1}{EI}\left(\frac{\sin(\lambda L)}{\lambda} - \frac{\sinh(\kappa L)}{\kappa}\right)$$

$$T_{15} = \left(\cosh(\kappa L) - \cos(\lambda L) - \frac{L^2 EI}{2}(\lambda^2+\kappa^2)\right)\cdot\frac{W\sin(\varphi)}{P\cdot EI}$$

$$T_{21} = \kappa\lambda\cdot(\lambda\sinh(\kappa L) - \kappa\sin(\lambda L))$$

$$T_{22} = \lambda^2\cosh(\kappa L) + \kappa^2\cos(\lambda L)$$

$$T_{23} = \frac{1}{EI}(\kappa\sinh(\kappa L) + \lambda\sin(\lambda L))$$

-continued $$T_{24} = \frac{1}{EI}(\cos(\lambda L) - \cosh(\kappa L))$$

$$T_{25} = (\kappa\sinh(\kappa L) + \lambda\sin(\lambda L) - L\cdot EI\cdot(\lambda^2+\kappa^2))\cdot\frac{W\sin(\varphi)}{P\cdot EI}$$

$$T_{31} = \lambda^2\kappa^2 EI(\cosh(\kappa L) - \cos(\lambda L))$$

$$T_{32} = \lambda\kappa\cdot EI(\lambda\sinh(\kappa L) - \kappa\sin(\lambda L))$$

$$T_{33} = \kappa^2\cosh(\kappa L) + \lambda^2\cos(\lambda L)$$

$$T_{34} = (-\kappa\sinh(\kappa L) - \lambda\sin(\lambda L))$$

$$T_{35} = (\kappa^2\cosh(\kappa L) + \lambda^2\cos(\lambda L) - (\lambda^2+\kappa^2))\cdot\frac{W\sin(\varphi)}{P}$$

$$T_{41} = (-\lambda^2\kappa^2 EI(\kappa\sinh(\kappa L) + \lambda\sin(\lambda L)))$$

$$T_{42} = \lambda^2\kappa^2 EI(\cos(\lambda L) - \cosh(\kappa L))$$

$$T_{43} = \lambda^3\sin(\lambda L) - \kappa^3\sinh(\kappa L)$$

$$T_{44} = \kappa^2\cosh(\kappa L) + \lambda^2\cos(\lambda L)$$

$$T_{45} = (\lambda^3\sin(\lambda L) - \kappa^3\sinh(\kappa L))\cdot\frac{W\sin(\varphi)}{P\cdot EI}$$

$$T_{51} = T_{52} = T_{53} T_{54} = 0$$

$$T_{55} = \lambda^2 + \kappa^2$$

Observing that the y-axis is not affected by gravity, then the problem in the y-direction is analogous to the two-dimensional case solved above $$\begin{pmatrix} y_L \\ \theta_{Y,L} \\ M_{Y,L} \\ V_{Y,L} \end{pmatrix} = \left(\frac{1}{\lambda^2+\kappa^2}\right)\cdot T \cdot \begin{pmatrix} y_o \\ \theta_{Y,o} \\ M_{Y,o} \\ V_{Y,o} \end{pmatrix} \tag{e77}$$

$$T_{11} = \lambda^2\cosh(\kappa L) + \kappa^2\cos(\lambda L)$$

$$T_{12} = \frac{\lambda^2}{\kappa}\sinh(\kappa L) + \frac{\kappa^2}{\lambda}\sin(\lambda L)$$

$$T_{13} = \frac{1}{EI}(\cosh(\kappa L) - \cos(\lambda L))$$

$$T_{14} = \frac{1}{EI}\left(\frac{\sin(\lambda L)}{\lambda} - \frac{\sinh(\kappa L)}{\kappa}\right)$$

$$T_{21} = \kappa\lambda\cdot(\lambda\sinh(\kappa L) - \kappa\sin(\lambda L))$$

$$T_{22} = \lambda^2\cosh(\kappa L) + \kappa^2\cos(\lambda L)$$

$$T_{23} = \frac{1}{EI}(\kappa\sinh(\kappa L) + \lambda\sin(\lambda L))$$

$$T_{24} = \frac{1}{EI}(\cos(\lambda L) - \cosh(\kappa L))$$

$$T_{31} = \lambda^2\kappa^2 EI(\cosh(\kappa L) - \cos(\lambda L))$$

$$T_{32} = \lambda\kappa\cdot EI(\lambda\sinh(\kappa L) - \kappa\sin(\lambda L))$$

$$T_{33} = \kappa^2\cosh(\kappa L) + \lambda^2\cos(\lambda L)$$

$$T_{34} = (-\kappa\sinh(\kappa L) - \lambda\sin(\lambda L))$$

$$T_{41} = (-\lambda^2\kappa^2 EI(\kappa\sinh(\kappa L) + \lambda\sin(\lambda L)))$$

$$T_{42} = \lambda^2\kappa^2 EI(\cos(\lambda L) - \cosh(\kappa L))$$

$$T_{43} = \lambda^3\sin(\lambda L) - \kappa^3\sinh(\kappa L)$$

$$T_{44} = \kappa^2\cosh(\kappa L) + \lambda^2\cos(\lambda L)$$

Model Formulations

Various BHA surrogates may be constructed to enable the BHA to be modeled or simulated utilizing the three-dimensional frequency-domain models described above. Consider one scenario in which the stabilizers are modeled in the BHA surrogate as being in synchronized rolling contact with the wellbore. These elements are synchronized in the sense that they are in phase in a line of contact that progresses about the borehole. For simplicity, a pinned condition may be specified in each coordinate direction at the bit end so that the moment at each end is zero. In this scenario, four conditions are determined along both coordinate directions, which is necessary and sufficient to achieve a solution. The state vectors and matrices shown above may be used to propagate a solution in each of the y and z coordinate directions. In addition to assuming periodicity in time, periodicity may be imposed in the conditions at the bit and stabilizers as they rotate synchronously about the borehole.

Additionally or alternatively, BHA surrogates can be developed by imposing an eccentric mass into the system. The results of the frequency-domain modeling may then be examined to determine the sensitivity of the results to this mass imbalance. When the three-dimensional models incorporate an eccentric mass condition, there is an additional term in the equations of the frequency-domain model to represent the mass offset from the centerline by an amount $\epsilon$. For example, the terms $\kappa$ and $\lambda$ are defined by equations (e70) above. Each may be adapted to model the eccentric mass by an appropriate incorporation of the $\epsilon$ term, such as $-\epsilon(\rho A)\omega_n^2$, which is analogous to the static loading case as in the lumped parameter model discussed above.

These and other BHA surrogates may be constructed to enable simulation of drilling operations utilizing the three-dimensional frequency-domain models described herein. The resulting state vectors may be processed to obtain one or more Vibration Performance Indices as described herein.

Curved Borehole Effects

The foregoing discussion of lumped parameter surrogates and distributed mass surrogates are representative of bottom hole assemblies disposed in a straight borehole. These surrogates can be modified to account for or represent a bottom hole assembly disposed in a curved borehole. While modifications can be made to any of the surrogates and models presented herein to account for borehole curvature, this section will describe exemplary modifications to the distributed mass surrogate discussed above. More specifically, the present section provides an exemplary modification to the methods and surrogates discussed above to allow consideration of bottom hole assemblies disposed in a curved section of the borehole.

The present exemplary modification considers the situation where the BHA is in a section of the well with a constant buildup rate (BUR). For a positive BUR, the inclination of the well increases as a function of distance x from bit. Similarly, for negative BUR, the inclination decreases with x. When considering a curved borehole section, the contact and stabilizer constraints are given in relation to the borehole centerline rather than in relation to a straight line. Accordingly, in the modification for curved borehole effects the lateral deflections y(x,t) of the BHA similarly may be specified with respect to the borehole centerline. The variable transformation of equation (e78) may be used to describe the deflection of the BHA from a straight line that is tangent to the borehole centerline at the bit.

$$\hat{y}(x, t) = y(x, t) + \frac{1}{2}\kappa_{BUR}x^2 \tag{e78}$$

Here, $\kappa_{BUR}$ is the curvature of the centerline associated with the BUR, with units of (1/length). Since the variable $\hat{y}$ describes lateral deviations with respect to a straight reference state, the differential equations that govern it between contact points or stabilizers are identical to those derived in the foregoing discussion of distributed mass surrogates. Using the variable transformation above, we can then obtain and solve the new equations for the static case, the dynamic bending, and the three-dimensional modeling.

Static Case

For the static case, equation (e29) from above reads:

$$EI\frac{d^4\hat{y}}{dx^4} - P\frac{d^2\hat{y}}{dx^2} - W\sin(\varphi) = 0 \tag{e29}$$

Substituting for the variable y to consider the borehole curvature, equation (e29) is modified as equation (e79).

$$EI\frac{d^4 y}{dx^4} - P\frac{d^2 y}{dx^2} - (W\sin(\varphi) + \kappa_{BUR}P) = 0 \tag{e79}$$

Thus, the matrix that relates the normalized state vector (y and its derivatives) at x=0 to the state vector at x=L has the same form as $T_{BEAM}$ given above as equation (e33). However, W sin($\phi$) is replaced by W sin($\phi$)+$\kappa_{BUR}$P. Furthermore, y and its derivatives are related to the state variables through equations (e80).

$$\frac{dy}{dx} = \theta \quad \frac{d^2 y}{dx^2} = \frac{M}{EI} - \kappa_{BUR} \quad \frac{d^3 y}{dx^3} = \frac{-V}{EI} \tag{e80}$$

The modifications to accommodate borehole curvature are of relatively minor complexity but are nonetheless significant to the accuracy and validity of the present methods when applied to curved boreholes. Considering the modifications above, the impact of the borehole curvature is seen to have two primary affects on the static lateral deflections. First, when there is an axial load, the curvature generates an additional effective lateral force along the BHA that is superimposed on the gravitational load. Also, the borehole curvature generates an additional effective bending moment that is required to keep the BHA aligned with the borehole centerline.

Dynamic Bending

Since the variable transformation described above does not depend on time, the equations that govern the dynamic bending states are unchanged. Accordingly, no modifications to the surrogates or calculations are necessary to account for the borehole curvature.

Three Dimensional Models

In the context of the full three dimensional model described above, the static case corresponds to the lateral deflections in the vertical plane (z-component). For a straight borehole, there are no static deflections in the horizontal direction (y-component), so no calculations were needed. If the well path is effectively 2D so that the only curvature present is in the vertical plane associated with a BUR, the solution described above for the static case applies to the z-component, and the y-component is once again identically zero. However, if there is walk present, such that the azimuth changes with position, the curvature vector is no longer in the vertical plane. Using the notation from above in the discussion of the full three-dimensional model, the curvature can be decomposed into its horizontal and vertical components as in equation (e81):

$$\vec{\kappa}=\kappa_{WALK}\vec{j}+\kappa BUR\vec{k} \tag{e81}$$

The three-dimensional model taking into account borehole curvature thus can be solved by considering the variable transformations of equations (e82):

$$\hat{y}(x,t)=y(x,t)+\frac{1}{2}\kappa_{WALK}x^2, \tag{e82}$$

$$\hat{z}(x,t)=z(x,t)+\frac{1}{2}\kappa_{BUR}x^2.$$

The solution for the vertical (z-) component reduces to the static case described above. The differential equation associated with the horizontal (y-) component is presented in equation (e83).

$$EI\frac{d^4y}{dx^4}-P\frac{d^2y}{dx^2}-\kappa_{WALK}P=0 \tag{e83}$$

Thus, the matrix that relates the normalized state vector (y and its derivatives) at x=0 to the state vector at x=L has the same form as $T_{BEAM}$ given above as equation (e33). However, W sin(ϕ) is replaced by W sin(ϕ)+$\kappa_{BUR}$P. Furthermore, y and its derivatives are related to the state variables through equations (e84).

$$\frac{dy}{dx}=\theta_y\quad\frac{d^2y}{dx^2}=\frac{M_y}{EI}-\kappa_{WALK}\quad\frac{d^3y}{dx^3}=\frac{-V_y}{EI} \tag{e84}$$

Thus, for the horizontal component, there is no gravitational term but the walk curvature is incorporated as an effective bending moment along the BHA, which will generate reaction loads at contact points. The total bending moment and shear force can each be obtained by a vector summation of their respective components.

The foregoing provides one exemplary modification of the bottom hole assembly surrogates and BHA vibration models that allows consideration of borehole curvature and the impact of the curvature on the vibrations in the static case using a full three-dimensional model. As in the two dimensional implementations, since the variable transformation does not depend on time, the equations that govern the dynamic bending states are unchanged. Accordingly, no modifications to the methods, equations, models, and/or calculations are necessary to account for the borehole curvature when considering dynamic bending.

BHA Vibration Performance Indices

The vectors of state variables described above may be utilized to provide various indices that are utilized to characterize the BHA vibration performance of different BHA surrogates. While it should be appreciated that various combinations of state variables and quantities derived from the fundamental state variables may be utilized, exemplary vibration performance indices are described herein. From these examples, others will be readily identified and are considered within the scope of the present disclosure.

While each of the vibration performance indices described herein are combinations of state variables at different locations along the BHA, which may be determined for many BHA surrogates in design mode or may be calculated for the actual performance of a field BHA in log mode, the indices can be generally characterized as either point indices or segment indices. Point indices are calculated by considering the state variables of the BHA at a specific point along its length. Segment indices, as suggested by name, are calculated by considering the state variables of a BHA over a segment of the BHA. One example of a point index is the end-point curvature index described below. In another example, the BHA side-force index and BHA torque sum index are comprised of the sum of point indices. Several examples of segment indices are provided below. While both indices are instructive and can help to predict vibrational performance, segment indices may provide more detailed and/or more accurate predictions of vibration performance along the entirety of the BHA. For example, the end-point curvature index identifies the curvature at the end-point but does not provide detailed information about the condition of the bottom hole assembly between the bit and the end-point. Segment indices, in contrast, may provide a vibration performance index for any segment between the bit and the end-point and/or for the entire BHA between the bit and the end-point.

The BHA surrogates used in the present models and methods include representations of the BHA components, such as the bit, stabilizers, drill collars, etc. The components may be considered to be grouped into a lower section and an upper section. The lower section includes components starting at the bit and extending through most or all of the drill collars. The upper section, which is the last component in the BHA surrogate, is generally the lower portion of the heavy-weight drill pipe. Various nodes, N, may be used to construct the BHA surrogate, with node 1 being at the bit. According to the implementations described herein, the first element in the upper section has the index "U" and the last element in the lower section has index "L," i.e. U=L+1. Furthermore, BHA surrogates include C contact points with contact forces "$F_j$," where the index j ranges over the BHA elements that are in contact with the wellbore.

Utilizing the results of one or more of the models discussed above, together with the above nomenclature for the BHA surrogates, various vibration performance indices may be calculated. For instance, the end-point curvature index may be represented by equation (e85), which is noted below.

$$PI=\alpha\frac{M_N}{(EI)_N} \tag{e85}$$

Where PI is a vibration performance index, $M_N$ is the bending moment at the last element in the model, $(EI)_N$ is the bending stiffness of this element, and α is a constant. It should be noted that the α may be $7.33\times10^5$ or other suitable constant, such as described further below.

Similarly, the BHA strain energy index may be represented by the equation (e86), which is noted below.

$$PI=\frac{1}{L}\sum_{i=1}^{L}\frac{M_i^2}{(EI)_i} \tag{e86}$$

Where the summation is taken over the L elements in the lower portion of the BHA, and the index i refers to each of these elements. It should be noted that the BHA strain energy index is a segment index that considers the average strain energy distributed over the entire lower portion of the BHA.

As another exemplary vibration performance index, an average transmitted strain energy index may be calculated by the equation (e87).

$$PI = \frac{1}{(N-U+1)}\sum_{i=U}^{N}\frac{M_i^2}{2(EI)_i} \tag{e87}$$

Where N is the total number of elements and U refers to the first element of the upper part of the BHA (usually the first node in the heavy-weight drillpipe), and the summation is taken over this upper BHA portion. It can be seen that the average transmitted strain energy index is an average of the strain energy in the upper portion of the BHA, or the strain energy transmitted from the upper portion.

While the average transmitted strain energy index characterizes the transmitted strain energy in the upper portion, recognition of the operational characteristics of the upper portion enables the derivation of yet another vibration performance index. For example, the observation that the transmitted bending moments appear sinusoidal and somewhat independent of end-length in this uniform interval of pipe (e.g., $M \sim M_0 \sin kx$) enables the transmitted strain energy index to be expressed more simply in equation (e88).

$$PI = \frac{\left(\max_{i=U}^{N}(M_i) - \min_{i=U}^{N}(M_i)\right)^2}{16(EI)_N} \tag{e88}$$

Where the maximum and minimum bending moments in the upper portion of the BHA are used as a proxy for the amplitude of the disturbance. This transmitted strain energy index is less sensitive to the choice of end-length and is thus more computationally efficient than the end-point curvature index given by (e87), although they both measure the amount of energy being imparted to the drillstring above the BHA. The derivation of the transmitted strain energy index from the average transmitted strain energy index is exemplary of other derivations of vibration performance indices that may originate or derive from the disclosure herein while not being explicitly described herein.

The strain energy indices may be implemented in a different but equivalent manner when the continuous beam element matrices are used. Although the element lengths in the lumped parameter model are constrained by numerical considerations, which provide a fair sampling of the interval for the purpose of calculating the vibration performance indices, the use of the continuous beam elements allows longer element lengths to be used in the model. In this case, the sampling of the beam motion achieved simply by using a coarse discretization may not be sufficient. Corresponding analytical relations for the bending strain energy may be provided for these continuous beam elements within the scope of this invention.

As further examples of suitable vibration performance indices, the sideforces may be indexed in at least two manners. For example, the RMS BHA sideforce index and total BHA sideforce index may be represented by the equations (e89) and (e90), respectively.

$$PI = \sqrt{\frac{1}{C}\sum_{j=1}^{C}F_j^2} \tag{e89}$$

$$PI = \sum_{j=1}^{C}|F_j| \tag{e90}$$

Where the contact force, $F_j$, is calculated for each of the C contact points from the constraints and solution propagation as discussed above, and the summation is taken over the contact forces at these locations using the contact point index j.

The dynamic sideforce values may be converted to corresponding dynamic torque values using the applied moment arm (radius to contact point $r_j$) and the appropriate coefficient of friction at each respective point $\mu_j$. Summing again over the elements in contact with the borehole, the RMS BHA torque index and total BHA torque index may be represented by the equations (e91) and (e92), respectively.

$$PI = \sqrt{\frac{1}{C}\sum_{j=1}^{C}(\mu_j r_j F_j)^2} \tag{e91}$$

$$PI = \sum_{j=1}^{C}|\mu_j r_j F_j| \tag{e92}$$

The dynamic torque performance index accounts for the dynamic torsional effects of the potentially large dynamic sideforces, providing a lower index value for improved equipment or operational factors, such as an effective reduction in friction that may result from the use of roller reamers, which are known to provide lower torsional vibrations in field operations.

The RMS BHA sideforce index and the RMS BHA torque index values present an average value of this source of dynamic resistance, whereas the total BHA sideforce index and the total BHA torque index values represent the summation of this resistance over the range of the BHA contact points between 1 and C. Both may provide useful diagnostic information. The RMS BHA sideforce index provides an average stabilizer reaction force; the total BHA sideforce index provides the total summation of the stabilizer reaction forces of all the contact points. The total BHA torque index shows the combined rotational resistance of all contact points, taking into account the diameter of the parts in contact with the wellbore and the respective coefficient of friction; the RMS BHA torque index provides the average rotational resistance over the span from j=1 to j=C. The BHA torque indices may provide valuable information to assist in design mitigation of stick-slip torsional vibrations.

The foregoing discussion of vibration performance indices utilize contact points or the upper or lower portions of the bottom hole assembly to define the bottom hole assembly segments to be analyzed and/or characterized by the vibration performance index equations and methods. Additional indices may be developed that enable the vibrational performance to be predicted and/or characterized in any segment of the bottom hole assembly. For example, the bottom hole assembly segment between any two points may be characterized by an appropriate vibration performance index. One exemplary index for characterizing the vibrational performance of a bottom hole assembly or a BHA surrogate is a transmissibility index. A transmissibility index may compare BHA state variables between any two points to provide an index. For example, the acceleration of the BHA surrogate (or of an actual BHA) may be determined at any two points and then compared to determine a transmissibility index. Other state variables, such as displacement, tilt angle, bending moment, and shear force, or derivatives thereof may be similarly compared.

Continuing with the example of a transmissibility index comparing the acceleration of any two points, a and b, on the BHA surrogate, the acceleration of the BHA at points a and b may be modeled using a virtual sensor incorporated into the BHA surrogate and the BHA vibration models described above. The BHA vibration models described above, and the associated methods and BHA surrogates, are described as being useful for, among other things, calculating the lateral displacement (y) of each mass element, or segment of BHA, and corresponding spatial derivatives. While the displacement is informative, a calculated acceleration using these models may provide a more direct method to compare model results with measured accelerations, which are readily obtained from downhole tools. It will be recalled that the derivatives of the lateral deflection are relative to the coordinate along the axis. The second derivative of the displacement with respect to time provides the acceleration. Fortunately, the Laplace transform relationship in the frequency-domain facilitates the calculation of the second derivative, which can be expressed by multiplying the displacement, y, by the square of the frequency, such as illustrated in equation (e93).

$$\frac{d^2 y}{dt^2} = -\omega^2 y \tag{e93}$$

It should be understood that in the context of the present disclosure, the term virtual sensor is any relationship or collection of relationships that can be associated with a BHA surrogate to allow the BHA vibration models to calculate at least one state variable at a given location on the BHA surrogate. For example, the above equation (e93) allows the BHA vibration models to calculate the acceleration of the BHA surrogate at a specific location, i.e., the location for which the y is input into the virtual sensor equation. Acceleration is only one example of state variables that may be determined or calculated by the virtual sensor concept. Others may also be selected, and suitable equations that may be developed to enable calculation of derived variables from the BHA vibration models. In some implementations, the virtual sensors will be selected to calculate state variables that correspond to one or more properties that can be directly measured during drilling operations for direct comparison thereto.

A virtual sensor in the BHA vibration models disposed at the axis of the BHA surrogate may be compared directly to the measured data of a data collection tool disposed at the axis of an actual bottom hole assembly. However, when the data collection tool, such as an accelerometer, is spaced away from the centerline of the tool in the actual bottom hole assembly, the virtual sensor may need to be adapted. Additionally or alternatively, different downhole sensors may be adapted to measure different states or different locations on the BHA; suitable adjustments to the equations and relationships of the virtual sensor may be made. As one example, an exemplary modification to the virtual sensor equation for acceleration is illustrated in equation (e94).

$$\frac{d^2 y}{dt^2} = -(\omega^2 y + \omega_o^2 R) \tag{e94}$$

Equation (e94) includes a centrifugal acceleration term to account for the measurement tool rotating at a distance R from the tool centerline at a rate $\omega_o$. The output of an accelerometer corresponds to the sum of the acceleration due to vibration plus the acceleration due to centrifugal effects. Additionally and alternatively, the outputs of two or more sensors may be combined to compare with the results of a virtual sensor. For example, measurements from two opposing radial accelerometers may be differenced, in which case the centrifugal term drops out and the resulting lateral acceleration may be directly compared with the model virtual sensor values. Without loss of generality, other mathematical combinations of real and virtual sensors may be conceived to provide improved comparative analyses.

Continuing with the discussion of a transmissibility index, two or more virtual sensors may be associated with a BHA surrogate for use in BHA vibration models. The transmissibility between the two virtual sensors can be determined through comparing the calculated state variable for one virtual sensor with the calculated state variable at the other virtual sensor. For example, a general transmissibility index $T_{ab}(\omega_o)$ from point b to point a in the BHA can be defined by equation (e95)

$$T_{ab}(\omega_o) = \frac{\left|\sum_{k=1}^{m} w_k(\omega_o)(k\omega_o)^2 y_{ka}(\omega_o)\right|}{\left|\sum_{k=1}^{m} w_k(\omega_o)(k\omega_o)^2 y_{kb}(\omega_o)\right|} = \frac{\left|\sum_{k=1}^{m} k^2 w_k(\omega_o) y_{ka}(\omega_o)\right|}{\left|\sum_{k=1}^{m} k^2 w_k(\omega_o) y_{kb}(\omega_o)\right|} \tag{e95}$$

where $y_{ka}$ and $y_{kb}$ are the calculated displacements at point a and b for the $k^{th}$ multiple of the RPM at rotary speed $\omega_o$, and $\omega_k(\omega_o)$ is the weight for the $k^{th}$ multiple of the RPM at rotary speed $\omega_o$.

While $T_{ab}(\omega_o)$ as defined in equation (e95) provides the ratio between two accelerations at different locations, other relationships between the two accelerations, or other state variables, may be used. By defining the transmissibility index as a ratio between state variables at two locations, the transmissibility index will have the following physical significances:

$T_{ab}(\omega_o)>1$: vibration increased from point *b* to point *a*

$T_{ab}(\omega_o)=1$: same vibration transferred from point *b* to point *a*

$T_{ab}(\omega_o)<1$: vibration decreased from point *b* to point *a*

The transmissibility index may be calculated between two fixed points on the BHA surrogate and/or may be calculated at a variety of locations relative to a fixed location, such as the bit. For example, if the locations of a and b are fixed, $T_{ab}(\omega_o)$ gives the relationship between vibration transmission and rotary speed. That is, the transmissibility index may provide an alternate means to identify RPM's that are likely to increase the transmissibility of vibrations and/or RPM's that are more likely to result in increased vibrations along the BHA. On the other hand, if point b is set at the bit position, rotary speed $\omega_o$ is fixed, and a varies along the x-axis, the transmissibility $T_{xb}(\omega_0)$ is a function of x, and it provides the vibration magnification effect along the BHA at the specified RPM $\omega_o$. Accordingly, the locations of severe vibration in the BHA can be recognized from the peaks of $T_{xb}(\omega_0)$ for a given RPM.

The calculated transmissibility index may be compared with a measured transmissibility index for various reasons. As will be discussed below in more detail, any of the vibration performance indices may be compared with measured data or data derived from measured data in order to verify the accuracy of the BHA vibration models, to improve the BHA surrogate, etc. As one example of a measured index, or derived data point, that can be compared to the calculated indices, a measured transmissibility index may be written as equation (e96).

$$T_{12}(\omega_o) = \frac{|FT[A_1(t)]|}{|FT[A_2(t)]|} \tag{e96}$$

where FT[ ] is the Fourier transform, and $A_1(t)$ and $A_2(t)$ are the measured acceleration histories at sensor positions 1 and 2, respectively. The measured transmissibility index compared with the calculated model transmissibility index may be used to make informed decisions regarding BHA configurations for use in subsequent drilling operations. Additionally or alternatively, the measured transmissibility index and the calculated transmissibility index may be used to inform the construction of future BHA surrogates for use in the methods of the present disclosure, either for greater accuracy in the surrogate's representation of the reality or for testing theoretically improved designs. Similarly, the drilling operations, whether actual or in the BHA vibration models, may be modified in light of the comparison between the measured transmissibility index and the calculated transmissibility index.

In a drilling operation, various interactions between the borehole and the BHA can lead to vibrations. Some interactions are more closely related to particular types of vibration than others. For example, sideforce and torque are BHA-borehole interactions that are closely related to stick-slip vibrations. Low stabilizer sideforces (or other contact point sideforces) across a broad range of rotary speeds indicate a reduced propensity for generating torque and consequently a reduced risk of BHA induced stick-slip. In the methods and models discussed above, vibration performance indices were described to characterize the sideforce and the torque (see equations (e89)-(e92)). Through the relationship between torque and sideforce, additional indices may be developed. As one example, a sideforce slope index may be derived from the results of the BHA vibration models.

The BHA sideforces and the torque generated from these sideforces are functions of the following three parameters: RPM ($\omega_o$), WOB, and hole inclination ($\theta$), assuming that the hole size remains constant at any given sideforce contact location. The torque generated from each stabilizer or contact point can be represented by equation (e97).

$$\vec{\tau} = \vec{r} \times \vec{F} \tag{e97}$$

In equation (e97), r is the radius of the hole and F is the component of the sideforce due to friction, which is given by equation (e98).

$$\vec{F} = N_{Sideforce} \cdot \mu \cdot \vec{e}_{wellbore} \tag{e98}$$

In equation (e98), $N_{Sideforce}$ is the contact load acting normal to the borehole wall, $\mu$ is the coefficient of friction and $\vec{e}_{wellbore}$ is a unit vector that lies parallel to the wellbore wall. Because the resultant sideforce and radial vector are always orthogonal, the vector direction of the resulting torque will always be parallel to the centerline of the wellbore. Taking advantage of this enables simplification of equation (e97) to equation (e97'):

$$\tau = r \cdot N_{Sideforce} \cdot \mu \tag{e97'}$$

Accordingly, the amount of torque generated is related to the sideforce by $r\mu$ which can be constant depending on the selection of the coefficient of friction, $\mu$. The larger the sideforce, the more torque will be generated for any given coefficient of friction and hole size. It should be noted that equation (e97') underlies the BHA torque indices described above in equations (e91) and (e92).

When a BHA system is experiencing stick-slip vibrations, large changes in both the torque and RPM are observed. Therefore, the system's propensity for stick-slip can be calculated or predicted by examining the slope of the torque index chart (and/or sideforce index chart) relative to rotary speed. Taking the derivative of equation (e97') with respect to the rotary speed, $\omega_o$, yields equation (e99).

$$\frac{d}{d\omega_o}(\tau) = \frac{d}{d\omega_o}(r\mu N) \tag{e99}$$

Assuming r is not a function of rotary speed gives equation (e99').

$$\frac{d\tau}{d\omega_o} = r\mu\frac{dN}{d\omega_o} + rN\frac{d\mu}{d\omega_o} \tag{e99'}$$

In equation (e99'), $$\frac{dN}{d\omega_o}$$

is the slope of the sideforce index and can be determined using various methods for numerical calculation such as second-order differences or piecewise regression. If there are no velocity weakening effects, then $\mu$ can be assumed to be a constant value and equation (e99') reduces to equation (e99")

$$\frac{d\tau}{d\omega_o} = r\mu\frac{dN}{d\omega_o} \tag{e99''}$$

Equation (e99") describes the relationship between (1) the change in sideforce versus RPM and (2) the change in torque versus RPM. Operationally, when stick-slip events occur, it is usually diagnosed by identifying changes in RPM and torque. Accordingly, stick-slip tendency can be predicted by modeling the change in torque relative to the change in RPM and/or by modeling the change in sideforces relative to the change in RPM. Where the sideforce is a value directly calculated by the models described above, the sideforce may be preferred in some implementations. The total BHA sideforce index described above is the sum of all the contact points for a given BHA configuration represented by a BHA surrogate. Similarly, the total BHA torque index is the sum of all contact points represented by the BHA surrogate. Either may be used, but the remainder of this discussion will refer to the sideforce and a sideforce slope index. A torque slope index may be implemented through analogy to the sideforce index. Alternatively, it may be preferred to examine the sideforce and sideforce slope index of each contact point individually. Collectively, these sideforce slope and torque slope indices can be referred to as stick-slip indices in reference to one of the many uses and implementations therefore.

Figure 5:
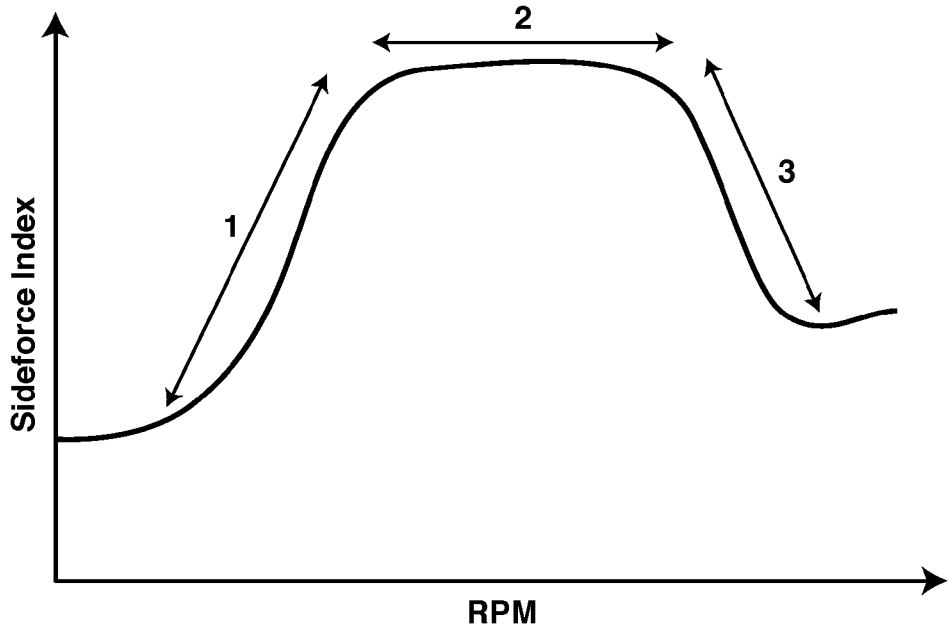
FIG. 5 shows an exemplary total BHA sideforce index plot.
Figure 6:
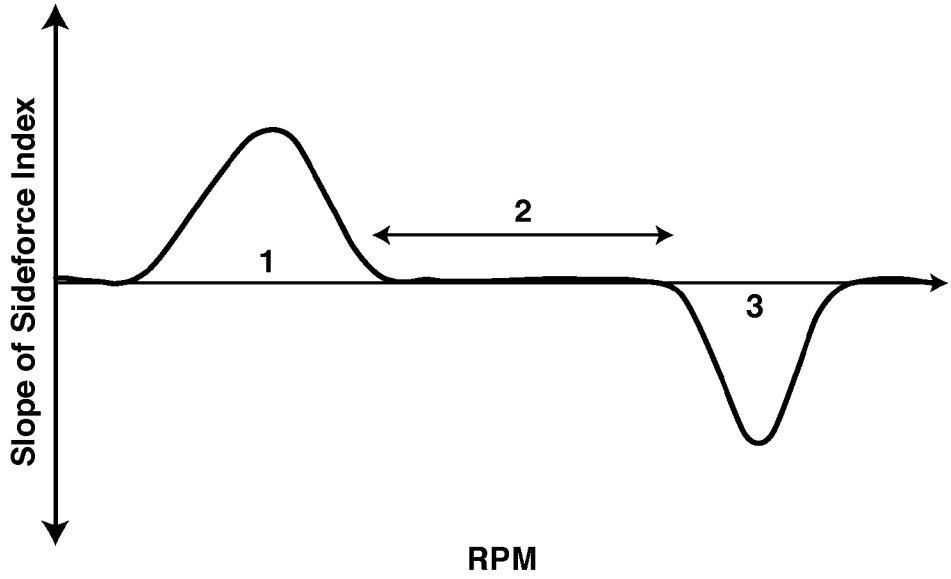
FIG. 6 shows an exemplary sideforce slope index plot.

FIG. 5 shows an exemplary total BHA sideforce index plot as a function of rotary speed with 3 regions identified: (1) a region with increasing slope, (2) a region with constant slope, and (3) a region with decreasing slope. While the magnitude of the total sideforce is one informative vibration performance index, the slope of the sideforce index may also provide a useful diagnostic. The sideforce slope index may be used to compare the relative stick-slip tendencies of different BHA designs. An example of a sideforce slope index plot based on FIG. 5 is shown in FIG. 6. Notice that during regions 1 and 3 of FIG. 5 the slope of the sideforce index is nonzero, resulting in non-zero values in corresponding regions of the sideforce slope index plot of FIG. 6. Any deviation of the sideforce from a constant value indicates an increased potential for stick-slip to occur. Accordingly, plotting the sideforce slope index as a function of the RPM identifies potential operating regions where stick-slip due to BHA contact points may be increased. To efficiently capture this sideforce slope index on one plot for a variety of operating conditions, the RMS and maximum values considering all the modes and end-lengths may be displayed. Alternatively, the sideforce slope index may be displayed and compared for particular contact points of interest.

Figure 7:
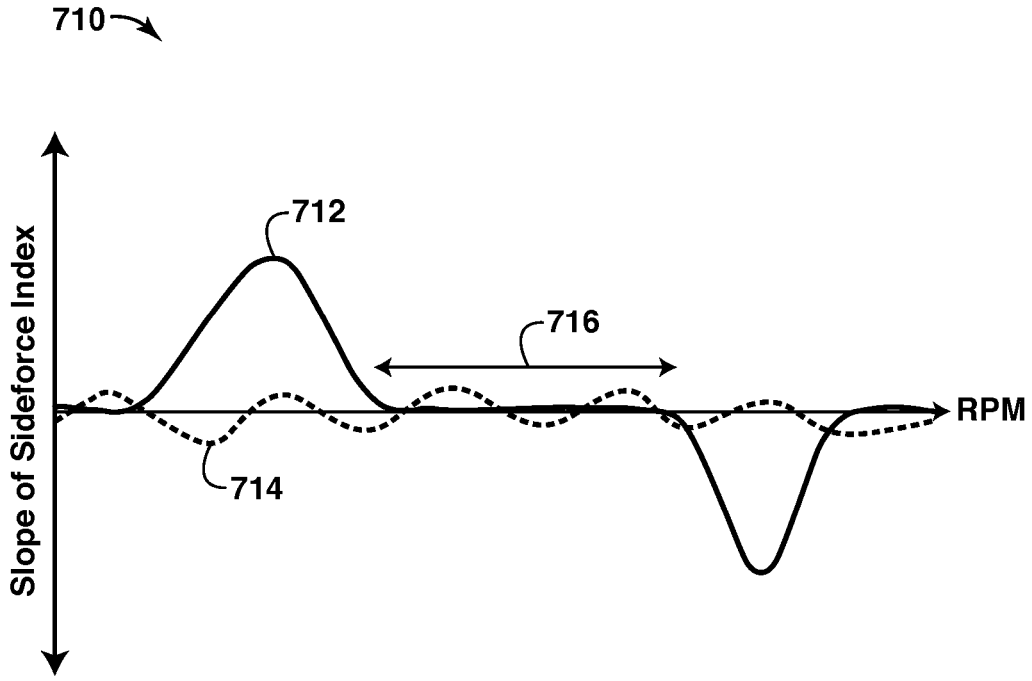
FIG. 7 shows an exemplary comparison of two sideforce slope index plots.

To further illustrate a possible use of the sideforce slope index in predicting stick-slip vibration tendencies, FIG. 7 illustrates a plot 710 including a first sideforce slope index 712 for a first BHA surrogate and a second sideforce slope index 714 for a second BHA surrogate. FIG. 7 also indicates, through arrow 716, a desired operating range. Although the first sideforce slop index 712 has areas of much higher sideforce slopes, in the region of the desired operating range 716, the first sideforce slope index is essentially zero indicating virtually no change in sideforces within the operating range. This would indicate a low propensity for BHA-induced stick-slip over the desired rotary speed range. In contrast, the second sideforce slope index 714 for the second BHA surrogate has variations in sideforces, indicated by the non-zero sideforce slope index, over the entire rotary range, including the desired operating range. For the desired operating range indicated, the first BHA surrogate would be a better choice since it has relatively lower sideforce slope indices over the desired operating range. While FIG. 7 illustrates the use of a sideforce slope index plot to compare two BHA surrogates, the sideforce slope index may also be used to identify preferred operating ranges for a given BHA surrogate.

In some implementations, velocity weakening effects can be considered by using equation (e99') and implementing an appropriate relationship for the coefficient of friction and rotary speed. Velocity weakening effects characterize the tendency of the resistance force as a function of velocity. As the velocity of the system increases, the effect of the resistance force decreases. Conversely, as the velocity of the system decreases, the magnitude of the resistance force increases. Because the direction of the resistance force is always opposite to the direction of motion, the result is instability in the system, and this effect describes the unstable nature of the stick-slip phenomena. As the magnitude of the resisting force increases for decreasing velocity, the system has an increased chance of initiating stick-slip. Due to the relationship between velocity and the resistance, a suitable equation may be readily developed to represent that relationship. The equation may consider factors such as component configuration, component materials and/or coatings, etc., which may each be constants or functions of some other factor.

As another example of the utility of a stick-slip index, the absolute value of the sideforce slope index may also be calculated, and the area under this curve can be calculated in order to quantify the relative stick-slip tendency of the BHA surrogate with a single number. This number could be used to easily identify the BHA's with the lowest tendency for BHA-induced stick-slip vibration. As above, some implementations may consider the area under the sideforce slope index curve for the entire range of rotary speeds analyzed or for only a limited range corresponding to desired operating conditions.

The foregoing discussion of slip-stick indices considered primarily sideforce slope indices based on the total BHA sideforce index, which is generally the sum of all the sideforces applied to the BHA surrogate, typically at the stabilizer components. Additionally or alternatively, the above analyses and variations may be calculated considering a single contact point sideforce by displaying the results for selected contact point sideforce locations or for different BHA configurations. These results would enable the engineer or analyst to identify which contact point position and/or configuration is contributing the most to the overall BHA-induced stick-slip tendency and would enable identification of the best place to locate a roller-reamer or other friction reducing technology.

In some implementations of the present methods, the vibration performance indices are calculated a number of times for a variety of rotary speeds and bit weights for each BHA configuration being modeled using a BHA surrogate. As one example of the varied operating conditions that may affect the indices, the different excitation modes in the flexural bending mode may be represented by different frequencies of the applied force at the bit. As another representative example, the uncertainty in the nodal point at the top of the BHA surrogate can be addressed through calculating dynamic results for a variety of nodal point "end-lengths" for both the flexural bending and twirl modes. These iterations yield multiple vibration performance index values for each rotary speed and/or bit weight. In some implementations, it may be appropriate to reduce these different index values to an RMS average value and a maximum value to simplify the analysis and display of these results. In other implementations, the plurality of indices may be combined or averaged with the use of a weighting factor intended to represent the degrees of relevance. For example, the weighting factor may indicate the likelihood that particular excitation modes will contribute to the vibrations to a greater degree than other excitation modes. Additionally or alternatively, the weighting factor may indicate the likelihood that a particular end-length in the BHA surrogate is more representative of the actual BHA configuration. These methods of accounting for the numerous variables in the BHA vibration models are described herein; others are available and are within the scope of the present disclosure.

As one example, the RMS average of a vibration performance index may be defined by equation (e100):

$$PI' = \sqrt{\frac{1}{mn}\sum_{i=1}^{m}\sum_{j=1}^{n}(PI)_{ij}^2} \tag{e100}$$

wherein PI' is the RMS average of the desired vibration performance index and $(PI)_{ij}$ is one of the indices defined in equations (e85)-(e92), or (e95), or derived from equations (e99)-(e99") for the $i^{th}$ of the m excitation modes and the $j^{th}$ of the n BHA end-lengths in the BHA surrogate.

The maximum of a vibration performance index may be defined by equation (e101):

$$PI' = \max_{i=1}^{m}\left\{\max_{j=1}^{n}(PI)_{ij}\right\} \tag{e101}$$

wherein PI' is the maximum value of the desired vibration performance index and $(PI)_{ij}$ is one of the indices defined in equations (e85)-(e92), or (e95), or derived from equations (e99)-(e99") for the $i^{th}$ of the m excitation modes and $j^{th}$ of the n BHA end-lengths in the BHA surrogate.

As mentioned above, the RMS average and the maximums for the vibration performance indices are only exemplary methods of evaluating the indices in light of the variables such as end-lengths and excitation modes. Other methods may weight one or more of the excitation mode influences and the end-length effects. Such weighting may be applied by experience or operator judgment. Additionally or alternatively, such weighting may be applied in cooperating with the log mode display of the present disclosure, first referenced above. The log mode display format is more fully described below. The use of the weighting factors related to the log mode display and measured performance in calculating vibration performance indices will be described more fully below in connection with the description of the log mode.

Modeling Systems

Figure 8:
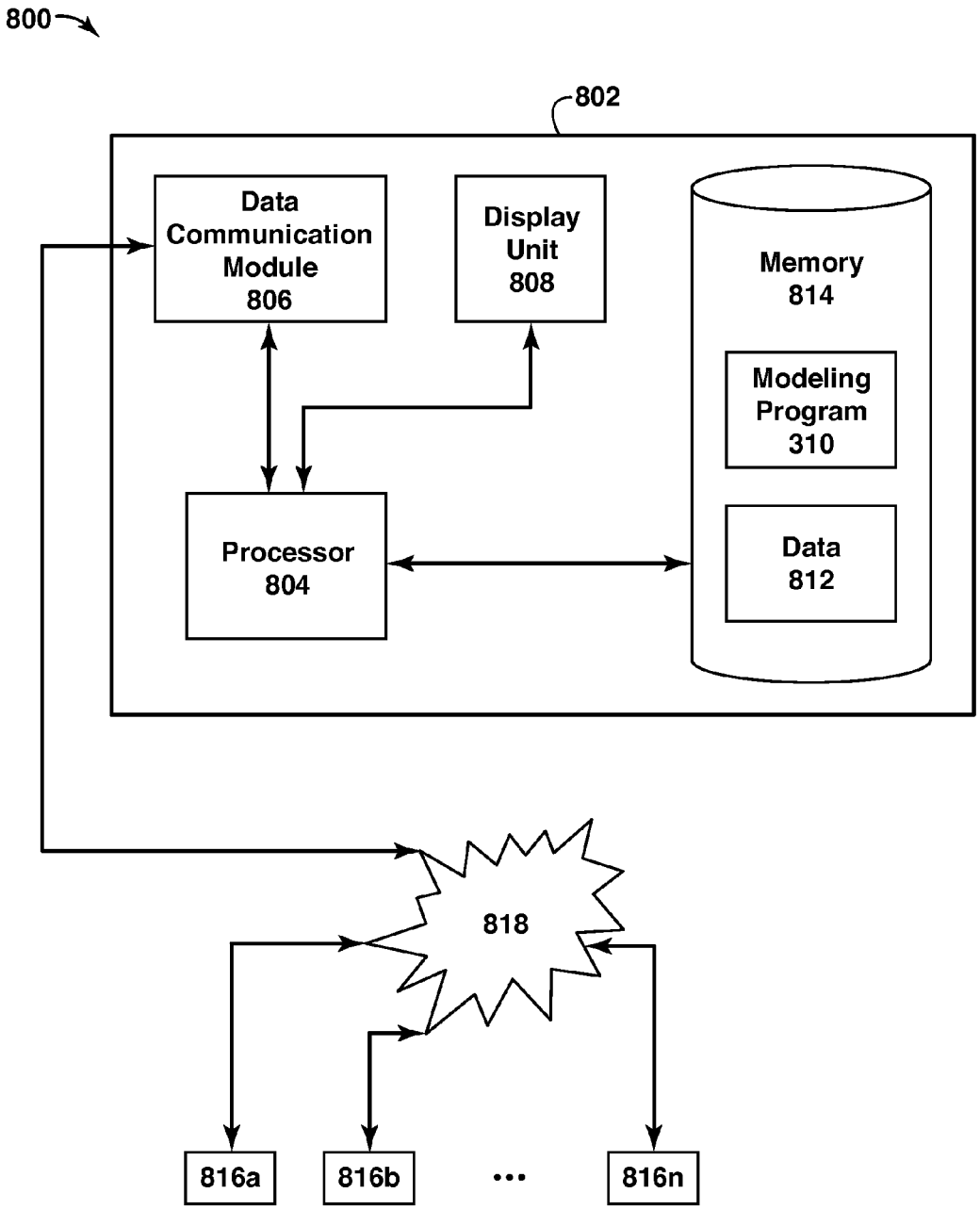
FIG. 8 provides an exemplary schematic of a modeling system.

As one exemplary embodiment, the methods described above may be implemented in a modeling system, as shown in FIG. 8. FIG. 8 is an exemplary embodiment of a modeling system 800 having various elements and components utilized to model BHA performance, to calculate results, and to display the results of the calculations (e.g., simulated results of calculated data in graphical or textual form) of the BHA surrogates. The modeling system 800 may include a computer system 802 that has a processor 804, data communication module 806, monitor or display unit 808, and one or more modeling programs 810 (e.g., routines, applications or set of computer readable instructions) and data 812 stored in memory 814 in files or other storage structures. The computer system 802 may be a conventional system that also includes a keyboard, mouse and other user interfaces for interacting with a user. Similarly, the display unit 808 may be a conventional monitor or may be any other suitable apparatus for providing a visual output of the results, such as a printer. The modeling programs 810 may include the code configured to perform the methods described above, while the data 812 may include measured data, results, calculated data, operating parameters, BHA surrogates, including information and/or data regarding BHA designs, dimensions, materials, etc., and/or other information utilized in the methods described above. Of course, the memory 814 may be any conventional type of computer readable storage used for storing applications and data, which may include hard disk drives, memory sticks, floppy disks, CD-ROMs and other optical media, magnetic tape, and the like.

Because the computer system 802 may communicate with other devices, such as client devices 816*a*-816*n*, the data communication module 806 may be configured to interact with other devices over a network 818. For example, the client devices 816*a*-816*n* may include computer systems or other processor based devices that exchange data, such as the modeling program 810 and the data 812, with computer system 802. In particular, the client devices 816*a*-816*n* may be associated with drilling equipment at a well location or may be located within an office building and utilized to construct the BHA surrogates representative of the BHA configurations to be evaluated. As these devices may be located in different geographic locations, such as different offices, buildings, cities, or countries, a network 818 may be utilized to provide the communication between different geographical locations. The network 818, which may include different network devices, such as routers, switches, bridges, for example, may include one or more local area networks, wide area networks, server area networks, metropolitan area networks, or combination of these different types of networks. The connectivity and use of the network 818 by the devices in the modeling system 800 is understood by those skilled in the art. While the network 818 and the client devices 816 may be used in connection with the computer system 802, some implementations may perform all of the modeling and calculating steps with a single computer system 802.

To utilize the modeling system, a user may interact with the modeling program 810 via graphical user interfaces (GUIs), which are described in various screen views in FIGS. 9, 10A-10D, 11A-11B, 12, 13, 14A-14B, 15, 16, 17, 18A-18B, 19A-19C, 20A-20B, 21A-21E, 23A-23D, 24, 25, and 26. Via the screen views or through direct interaction, a user may launch the modeling program to perform the methods described above. For example, model results may be generated for various BHA surrogates and specific operating conditions, such as the sample output in these figures. The results may be graphically tabulated or displayed simultaneously for direct comparison of different BHA surrogates. Accordingly, FIGS. 9, 10A-10D, 11A-11B, 12, 13, 14A-14B, 15, 16, 17, 18A-18B, 19A-19C, 20A-20B, 21A-21E, 23A-23D, 24, 25, and 26 are exemplary screen views of a modeling program in accordance with some aspects of the present techniques. As the screen views are associated with modeling system 800, FIGS. 9, 10A-10D, 11A-11B, 12, 13, 14A-14B, 15, 16, 17, 18A-18B, 19A-19C, 20A-20B, 21A-21E, 23A-23D, 24, 25, and 26 may be best understood by concurrently viewing FIG. 8 and FIGS. 9, 10A-10D, 11A-11B, 12, 13, 14A-14B, 15, 16, 17, 18A-18B, 19A-19C, 20A-20B, 21A-21E, 23A-23D, 24, 25, and 26. Further, it should be noted that the various menu bars, virtual buttons and virtual slider bars, which may operate in similar manners, may utilize the same reference numerals in the different screen views for simplicity in the discussion below. While FIGS. 9, 10A-10D, 11A-11B, 12, 13, 14A-14B, 15, 16, 17, 18A-18B, 19A-19C, 20A-20B, 21A-21E, 23A-23D, 24, 25, and 26 and the associated description herein describe a particular modeling system and program, such figures and descriptions are merely exemplary and the methods and models described above can be implemented in a variety of manners. Similarly, it should be noted that the data and values represented in the exemplary screen views of FIGS. 9, 10A-10D, 11A-11B, 12, 13, 14A-14B, 15, 16, 17, 18A-18B, 19A-19C, 20A-20B, 21A-21E, 23A-23D, 24, 25, and 26 are for purposes of example only and are not based on actual field data. The absolute and relative values of the various outputs and plots are for purposes of discussion and example and may vary from that shown when the present methods are implemented.

Figure 9:
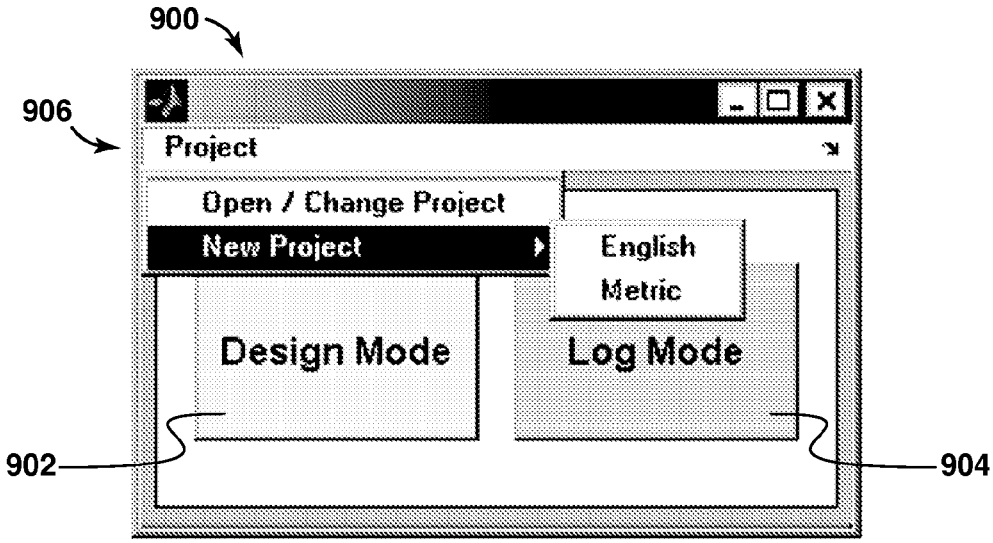
FIG. 9 provides an exemplary screen view provided by a modeling system.

In FIG. 9, a screen view 900 of a startup image for the exemplary modeling program is shown. In this screen view 900, a first virtual button 902 and a second virtual button 904 are presented along with menu options in a menu bar 906. The first virtual button 902, which is labeled "Design Mode," is selected by the user to operate the modeling program 810 to model one or more BHA surrogates to predict vibration performance, including calculated state variables and vibration performance indices. In typical applications, design mode is used to compare alternative BHA surrogates so that an optimal BHA surrogate may be used for the drilling process. The screen views associated with the design mode are presented in FIGS. 9, 10A-10D, 11A-11B, 12, 13, 14A-14B, 15, 16, 17, 18A-18B, 19A-19C, 20A-20B, 21A-21E. The second virtual button 904, which is labeled "Log Mode," may be selected to operate the modeling program 810 in a log mode that compares measured data from a drilling operation with one or more calculated results from modeled BHA surrogates, which may operate under similar operating conditions (e.g., operating parameters) and may have components and features at least substantially similar to those represented by the bottom hole assembly surrogate. In log mode, the measured data, which may include data derived from measured data, from one or more drilling intervals are presented alongside the model predictions to evaluate the indices relative to the actual data. The screen views specific to the log mode are presented in FIGS. 23A-23D, 24, 25, and 26. The menu options in the menu bar 906 may include an "Open/Change Project" option to select an existing BHA surrogate or a "New Project" option that may initialize a new BHA surrogate, which may be in English or metric units as indicated in the submenu.

Figure 10A:
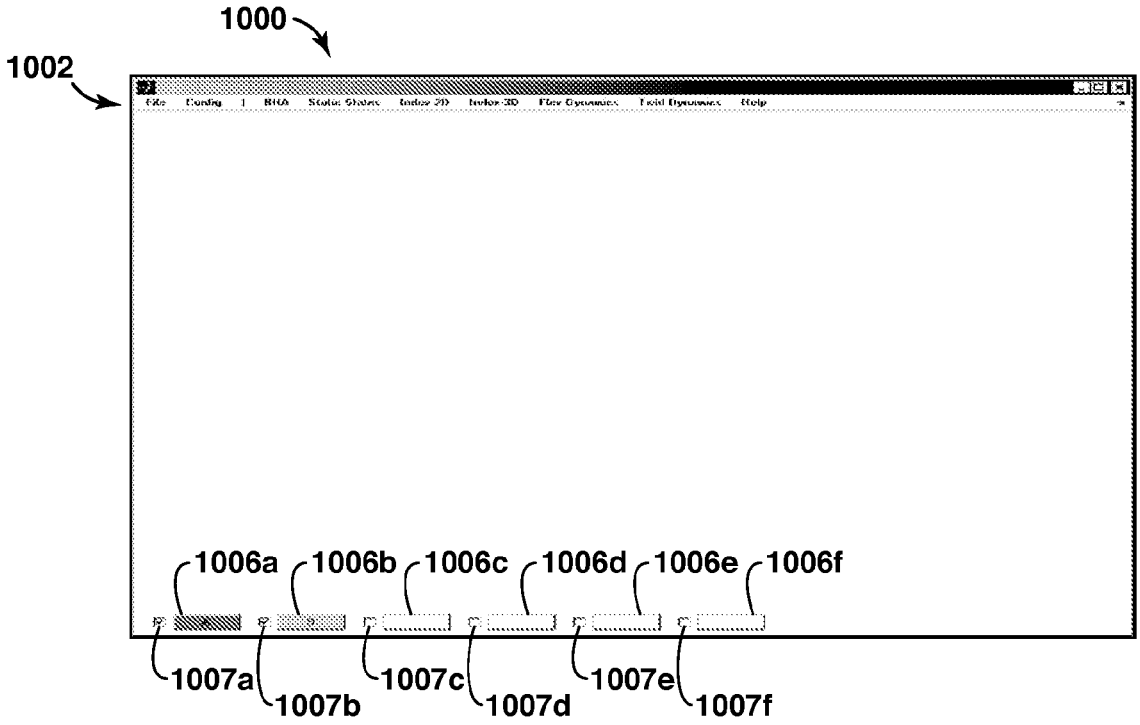
FIGS. 10A-10D are exemplary screen views provided by a modeling system.
Figure 10B:
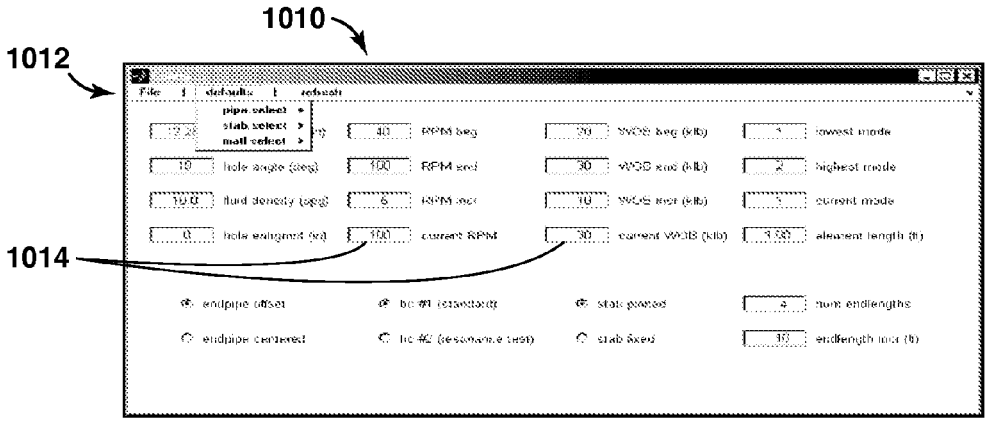

If the design mode is selected, a screen view 1000 of a blank panel is presented, as shown in FIG. 10A. The menu tabs in the menu bar 1002 are a typical "File" menu tab to enable printing, print setup, and exit commands, and a configuration menu tab labeled "Config," The configuration menu tab invokes the configuration panel as shown in FIG. 10B. The menu bar 1002 may also include one or more Design Mode processes, e.g., "BHA," "Static States," "Index 2D," "Index 3D," "Flex Dynamics," "Twirl Dynamics," and "Help." These different process menu items are explained in more detail below, but the processing concept is to apply each of these methods to the selected BHA surrogates for which the check boxes 1007*a*-1007*f* are selected. Each process enables the screen controls and the display data as required for the process to execute, in this sense the screen view 1000 may be considered to be "context sensitive."

Also, virtual buttons 1006*a*-1006*f* may be utilized to access and modify the different BHA surrogates. In this example, two of the virtual buttons, 1006*a* and 1006*b*, are associated with corresponding "A" and "B" BHA surrogates, while virtual buttons 1006*c*-1006*f* do not have BHA surrogates associated with them. Further, the virtual check boxes 1007*a*-1007*f* next to the names of the BHA surrogates may be used to include specific BHA surrogates as part of the process calculations to compare the BHA surrogates. As indicated in this example, the BHA surrogate "A," which may be referred to as BHA surrogate A, and BHA surrogate "B," which may be referred to as BHA surrogate B, are to be compared in the different screen views provided below.

As shown in FIG. 10B, if the "Contig" menu tab is selected from the menu bar 1002, screen view 1010 may be presented to define the relevant operating parameters for the modeling process, as described below. In screen view 1010, menu tabs in the menu bar 1012 may be utilized to adjust the default pipe, stabilizer, and material properties for inserting new BHA components in the BHA design panel. The menu bar 1012 may include a file menu tab (labeled "File"), a refresh menu tab (labeled "refresh"), and a defaults menu tab (labeled "defaults"), which may include various submenus for different types of pipes, stabilizers and materials. In particular, for this exemplary screen view 1010, various values of the BHA design and operating parameters are presented and may be modified in the text boxes 1014. The text boxes 1014 include nominal hole diameter in inches (in); hole inclination in degrees (deg); fluid density in pounds per gallon (ppg); WOB range in kilo-pounds (klb); rotary speed range in RPM; excitation mode range; static end-point boundary condition (e.g., offset or centered); boundary condition at the bit for flexural dynamic bending; stabilizer model (pinned or fixed); the number of end lengths; and the end-length increment in feet (ft). For projects that are specified in metric units, the corresponding metric units may be used. Alternatively, the method may be adapted to an arbitrary system of units depending only on the software implementation.

In an alternative embodiment, the configuration file may supplement the inclination angle with the rate of change of inclination angle for curved wellbores. More generally, for three-dimensional models, the rate of change of azimuth angle may also be included. Furthermore, a wellbore survey file may be identified and read by the program to provide input data to model a specific drilling application.

Figure 10C:
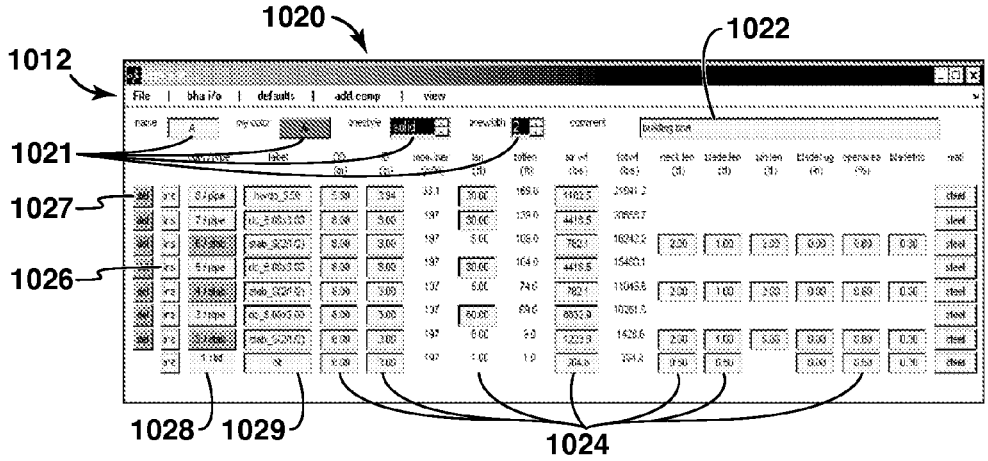

The description for each of the BHA surrogates may be presented from the BHA design tabs 1006*a*-1006*f* in FIG. 10A. As one example, FIG. 10C is an exemplary screen view 1020 of a configuration panel for describing the BHA surrogate A, which is accessed by selecting the BHA design tab 1006*a*. The screen view 1020 includes the different control boxes 1021 for the specific BHA surrogate, such as BHA surrogate name of "A," a designated color of "dark gray," a linestyle of "solid," and line width as "2." In addition, an additional text box 1022 may be utilized for additional information or comments regarding the BHA surrogate being constructed and modeled, such as "building bha." The BHA design menu bar 1012 has a "bha i/o" menu option to facilitate import and export of bha model descriptions, a "defaults" menu for the local selection of default pipe, stabilizer, and material properties, an "add.comp" menu to append multiple elements to the top of the model description, and a "view" menu option to enable scrolling the display to access BHA components not visible in the current window.

The virtual buttons 1026, 1027 and 1028, along with edit boxes 1029 provide mechanisms to modify the layout of the BHA assembly for a specific BHA surrogate. The components and equipment may be inserted and deleted from the selected BHA layout by pressing the corresponding virtual buttons, which include an insert virtual button 1026 labeled "ins" and a delete virtual button 1027 labeled "del." The virtual buttons 1028 indicate the element index number and whether an element is a pipe or stabilizer element, which may be indicated by colors (e.g. light or dark gray) and/or by text (e.g., stab or pipe). Pressing one of the virtual buttons 1028 toggles an element from a pipe to a stabilizer, or vice versa. The currently selected default pipe or stabilizer type is set for the new toggled element. Edit boxes 1029 are initialized to the label of the respective input data table that is read from a file, such as a Microsoft Excel™ file, or may be modified by entering data directly into the text box. By typing over the edit boxes 1029, the list may be customized by the user. Right-clicking on one of the edit boxes 1029 brings up a popup menu to select any of the pre-existing elements of that type, after which the values for OD, ID, and other parameters may be pre-populated. Any of the edit boxes 1029 may then be modified after being initialized in this way to provide full customization of BHA components.

In addition to specifying the layout of the BHA surrogate, the screen view 1020 includes material information for each component in a BHA surrogate, as shown in the text boxes 1024. In this specific example, the text boxes 1024 include the outer diameter (OD), inner diameter (ID), length (len), total length (totlen), moment of inertia (mom.iner), air weight (wt), total air weight (totwt), neck length (neck.len), blade length (blade.len), pin length (pin.length), stabilizer diameter or blade undergauge clearance (blade/ug), percent blade open area (openarea), blade friction coefficient for calculating torque from contact sideforce (bladefric), and material (mad). The total length, total weight, and moment of inertia are calculated by the modeling program and not the user, whereas the other text boxes 1024 may be edited by the user. Further, to model unusual components, it may be possible to overwrite the calculated weight value for a given component. For example, if the total weight of the component is known, then it can be entered into the respective text box 1024 directly to replace the value in the BHA surrogate. The modeling program may adjust the density of the material to match the value entered by a user based on the OD, ID and overall length of the component. This aspect may be useful when matching the stiffness and mass values for components that may only be approximated because of certain geometrical factors (e.g., an under-reamer with cutting structure located above a bull nose). That is, both inertia and stiffness values may be matched even though the geometry may not be well represented by a simple cylindrical object. In this way, an equivalent cylindrical section may be generated to approximate the dynamic characteristics of the actual drilling component.

The modeling program may include various limitations on the specific component positioning in the BHA layout. For example, the BHA assemblies may have to begin with a drill bit element and end with a pipe section. Similarly, stabilizers may not be allowed to be the top component of the BHA layout.

Figure 10D:
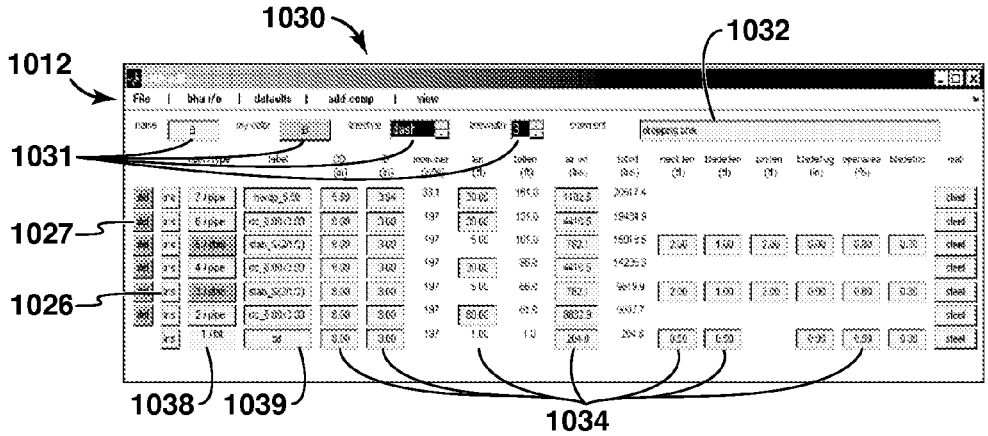

As another example, FIG. 10D is an exemplary screen view 1030 of a configuration panel for describing the BHA surrogate B, which is accessed by selecting the BHA design tab 1006*b*. The screen view 1030 includes different control boxes 1031, such as the specific BHA surrogate name of "B," a designated color of "light gray," a linestyle of "dash," and a linewidth of "3." In addition, a descriptive comment may be provided in text box 1032. The screen view 1030 includes the same virtual buttons 1026 and 1027 as FIG. 10D, in addition to virtual boxes 1038 and text boxes 1034 and 1039, which are specific to define the BHA surrogate B. In this specific example, the difference between A and B is the near-bit stabilizer in BHA surrogate A. This component tends to build wellbore inclination angle for the BHA surrogate A, whereas the absence of this component tends to drop angle for the BHA surrogate B, as described in more detail below. Once the parameters and layout are specified for the BHA surrogates, the BHA surrogates can be verified by the user by viewing graphical or textual displays of the BHA surrogate, as seen in FIGS. 11A and 11B.

Figure 11A:
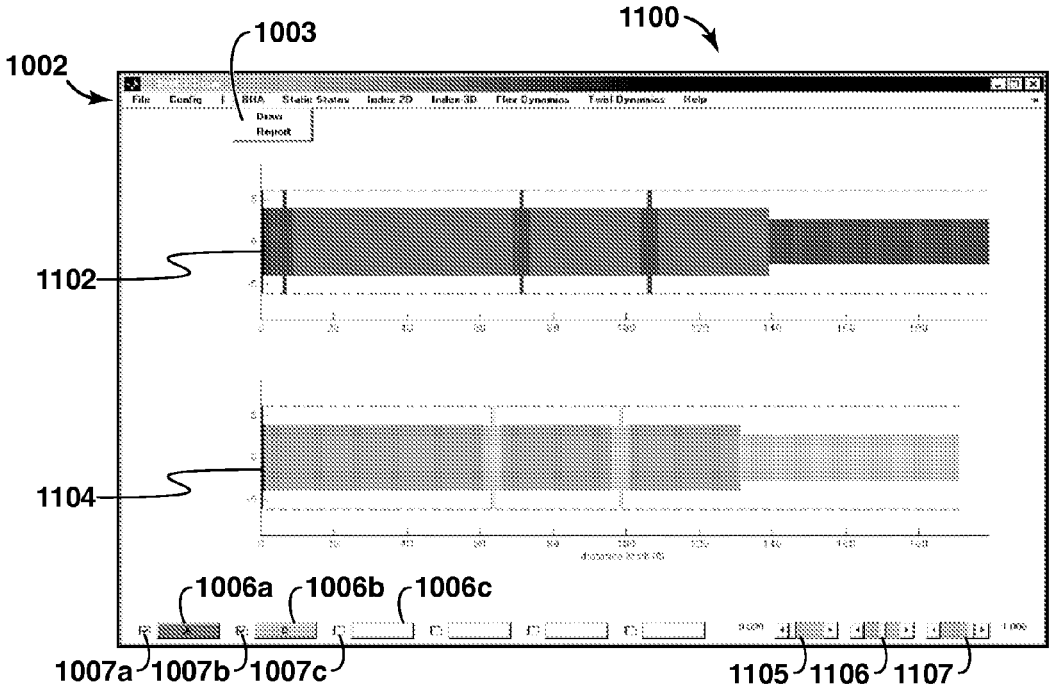
FIGS. 11A-11B are exemplary screen views provided by a modeling system.

FIG. 11A is a screen view 1100 of graphical displays 1102 and 1104 of the different BHA surrogates that is obtained by selecting the "BHA—Draw" menu 1003. In this screen view 1100, the BHA surrogate A and BHA surrogate B are displayed. The BHA surrogates being displayed are identified by reference to the BHA design tabs 1006*a*-1006*b* and the associated virtual check boxes 1007*a* and 1007*b*. In particular, the graphical display 602 is associated with the BHA surrogate A and the graphical display 604 is associated with the BHA surrogate B. The BHA design tabs 1006*a*-1006*b* operate in a manner as described in connection with FIG. 10 to allow a user to modify the BHA surrogate configuration.

In FIG. 11A, the virtual slider bars 1105-1107 may be utilized to adjust the view along various lengths of the BHA surrogates. In the present embodiment, virtual slider bars are shown as three separate slider elements, one to control the left or top edge of the window, one to control the right or bottom edge of the window, and a center slider element to allow the current window of fixed aperture to be moved along the respective dataset axes. Other slider bars are possible without deviating from this data processing functionality.

Figure 11B:
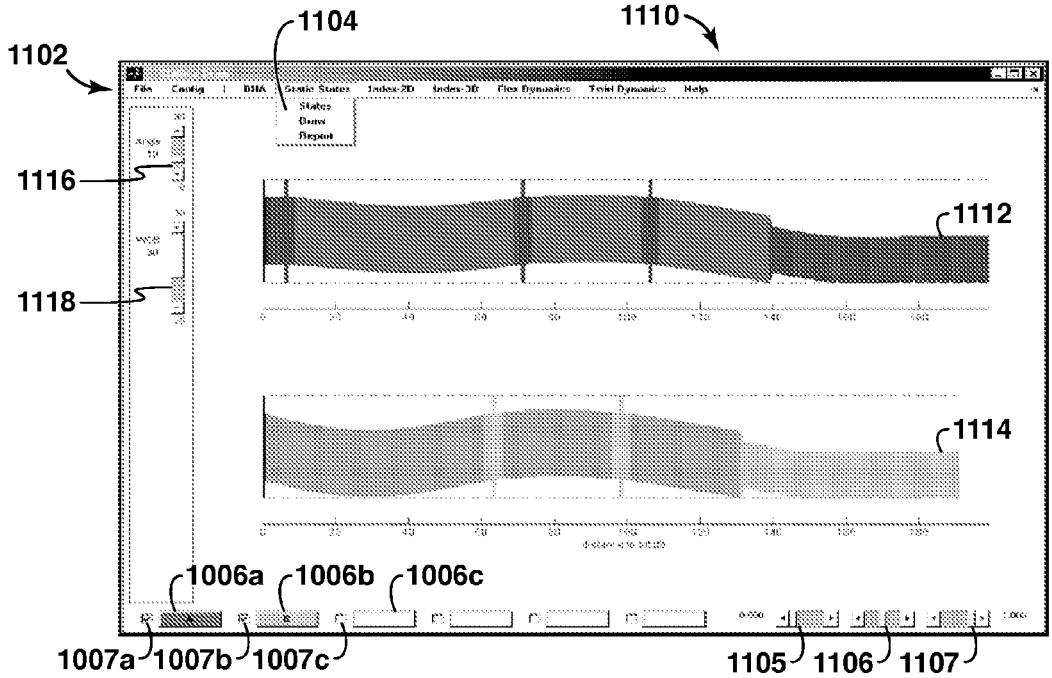

FIG. 11B presents another graphical illustration of the BHA surrogate, this time under simulated static conditions applying the static calculations. The view presented in FIG. 11B may be viewed by selecting the "Static States—Draw" menu tab 1004 from the menu bar 1002. In FIG. 11B, screen view 1110 may include graphical displays 1112 and 1114 of the different BHA surrogates. The graphical displays 1112 and 1114 present the static deflections experienced by the BHA surrogates due to axial loading and gravity. In this screen view 1110, the graphical display 1112 is associated with the BHA surrogate A and the graphical display 1114 is associated with the BHA surrogate B. These graphical displays 1112 and 1114 illustrate the BHA lying on the low-side of the borehole, with the bit at the left end of the assembly. The virtual slider bars 1105-1107 and the BHA design tabs 1006*a*-1006*b* along with the virtual check boxes 1007*a* and 1007*b* may operate as discussed above in FIG. 11A. In addition, the virtual slider bars 1116 and 1118 may be utilized to adjust the WOB and inclination angle. In some implementations, when virtual slider bars 1116, 1118, and other similar components are adjusted, the corresponding values displayed in the "Config" panel of FIG. 10B may be updated to synchronize various components of the modeling program that utilize the same dataset values. After being modified, other calculations of results and images use the updated values that have been selected. In some implementations, the virtual slider bars 1116 and 1118 may be configured to allow the operator to view the impact of certain changes before saving them back to the configuration file for synchronization with the other components of the program. For example, some aspects of the program, including some of the modeling and calculations, may be time-consuming and/or burden the processors of the computer systems. Accordingly, efficiency may be gained by allowing a user to view the impact of a change on a limited set of calculations and associated output displays before updating all of the calculations capable of being performed in accordance with the present methods and systems.

Figure 12:
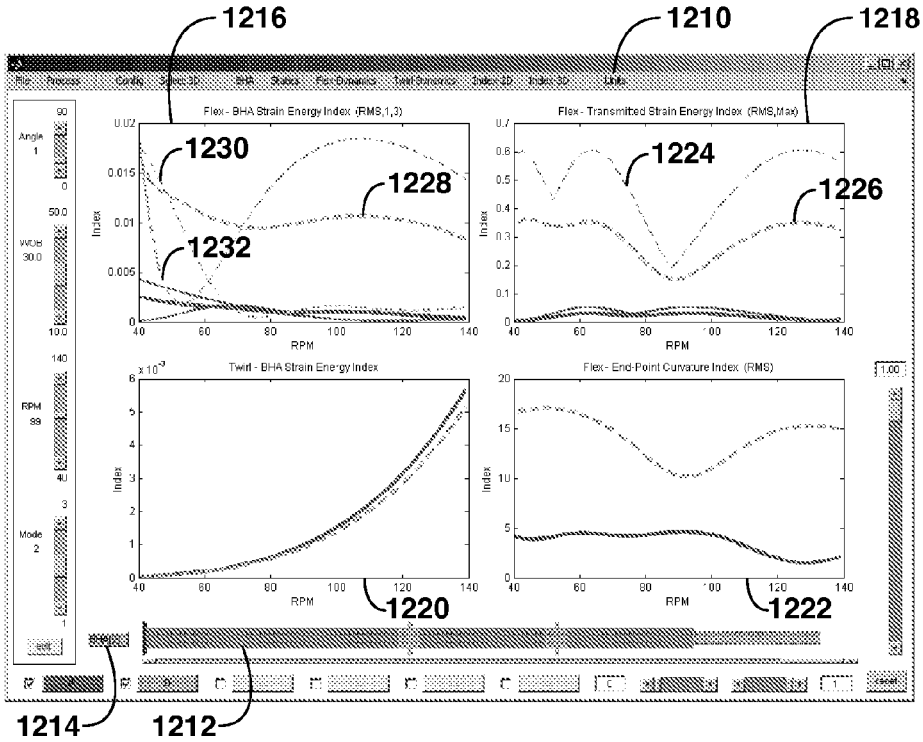
FIG. 12 provides an exemplary screen view provided by a modeling system.

While FIGS. 11A and 11B provide exemplary methods of illustrating the configuration of the BHA surrogate, various other methods and displays may be implemented for converting the input BHA surrogate data of FIGS. 10C and 10D into visual displays. The visual, graphical representation of the BHA surrogate may provide a quick reference to the configuration for consideration alongside the various charts and comparisons that are described below. For example, when working with many design alternatives for BHA surrogates, one may lose track of which configuration or BHA surrogate is associated with the specific colors and line types used in the displays of model results. To interpret the results on the screen, it is often necessary to refer back to the BHA descriptions to relate the results to the BHA models. FIG. 12 provides an exemplary screen view 1210 illustrating four different index plots for two BHA surrogates. The functionality of the various slider bars and the specifics of the index plots are described elsewhere herein. FIG. 12 illustrates that a window including the functionality described herein may further be configured to include a BHA schematic 1212. Specifically, a small portion of the screen 1210 has been allocated to include a graphical representation 1212 of the BHA surrogate. The screen 1210 of FIG. 12 includes only enough room for one BHA schematic 1212 though some implementations may be adapted to display more than one BHA schematic. When schematics for less than all of the BHA surrogates being modeled are displayed, the screen 1210 may include a schematic selection button 1214, which may be near to the schematic 1212. By clicking the schematic selection button 1214, the screen may rotate through each of the selected BHA surrogates. FIG. 12 provides one exemplary method of illustrating the BHA surrogate configuration. Additionally or alternatively, a button on the screen or a menu selection item may be used to call a pop-up screen that may include graphical schematics 1212 of one or more BHA surrogates, which may be of a size smaller than the output display screen.

FIG. 12 additionally illustrates that each of the plots on the display screen 1210 may provide data regarding different states and/or indices. For example, plot 1216 graphs the results of the BHA strain energy index calculations for flex mode vibrations, plot 1218 graphs the results of the transmitted strain energy index calculations for flex mode vibrations, plot 1220 graphs the results of the BHA strain energy index calculations for twirl mode vibrations, and plot 1222 graphs the results of the end-point curvature index for flex mode vibrations. Additionally or alternatively, as shown in FIG. 12, the different plots 1216-1222 may be configured to present combined indices, such as RMS indices or MAX indices, generated through the simulations of the BHA surrogates with differing multiples of the rotary speed and the various end lengths, such as described above. Plot 1218, for example, graphs the MAX results 1224 and the RMS average results 1226 of the transmitted strain energy index for the flex mode vibration. Still additionally, the systems and methods of the present disclosure may be adapted to calculate and display the results for specific multiples of the rotary speed and/or end length. Plot 1216 of FIG. 12 illustrates one implementation of this method that plots the results for RMS average 1228, 1× multiple rotary speed 1230, and 3× multiple rotary speed 1232. The calculation and display of results for the states and indices at each of the rotary speed multiples and/or end-lengths, when implemented, may enable more thorough analysis and/or comparisons between multiple proposed BHA surrogates and/or between a simulated BHA surrogate and measured conditions during drilling operations.

Figure 13:
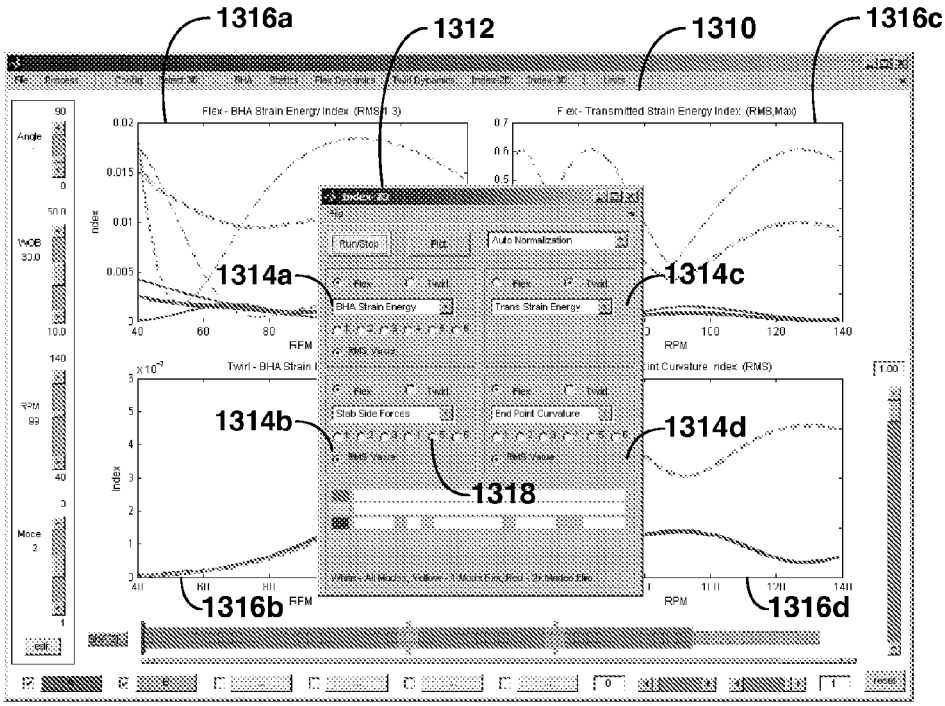
FIG. 13 provides an exemplary screen view provided by a modeling system.

FIG. 13 illustrates additional features that may be incorporated into implementations within the present disclosure. FIG. 13 illustrates an output display 1310 similar to several of the other displays described herein; features in common with other figures and described elsewhere herein operate as described. FIG. 13 also includes an exemplary representation of a graphics control panel 1312. For efficiency in program usage and interpretation of the model results, a graphics control panel 1312 may be developed and implemented to facilitate the customization of the output display. For example, different indices and/or states can be selected for display from the model results. Additionally or alternatively, options such as whether and how to normalize the results may be selected. Similarly, the graphics control panel may allow the user to select whether to display the RMS value, the Max value, or a specific multiple of the rotary speed, such as indicated by the selection buttons and associated numbers 1318. Some implementations may include options to allow the user to vary the color, pattern, weight, or other aspect of the display to improve the clarity of the results. The graphics control panel 1312 may be configured to allow the user to change the display configuration in any of a variety of manners. For example, some implementations may remove the slider bars from the main display screen and incorporate them into the graphics control panel 1312. In some implementations, the system would perform the computations for each of the selected BHA surrogates and the output or results for the computations are selectively displayed according to the user's preferences in the graphics control panel 1312. In the exemplary graphics control panel 1312, the user can specify the data to be displayed in each portion of the display window. For example, the graphics control panel 1312 includes four output display selection regions 1314*a*-1314*d* corresponding to the four output display regions 1316*a*-1316*d* in the underlying display screen.

As discussed in connection with FIG. 13, some implementations of the present systems and methods may include normalization options. The systems and methods described herein are primarily intended for use in designing bottom hole assemblies, designing drilling operations for use with bottom hole assemblies, and/or diagnosing or analyzing the performance of a bottom hole assembly and/or its operation. One efficient method of such design and/or analysis is through comparisons, which may be between two proposed BHA surrogates or between a given BHA surrogate and a baseline BHA surrogate operation established as a target performance or an acceptable performance. A normalization routine may be established to facilitate the analysis and/or the design comparison process. Various normalization options are available; non-exhaustive examples are provided herein and others may be similarly used.

As one example of a normalization option, any of the various calculations or indices described herein may have a minimum value, which may be established either by operability or by preference. The minimum value of the results for the collection of surrogates to be displayed in each plot area may be set to 1, with each of the calculations and indices for all BHA surrogates scaled relative to this denominator. Additionally or alternatively, the calculations and/or indices for BHA surrogates may be scaled or normalized to a target value, which may not be the minimum value. In conjunction with normalization around a target value, the plotted calculations and/or indices may be color coded or otherwise marked when the deviation from the target value is too great, such as to indicate intolerable vibration conditions.

Additionally or alternatively, an "absolute" normalization routine may be implemented. Absolute normalization would scale all of a BHA surrogate's calculations and/or indices relative to some pre-calculated values for each index or state. For example, if a certain BHA configuration became a design standard for an operating area, then at the standard operating parameters (WOB and RPM), the numerical results can be captured and used as a divisor. Then that BHA would have a value of 1 for each index at the reference conditions. All other BHA surrogates would then be compared with that reference for each of the indices.

Relative normalization routines may also be implemented. One implementation of "relative" normalization would set the divisor such that the minimum value (presuming minimum is desired for the given index or state) of all the displayed design configurations at the current operating parameters would be equal to 1. Then the alternative designs and different operating conditions would be scaled relative to the "best case" present in the current data on the screen. For example, with a BHA standard included in the design comparisons, the results would be similar to the absolute normalization above. In implementations where multiple states and/or indices are being displayed, the normalization routine may be customized to apply different normalization routines for the different states or indices, such as using the minimums or maximums as the normalization divisor. In some implementations, the user may select the normalization routine, such as through a graphics control panel 1312. Additionally or alternatively, the normalization routine may be associated with the particular index or state such that selection of a particular index applies the appropriate normalization routine.

Figure 14A:
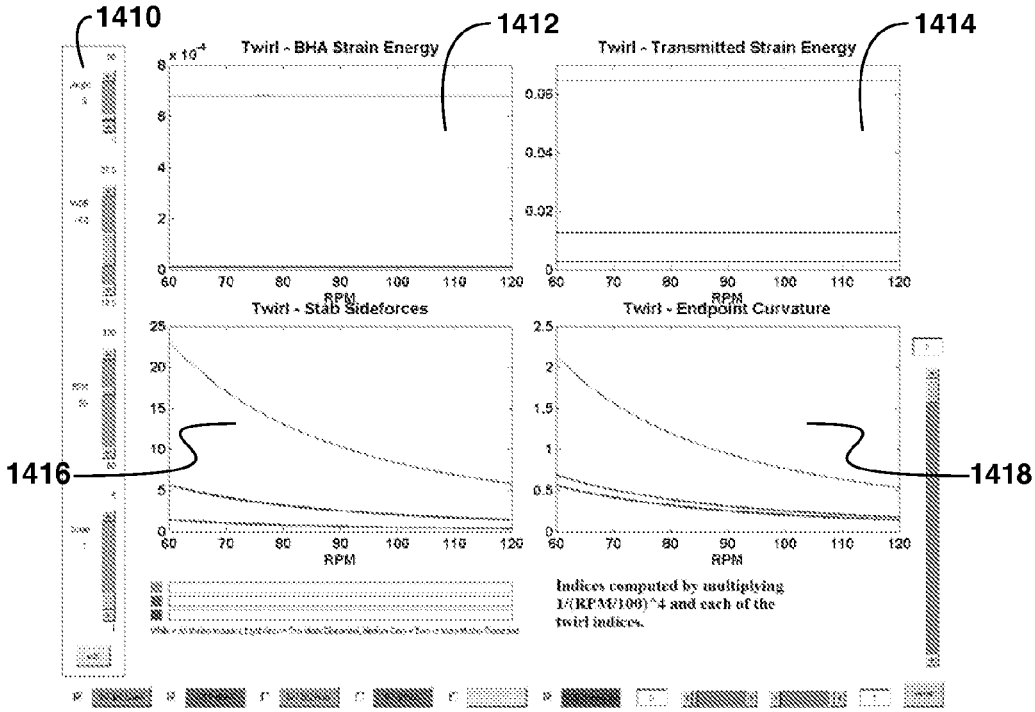
FIGS. 14A-14B are exemplary screen views provided by a modeling system.
Figure 14B:
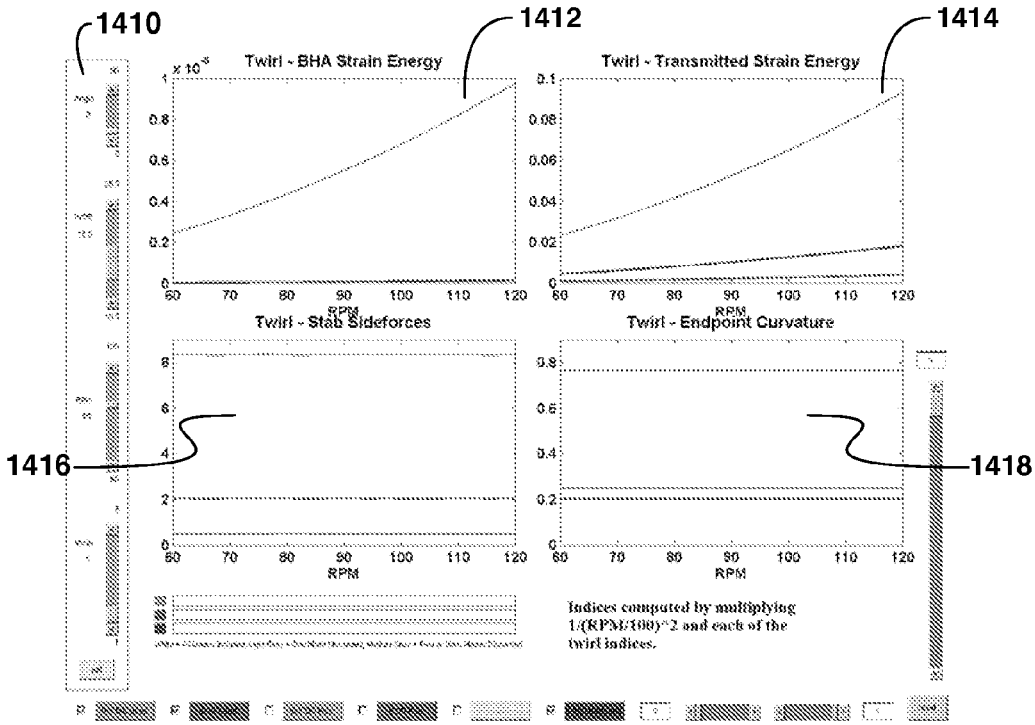

FIGS. 14A and 14B provide examples or further normalization options to facilitate the comparison and analysis of various BHA surrogates. As seen in the discussion above, several of the states and/or indices of the present methods vary as a function of one or more parameters. For example, several of the vibration performance indices vary as a function of the rotary speed. As the rotary speed is constant when comparing differing BHA surrogates under identical operating conditions, the output of the calculations for one or more indices may be simplified by factoring out the rotary speed. Specific examples are shown in FIGS. 14A and 14B and described herein; other examples will be readily apparent.

The displays 1410 of FIGS. 14A and 14B illustrate four of the twirl-related indices described herein: the BHA strain energy index 1412, the transmitted strain energy index 1414, the sideforce index 1416, and the endpoint curvature index 1418. As seen in the discussion above, the BHA strain energy index and the transmitted strain energy index vary as the fourth power of the rotary speed. FIG. 14A illustrates that the relatively complex plot of strain energy indices can be simplified to a linear plot by simply dividing the index value by the rotary speed raised to the fourth power. Similarly, FIG. 14B illustrates that the sideforce index and the endpoint curvature index, which each vary as the rotary speed squared, can be simplified to a linear plot by dividing the index value by the rotary speed squared.

Figure 15:
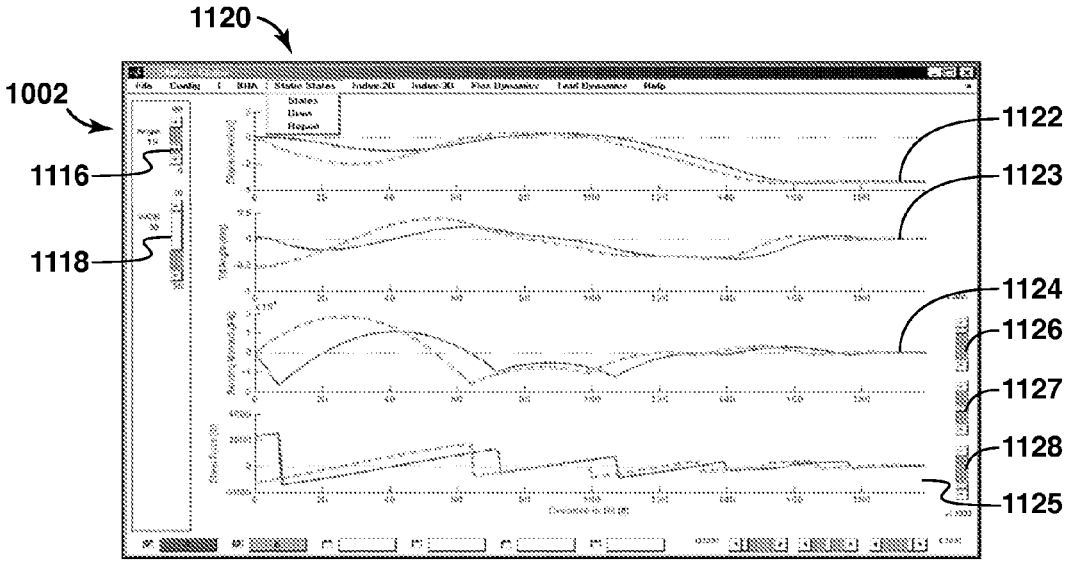
FIG. 15 provides an exemplary screen view provided by a modeling system.

Continuing with the discussion of exemplary display output options available in systems implementing the present methods, FIG. 15 provides an exemplary display of state values corresponding to the static model results of the BHA surrogates A and B corresponding to the deflections displayed graphically in FIGS. 11B. From the static states menu tab, the menu option labeled "States" may be selected from the menu bar 1004 to provide the screen view 1120 of FIG. 15. In FIG. 15, the screen view 1120 presents four of the states relevant for the static condition and calculations, including a displacement display 1122, a tilt angle display 1123, a bending moment display 1124, and a shear force display 1125. The displays 1122-1125 present the BHA surrogate A as a solid line, while the BHA surrogate B is presented as a thicker dashed line. The BHA surrogates in the displays 1122-1125 are measured in inches (in) for displacement, degrees (deg) for tilt angle, foot-pounds (ft-lb) for bending moment, and pounds (lb) for shear force, and these values are plotted as a function of distance from the drill bit in feet (ft). If the modeling program units are specified in metric or other units, these values may be displayed in the respective units. Additionally or alternatively, the displays may be normalized as discussed above to be dimensionless. The three vertical slider bars 1126, 1127, and 1128 are used to zoom in to a specific range along the vertical axes of the graphs. Slider bars 1126-1128 may be selective for a single display (e.g., the "current" set of axes) or may control multiple displays having a common vertical axis.

Figure 16:
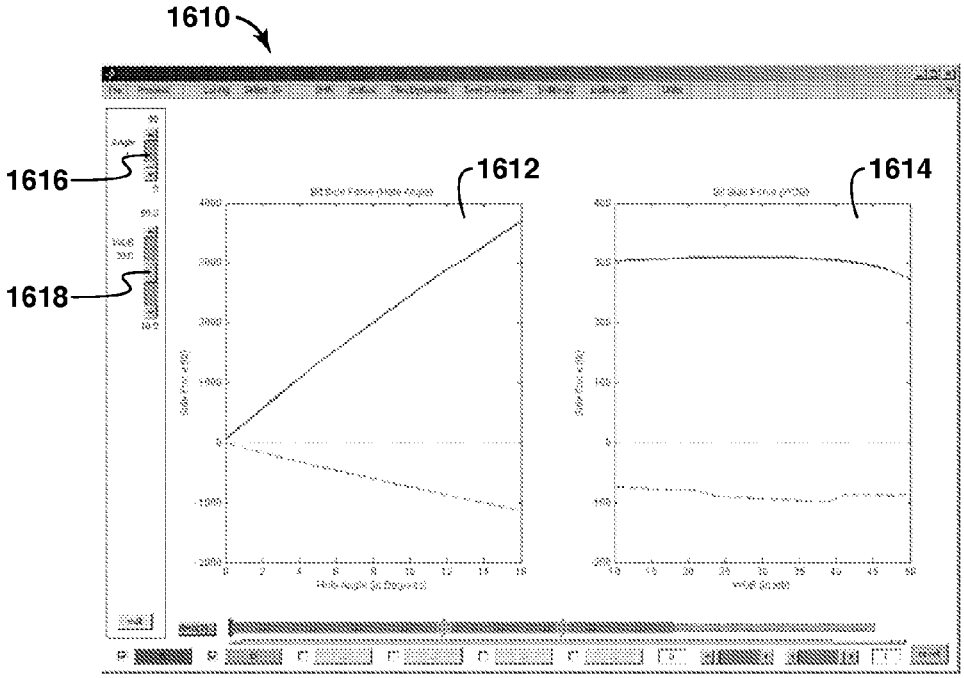
FIG. 16 provides an exemplary screen view provided by a modeling system.

In some implementations of the present methods and systems, it may be determined that the static sideforce values at the bit (distance to bit equals zero) are useful values. For example, a negative bit sideforce tends to drop the inclination angle while a positive bit sideforce tends to build the inclination angle. For instance, the BHA surrogate B has a small negative bit sideforce, which tends to drop the inclination angle, and the BHA surrogate A has a larger positive value, which tends to build the inclination angle. FIG. 16 illustrates an exemplary output display 1610 to facilitate the comparison and analysis of one or more BHA surrogates and corresponding bit sideforce values. FIG. 16 provides a hole angle plot 1612 and a weight on bit plot 1614. Additionally, the screen view 1610 of FIG. 16 includes virtual slider bars 1616 and 1618 configured to allow the user to select a baseline hole angle and a baseline weight on bit. The baseline weight on bit from slider 1618 is used as the current and constant weight on bit in calculations to generate the hole angle plot 1612; the baseline hole angle from slider 1616 is used as the current and constant hole angle in calculations to generate the weight on bit plot 1614.

In the hole angle plot 1612 of FIG. 16, the side force at the bit is plotted for two BHA surrogates as a function of hole angle, for the reference bit weight of 30 klbs as indicated in the slider bar 1618. A positive sideforce indicates a building tendency, and a negative value suggests a dropping tendency. The dashed line shows an increasingly negative side force as the inclination angle increases. This is a stabilizing influence for a dropping assembly and is desired when drilling a vertical hole. The building BHA (solid line) has an increasingly positive side force which indicates that it will tend to continue to build hole angle. The weight on bit plot 1614 of FIG. 16 shows the change in bit sideforce as weight-on-bit (WOB) varies at the hole angle shown on the slider bar 1616 of 1 degree. These lines are relatively flat suggesting little variation in directional tendency with WOB changes. Displays such as those in FIG. 16 provide the capability to assess the relative directional stability of proposed BHA designs.

In addition to the static calculations and analysis, dynamic calculations may also be performed as described at length above. For instance, two types of dynamic calculations may be referred to as the "flex" mode for flexural dynamic bending in the lateral plane and the "twirl" mode for whirling motion resulting from eccentric mass effects. Other examples are described in more detail above. These different dynamic calculations may be options provided on the menu bar 1002 that can be invoked with the "Flex Dynamics" and "Twirl Dynamics" menu tabs, respectively. Additionally or alternatively, the dynamic calculations and/or the display of results from the calculations may be invoked from a graphics control panel, such as described above.

Figure 17:
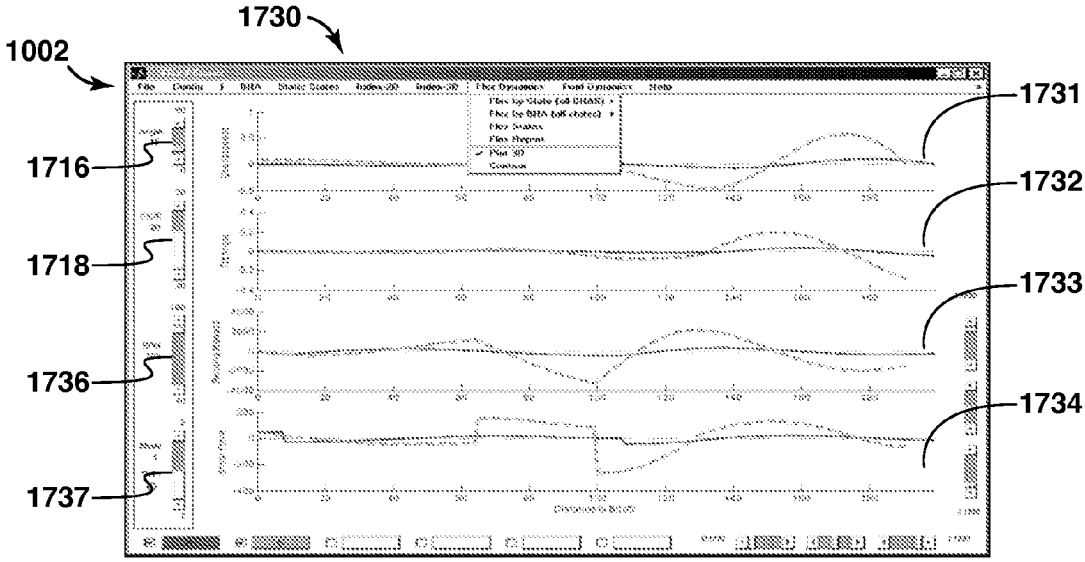
FIG. 17 provides an exemplary screen view provided by a modeling system.

As an example, FIG. 17 is an exemplary screen view 1730 of graphical displays 1731-1734 based on the flex lateral bending mode calculations in the flex dynamics mode. Screen view 1730 is obtained by selecting "Flex Dynamics—Flex States" from the menu 1002. These graphical displays are a displacement display 1731, a tilt angle display 1732, a bending moment display 1733, and a shear force display 1734. The displays 1731-1734 present the BHA surrogate A as a solid line, while the BHA surrogate B is presented as a thicker dashed line. The BHA surrogates in the displays 1731-1734 are calculated in inches (in) for displacement, degrees (deg) for tilt angle, foot-pounds (ft-lb) for bending moment, and pounds (lb) for shear force verses distance from the drill bit in feet (ft). However, the units are not displayed because these values are calculated for an arbitrary reference excitation input and are relative values in this sense. The dynamic model results have meaning on a comparative basis.

More generally, the absolute values and corresponding units in the dynamic modes are not of significance because the objective of these calculations is to determine the relative quantitative values comparing two or more BHA designs. Thus, for the same excitation input, the relative response is to be determined for each BHA surrogate. In FIG. 17, the dashed lines respond with higher amplitude than the solid line, and thus, for these conditions (e.g. 12 degrees of angle, 20 klb WOB, 100 RPM, and an excitation mode of one times the rotary speed), the BHA surrogate B has a tendency to vibrate more in response to excitation at the bit than the BHA surrogate A. As discussed above, the models may also be normalized to provide relative charts that plot the results relative to a baseline BHA surrogate and/or relative to the other BHA surrogates being modeled. In implementations where a single BHA surrogate is being analyzed and is not being compared to a reference baseline BHA surrogate, the numeric values and corresponding results may be displayed for the user's reference in considering the benefits and weaknesses of a particular BHA configuration. Used this way, the tendency for the excitation at the bit to amplify the vibrations proceeding uphole away from the bit can be examined without reference to other surrogate BHA designs.

To adjust the displays 1731-1734, virtual slider bars, such as hole inclination slider bar 1716, WOB slider bar 1718, RPM slider bar 1736, and excitation mode slider bar 1737, may be utilized to adjust the operating parameters for the flex mode dynamic state calculations. For instance, as shown in FIG. 17, the parameter values for the slider bars 1716, 1718, 1736 and 1737 are indicated by the values associated with the respective slider bars 1716, 1718, 1736 and 1737 (e.g., angle is 12°, WOB is 20 klbs, RPM is 100, and Mode is 1). The state vector responses (e.g., the lines on the graphical displays 1731-1734) are calculated for this set of operating parameters. Accordingly, if a comparative analysis for a different set of parameter values is desired, the slider bars 1716, 1718, 1736 and 1737 are used to adjust the parameters to another set of values to be modeled. The state vector responses may be recalculated and displayed for all the selected BHA surrogates.

Figure 18A:
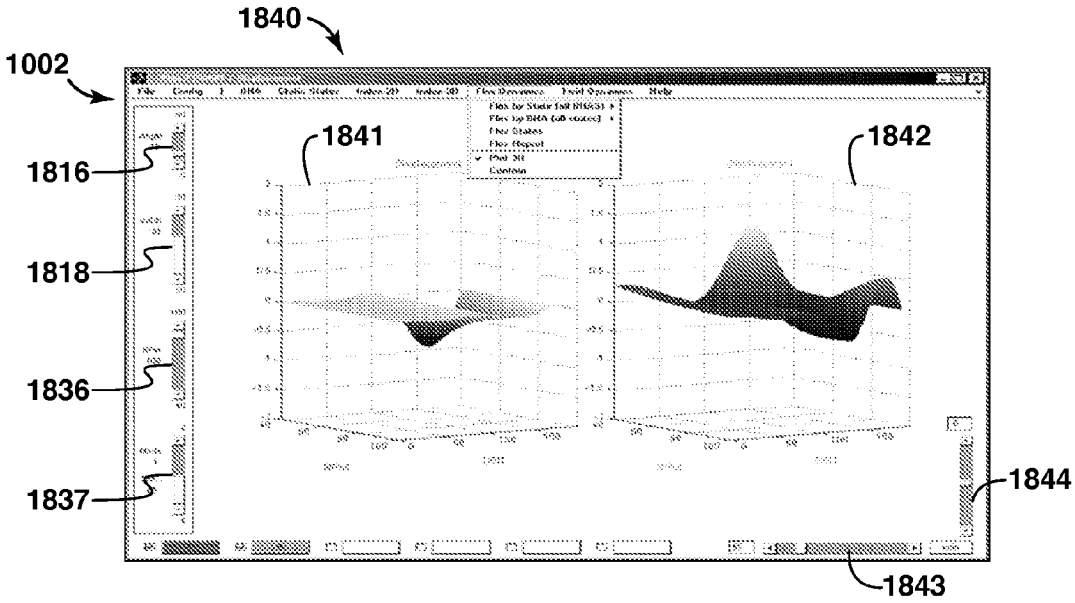
FIGS. 18A-18B are exemplary screen views provided by a modeling system.
Figure 18B:
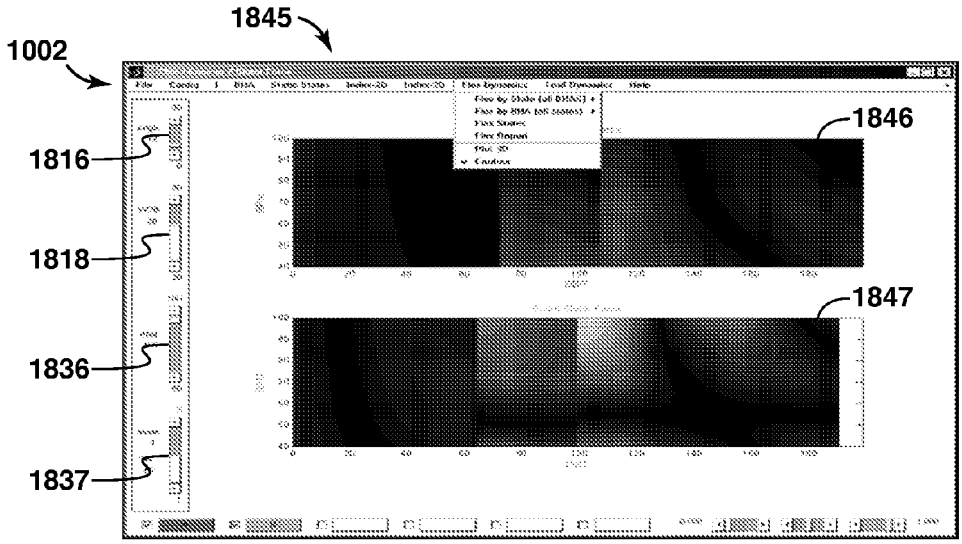

In addition to the 2-dimensional (2D) displays, the respective values or parameters may be used to generate 3-dimensional (3D) displays, such as shown in FIGS. 18A and 18B. For example, FIG. 18A is an exemplary screen view 1840 of a 3D representation of the flex dynamics mode calculations that is obtained by checking the "Plot 3D" option on the menu bar 1002. In this screen view 1840, the graphical display 1841 is of the BHA surrogate A and the graphical display 1842 is of the BHA surrogate B. Each of the displays 1841 and 1842 present a 3D representation of the RPM ranges from the specified minimum to maximum values of parameters (e.g., angle is 12°, WOB is 20 klbs, and excitation mode is 1). For each of these selections, the state values plotted are selected from the list of displacement, tilt angle, bending moment, and shear force, selected from the menu that appears when "Flex Dynamics—Flex by State (all BHAS)" is chosen. The state variables are plotted versus distance from the bit, at the specific WOB, and with varying RPM. The axes of the displays 1841 and 1842 may be rotated in the same or identical manner for proper perspective. Further, the virtual slider bars, such as horizontal virtual slider bar 1843 and vertical virtual slider bar 1844, may be utilized to rotate the images for alternative perspectives. This is useful to visualize null response regions for which the vibrations are predicted to be low within an RPM range along the entire length of BHA.

FIG. 18B is an exemplary screen view 1845 of a 3D contour plot representation of the BHA surrogates in the flex dynamics mode, obtained by checking the "Contours" option from the flex dynamics menu option and then selecting the appropriate state variable to display. In this screen view 1845, the graphical display 1846 is of the BHA surrogate A and the graphical display 1847 is of the BHA surrogate B. The data utilized to provide these displays 1846 and 1847 is the same data utilized in displays 1841 and 1842 of FIG. 18A. In this screen view 1845, the contour shading for each of the displays 1846 and 1847 may be set to be identical so that the highest values are readily apparent by a visual inspection. The contour displays 1846 and 1847 present the state variable response amplitudes as a function of distance from the drill bit in feet on the x-axis versus rotary speed in RPM on the y-axis for the BHA surrogates A and B at the respective parameters. Alternatively, the axes may be swapped if desired.

Figure 19A:
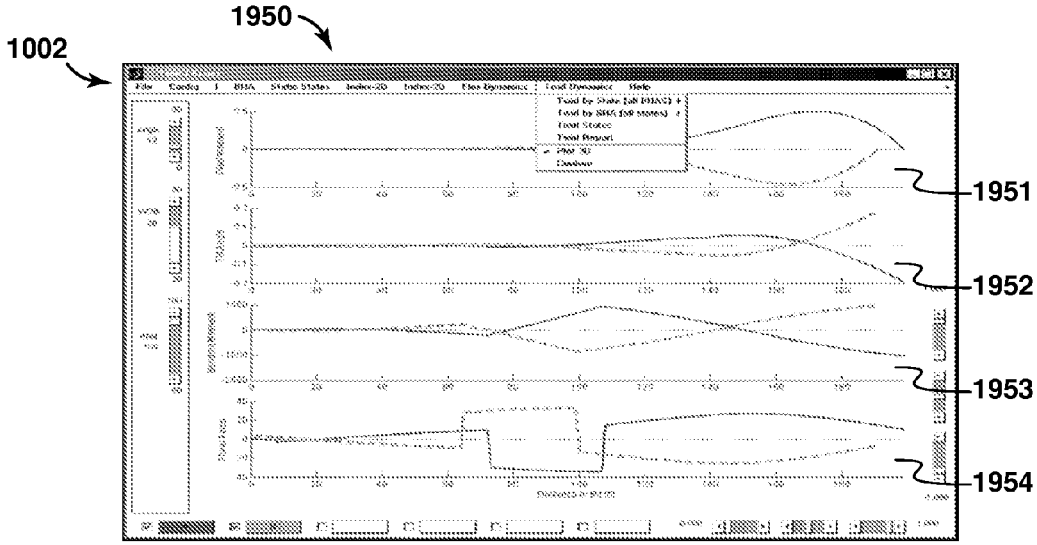
FIGS. 19A-19C are exemplary screen views provided by a modeling system.
Figure 19B:
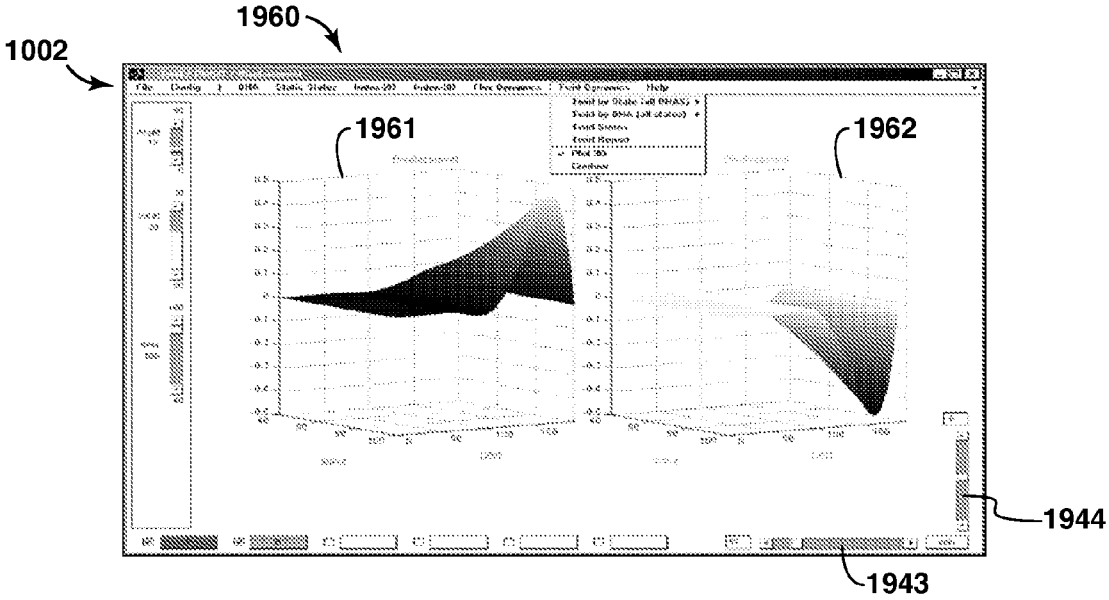
Figure 19C:
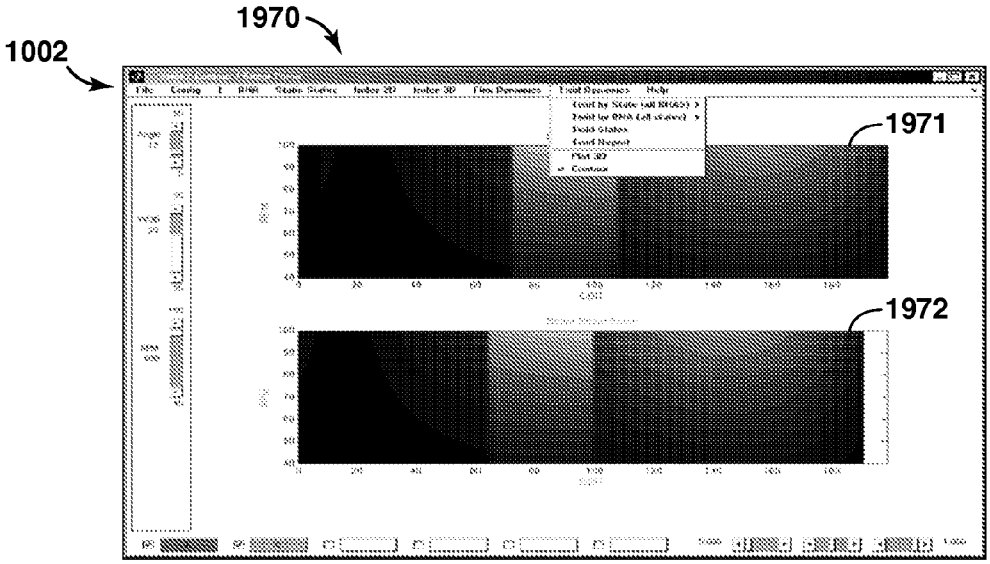

In addition to the flex dynamics mode calculations, twirl mode calculations may also be provided to assess the sensitivity of the BHA surrogate to eccentric mass effects, as shown in FIGS. 19A-19C. Because the twirl calculations apply to the eccentric mass loading conditions, which is synchronous with the rotary speed (i.e., occur only at one times the rotary speed), the FIGS. 19A-19C do not include excitation mode parameters. As one specific example of the twirl calculations, FIG. 19A is an exemplary screen view 1950 of graphical displays 1951-1954 based on the twirl dynamics mode, obtained by selecting the "Twirl Dynamics—Twirl States" menu tab on the menu bar 1002. In this screen view 1950, the graphical displays are a displacement display 1951, a tilt angle display 1952, a bending moment display 1953, and a shear force display 1954. The displays 1951-1954 present the BHA surrogate A as a solid line, while the BHA surrogate B is presented as a thicker dashed line. The discussion regarding units for FIG. 17 is similar to discussion of FIG. 19A and not repeated here.

FIG. 19B is an exemplary screen view 1960 of a 3D representation of the BHA surrogates in the twirl mode by checking the "Plot 3D" menu option from the twirl dynamics menu tab and then choosing this display. In this screen view 1960, the graphical display 1961 is of the BHA surrogate A and the graphical display 1962 is of the BHA surrogate B. Each of the displays 1961 and 1962 present a 3D representation of the RPM ranges from the specified minimum to maximum values (e.g., 40 to 100 RPM) for the BHA response along the length of the assembly, for the illustrated parametric values (e.g., inclination angle is 12° and WOB is 20 klbs). Just as in the example of FIG. 18A, the state values plotted are chosen from the list of displacement, tilt angle, bending moment, and shear force when the menu selection "Twirl Dynamics—Twirl by States (all BHAS)" is chosen. The axes of the displays 1961 and 1962 may be rotated in the same or identical manner for proper perspective. Further, the virtual slider bars, such as horizontal virtual slider bar 1943 and vertical virtual slider bar 1944, may be utilized to rotate the images in the displays 1961 and 1962 for alternative perspectives in a manner similar to the discussions above of FIG. 18A.

FIG. 19C is an exemplary screen view 1970 of a 3D representation of the BHA surrogates in the twirl dynamics mode, obtained by checking the "Contours" tab menu option from the twirl dynamics menu tab, selecting the display "Twirl Dynamics—Twirl by States (all BHAS)," and choosing the state to view. In this screen view 1970, the graphical display 1971 is of the BHA surrogate A and the graphical display 1972 is of the BHA surrogate B. The data utilized to provide these displays 1971 and 1972 is the same data utilized in displays 1961 and 1962 of FIG. 19B. In this screen view 1970, the contour shading is again set to be identical so that the highest values are readily apparent by a visual inspection. The contour displays 1971 and 1972 present the state variable response amplitudes as a function of distance from the drill bit in feet on the x-axis versus rotary speed in RPM on the y-axis for the BHA surrogates A and B at the illustrated parameter values. Alternatively, the axes may be swapped if desired.

Figure 20A:
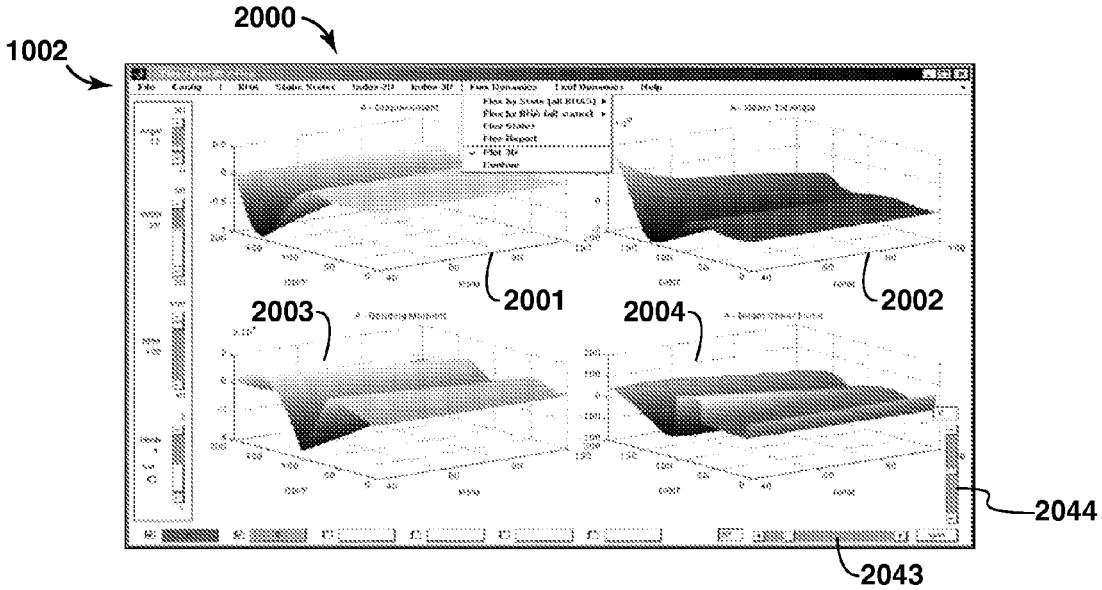
FIGS. 20A-20B are exemplary screen views provided by a modeling system.

To display all states for a single BHA surrogate, the menu option "Flex Dynamics—Flex by BHA (all states)" may be selected from the menu bar 1002, followed by selection of the specific BHA from a menu list. With "Plot 3D" selected, the screen view 2000 of FIG. 20A is generated for the flex mode. Checking the "Contours" menu option and selecting this output will generate screen view 2010 of FIG. 20B. In like manner, the corresponding 3D representations for the twirl mode may also be obtained.

In more detail, FIG. 20A is an exemplary screen view 2000 of a 3D representation of the BHA surrogate A for the flex dynamics mode. In this screen view 2000, the 3D graphical displays are a displacement display 2001, a tilt angle display 2002, a bending moment display 2003, and a shear force display 2004. Each of the displays 2001-2004 present a 3D representation of the states as functions of RPM and distance to the drill bit, for the respective parameter values of hole angle, WOB, and excitation mode. Note that the mode is not applicable to the twirl case. Accordingly, the displays 2001-2004 may be utilized to locate beneficial operating regions (e.g., operating parameter settings that reduce vibrations) for the candidate BHA surrogates and to examine the relationships between the state variables for a given BHA surrogate. Further, the virtual slider bars, such as horizontal virtual slider bar 2043 and vertical virtual slider bar 2044, may be utilized to rotate the images for alternative perspectives, as described above.

Figure 20B:
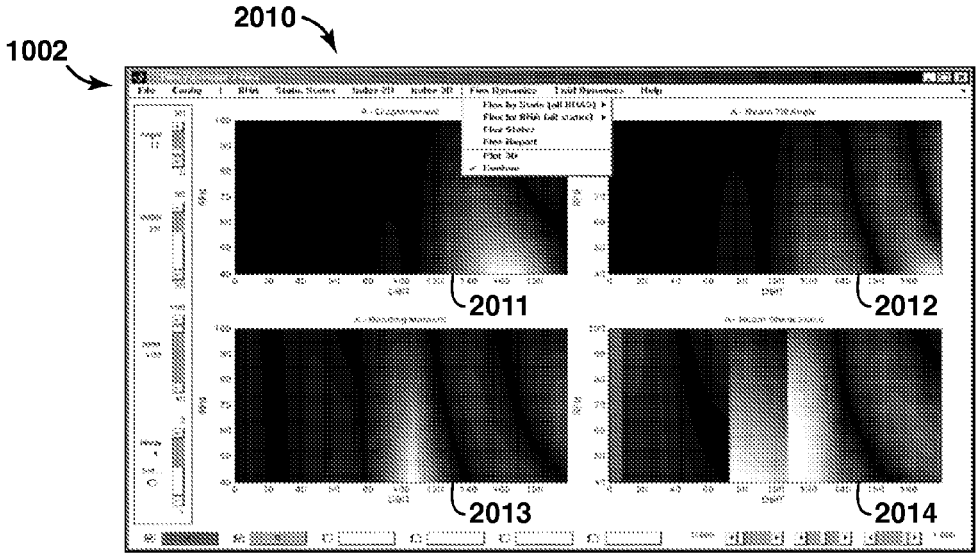

FIG. 20B is an exemplary screen view 2010 of a contour map representation for the selected BHA surrogate in the flex or twirl dynamics mode, as appropriate. This display is obtained by checking the "Contours" option on the menu bar 1002 and then selecting the appropriate menu item for the flex and twirl modes. In this screen view 2010, the 3D graphical displays are a displacement display 2011, a tilt angle display 2012, a bending moment display 2013, and a shear force display 2014. Each of the displays 2011-2014 may be based on the same data utilized in displays 2001-2004 of FIG. 20A.

Figure 21A:
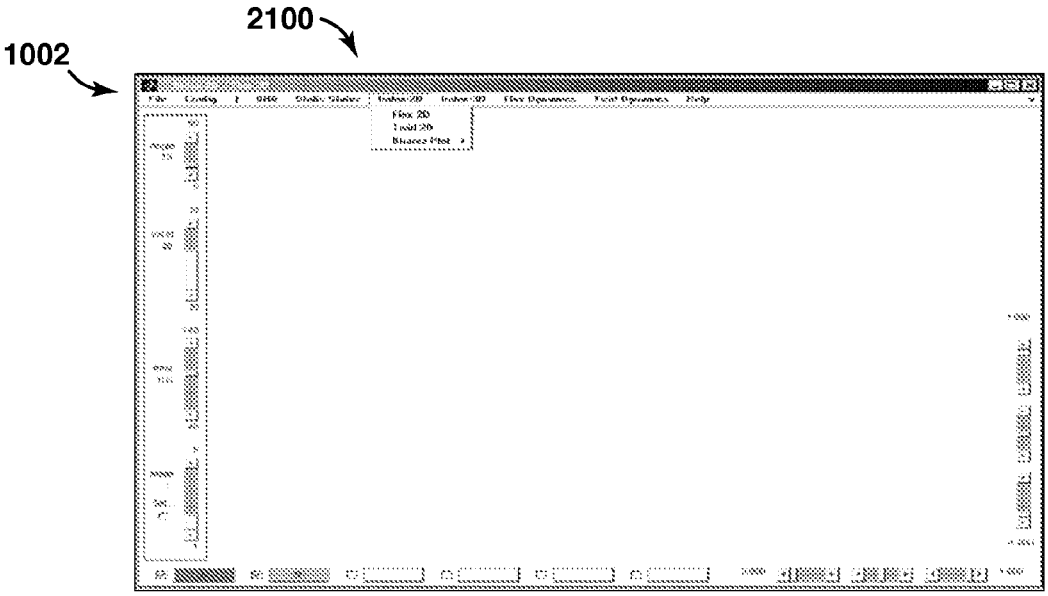
FIGS. 21A-21E are exemplary screen views provided by a modeling system.
Figure 21B:
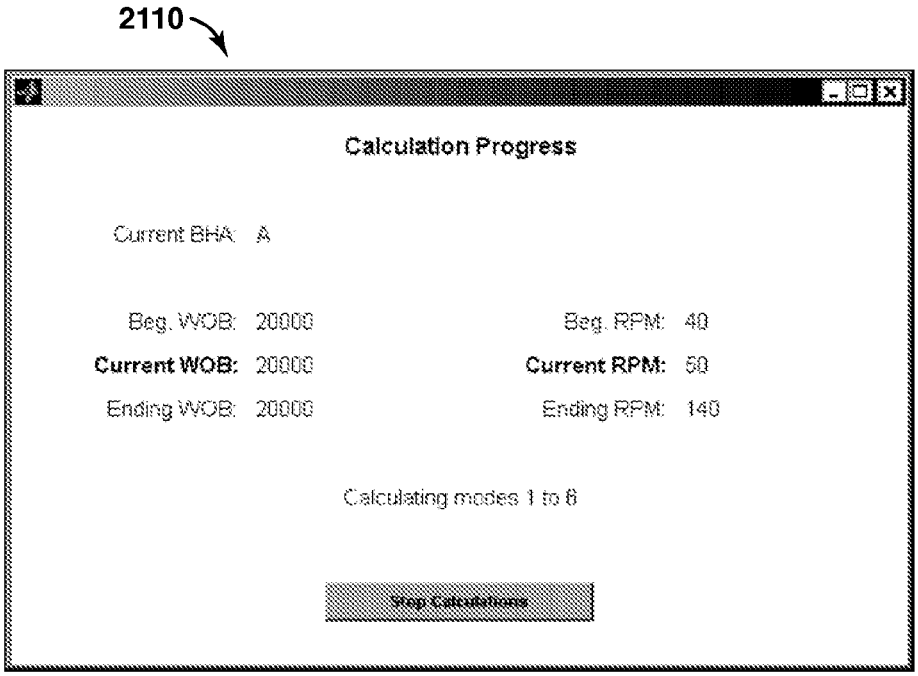

Selection of the "Index 2D" menu tab on the menu bar 1002 provides the additional menu options "Flex 2D," "Twirl 2D," and "Bharez Plot," as illustrated in screen view 2100 of FIG. 21A. Selection of one of these menu options may cause the information panel 2110 illustrated in FIG. 21B to be displayed while the index calculations are performed (typically no more than a few minutes). A similar information panel may be presented during the calculations associated with any of the methods, systems, and displays described herein. The calculations or simulations are performed for the inclination angle and WOB indicated, for the specified RPM range and excitation mode range requested, for each of the selected BHA configurations. After each simulation run for a given parameter set, the results are saved in memory and may be utilized to calculate the dynamic vibration performance or the indices as described above. When the calculations have been completed, FIG. 21B is closed and the vibration performance index results for the flex mode lateral bending output is provided by default, as seen in display 2120 of FIG. 21C. The menu options of "Flex 2D" and "Twirl 2D" may be subsequently used to display these results, and the "Bharez Plot" menu option may be used to display only the end-point curvature index value for a single BHA surrogate for compatibility with a prior modeling program. In an alternate implementation, the graphics control panel 1312 of FIG. 13 provides a similar capability to select model calculations and display the status of the simulation process.

Figure 21C:
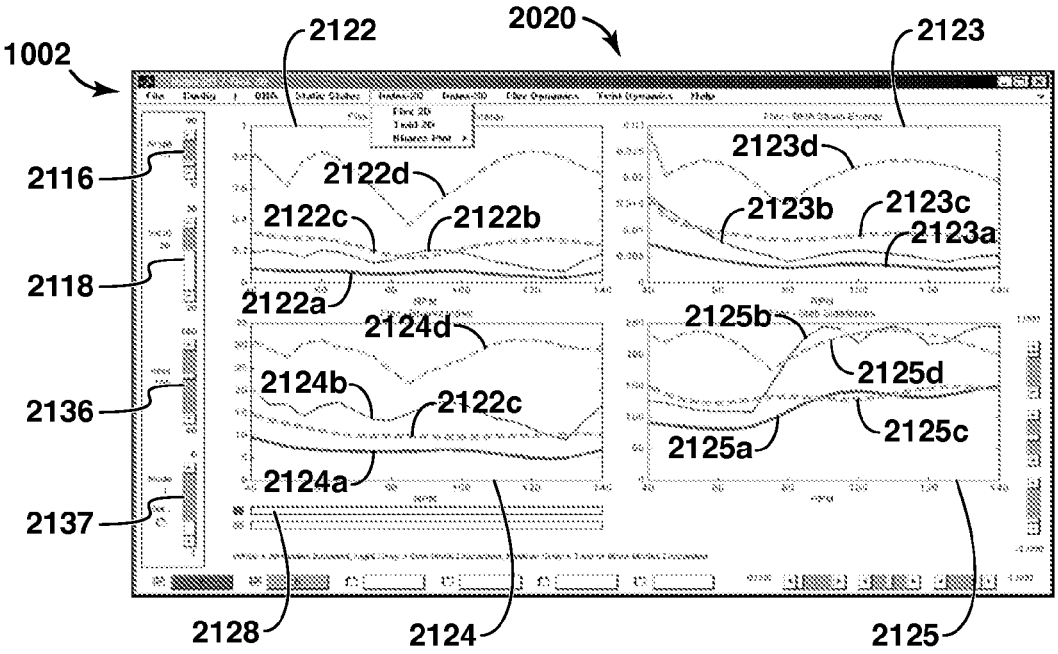

Once the calculations are completed, vibration index results or responses as a function of rotary speed are presented in a screen view 2120 of FIG. 21C. In this screen view 2120, four vibration performance indices 2122-2125 are shown against values of RPM for a fixed WOB of 20 klbs and using modes up to 6. Referring back to the index calculations discussed above, the vibration index response 2122 corresponds to the RMS Transmitted Strain Energy Index values; vibration index response 2123 represents results for the BHA Strain Energy Index values; vibration index response 2124 corresponds to the RMS End-Point Curvature Index values; and finally vibration index response 2125 represents the RMS BHA Stabilizer Sideforce Index values or, alternatively, one of the BHA Dynamic Torque Index values. In these displays, the lines 2122*a*, 2122*b*, 2123*a*, 2123*b*, 2124*a*, 2124*b*, 2125*a* and 2125*b* correspond to results for BHA surrogate A, and the lines 2122*c*, 2122*d*, 2123*c*, 2123*d*, 2124*c*, 2124*d*, 2125*c* and 2125*d* indicate results for BHA surrogate B. Furthermore, the heavier lines ("a" and "c") are the RMS values averaged over the various excitation mode and end-length calculations for the flex mode (recall that the twirl mode is only calculated for the excitation mode of one times the rotary speed), and the thinner lines ("b" and "d") indicate the "worst case" maximum index results. If the excitation is self-sustained at the worst case condition, then this value is a measure of how detrimental that condition may be to the BHA. In these charts 2122-2125, it may be noted that results for the BHA surrogate A are generally lower than those for the BHA surrogate B. Thus, it is expected that BHA surrogate A should exhibit lower vibrational response than BHA surrogate B because the response for BHA A is lower than that for BHA B for the similar bit excitation conditions (i.e., the same applied dynamic bit loads and excitation modes).

The set of horizontal bars 2128 in FIG. 21C are a diagnostic aid to examine if any numerical convergence difficulties have been encountered for any of the excitation modes. The tag, which may be colored, to the left of the bars 2128 indicates which BHA the respective bars 2128 represent. If the bar is all white (as shown in this example), then all of the requested modes processed to completion successfully. If shaded light gray, then one mode (generally the highest excitation mode level) failed to converge and the non-converged mode is omitted from the results. If shaded dark gray, then two or more modes were omitted, and the user is thereby warned that some investigation is necessary to modify parameters to restore convergence.

For flex dynamics mode calculations, the RMS and maximum values are based on the various combinations of modes and end-lengths, but for twirl dynamics calculations the RMS and maximum values are based on the various end-lengths only. The resulting index values for a range of rotary speeds of the graphical displays 2122-2125 indicate the operating conditions, and through visual inspection provide the specific efficient operating range or "sweet spot" of the BHA surrogates. This efficient operating range may be found as an interval of 5-10 RPM (or more) for which the response is close to a minimum. Some examples present stronger minimum response tendencies than others. In this example, the BHA surrogate A is preferred to BHA surrogate B across the full RPM range. If BHA surrogate B is used, there may be a preferred region around 80 RPM where the RMS Transmitted Strain Energy index 2122*c* curve has a slight dip.

Figure 21D:
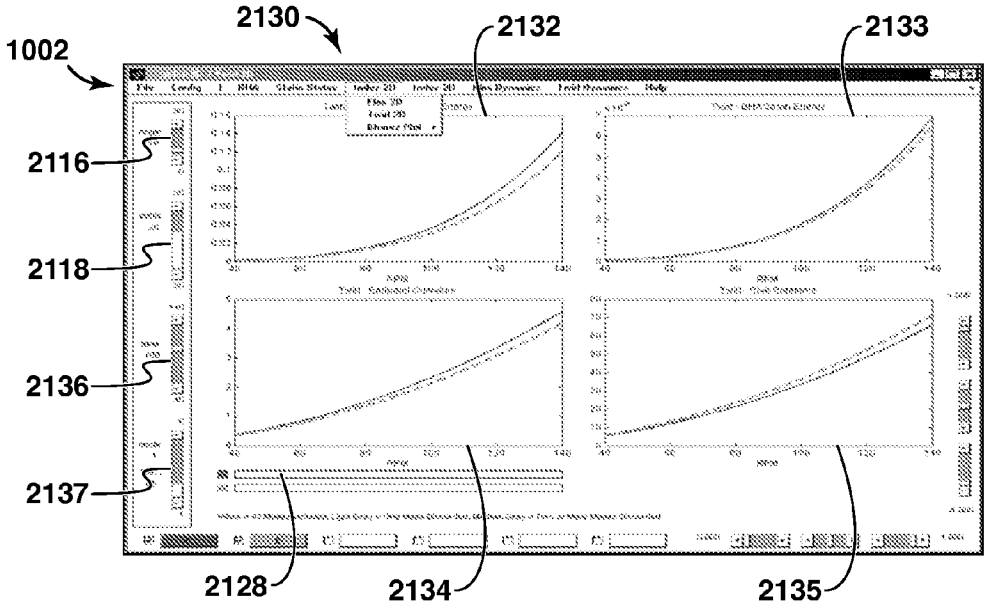

The results for the twirl mode calculations are displayed in screen view 2130 of FIG. 21D for which the corresponding index calculations are shown. In screen view 2130, the vibration index response 2132 corresponds to the RMS Transmitted Strain Energy Index values; vibration index response 2133 illustrates the BHA Strain Energy Index values; vibration index response 2134 corresponds to the RMS End-Point Curvature Index values; and finally vibration index response 2135 refers to the RMS BHA Sideforce Index values or, alternatively, one of the BHA Dynamic Torque Index values. FIG. 21D shows the power-law behavior of the twirl response, as discussed above in connection with FIG. 14B. The matrix element for the eccentric mass includes the rotary speed squared as a direct force input as described above.

Figure 21E:
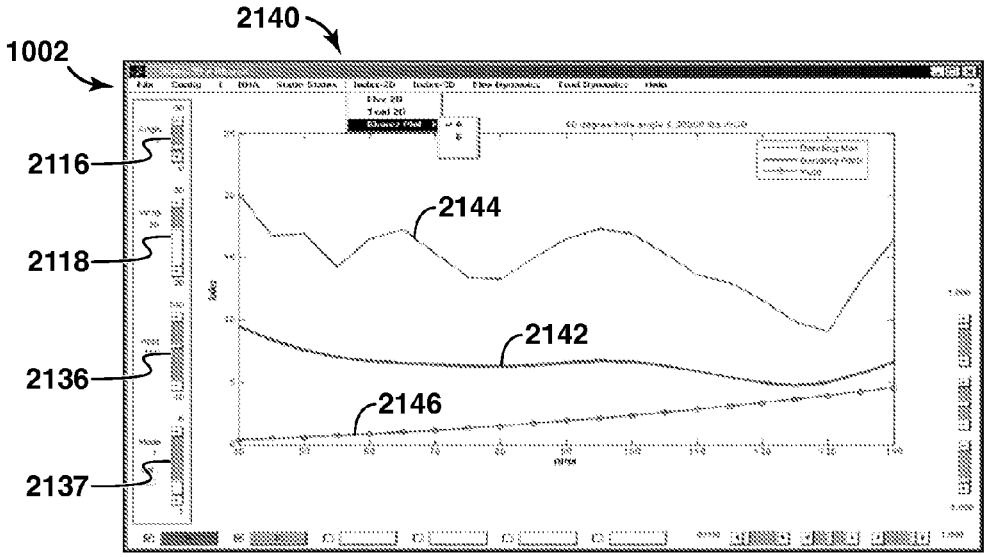

Results for specific individual BHA configuration results may be enlarged to fill the available screen area, as shown in screen view 2140 in FIG. 21E. In screen view 2140, the End-Point Curvature Index is displayed for BHA surrogate A. This was obtained by selecting the "Bharez Plot" menu option in menu bar 1002. The RMS flex mode index values are plotted as response 2142, the maximum flex mode values are represented by response 2144, and the RMS twirl values are provided in response 2146.

In addition to the lateral vibration index displays, comparable index values for other modes, such as axial and torsional vibrations, may also be provided. Accordingly, it should be appreciated that comparable displays of vibration indices may be provided to facilitate comparison of vibration tendencies among different BHA surrogates, as well as to compare the responses at different frequencies of other vibration modes. For example, this modeling program may be utilized to provide BHA surrogates having efficient operating ranges with low levels of vibration response at all modes, including flexural, twirl, whirl, axial, and torsional responses. Combination of the present techniques with other models known in the art is likely a useful extension of this technique, and such is included within the broader method disclosed herein.

As described above, the methods and systems of the present disclosure may be advantageously used in comparing two or more BHA configurations through the use of multiple BHA surrogates and the modeling and calculations described above. The foregoing description of exemplary systems included multiple examples of output displays comparing calculated results for multiple BHA surrogates. While the visual presentation of the present systems and methods are a useful and efficient means for evaluating multiple BHA configurations, the present systems and methods can be equally used to evaluate a single BHA configuration. For example, a user of the present systems and methods may run the models for a single BHA surrogate and the output values, whether numerical or graphically presented, may be compared against the user's experience and knowledgebase or against prior records, which may be built into the system as a normalization or coding routine.

Figure 22:
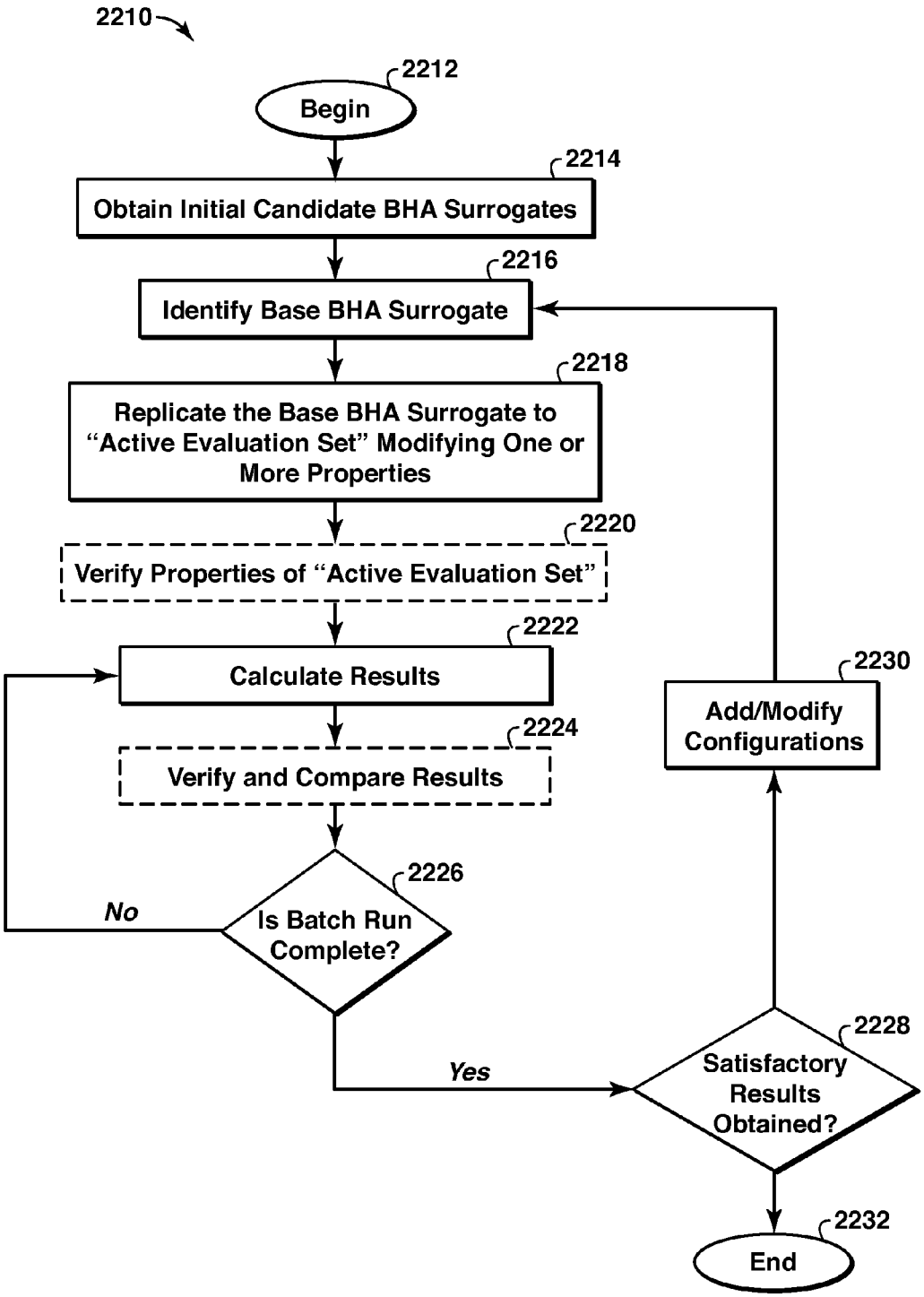
FIG. 22 provides a representative flow chart of a batch mode operation.

In implementations where multiple BHA surrogates are compared, the present systems and methods may be configured to provide the user with a batch mode operation feature. A batch mode operation may facilitate the evaluation of multiple candidate BHA surrogates. FIG. 22 provides a representative flow chart 2210 of a batch mode operation. The batch mode operation begins at 2212 in FIG. 22 and may include identifying or obtaining a plurality of candidate BHA surrogates that may be used during drilling operations, such as indicated at 2214. The initial candidate BHA surrogates may be identified based on prior experience, available drilling equipment etc. A base BHA surrogate is then identified or obtained from these candidate BHA surrogates, such as indicated at 2216. The base BHA surrogate may be saved to a file on a computer system or otherwise identified as the base BHA surrogate for future use.

Continuing with reference to FIG. 22, the batch mode method 2210 continues at 2218 by duplicating the base BHA surrogate into an Active Evaluation Set. The Active Evaluation Set includes multiple BHA surrogates based on the base BHA surrogate and being varied therefrom in any number of parameters, such as material properties, geometrical properties, length of drill collars, fishing neck length, stabilizer position, etc. The BHA surrogates in the Active Evaluation Set may also differ one from another in one or more of the operating conditions under which they will be simulated. For example, variations in the weight on bit range, rotary speed range, hole angle range, drilling mud density, depth, etc. may be made when simulating the BHA surrogates in the Active Evaluation Set. Accordingly, two BHA surrogates in the Active Evaluation Set may be configured to represent the same physical bottom hole assembly but be designated as distinct BHA surrogates in the Active Evaluation Set to enable the simulation to be conducted with the differing operating condition parameters.

In some implementations, the properties of the BHA surrogates in the Active Evaluation Set may be verified at 2220. For example, the Active Evaluation Set may be generated through user instruction and/or through pre-programmed modifications of the base BHA surrogate. In order to confirm that each of the BHA surrogates in the Active Evaluation Set are configured according to the specifications (whether from the user or from the pre-programmed instructions), appropriate function calls may be made to the modeling system for each of the BHA surrogates to generate the representation of each of the BHA surrogates for inspection. The representation may be a graphical representation, such as illustrated in FIG. 11, or a numerical representation. The verification may be conducted by visual comparison of the various BHA surrogate representations by the user. Additionally or alternatively, the computer systems of the present disclosure may be adapted to perform a visual inspection of screen captures or saved images of the graphical representations. Still additionally or alternatively, the computer systems and/or the users may compare numerical representations of the BHA surrogates in the Active Evaluation Set, such as by reviewing tables including properties and parameters of the various BHA surrogates in the Active Evaluation Set. Additionally or alternatively, some implementations of the present systems and methods may develop the Active Evaluation Set in a manner such that a verification step is not necessary or is redundant.

Once the BHA surrogates of the Active Evaluation Set are established, the results of the present methods are calculated at 2222. For example, function calls may be made to the programming of the present systems and methods to execute one or more of the simulations and/or calculations described at length above. The results may include one or more of the two-dimensional and three-dimensional state vector analysis and plots, the static state vector calculations, the BHA displacement configurations, and one or more of the various vibration performance indices such as end-point curvature index, BHA strain energy index, average transmitted strain energy index, transmitted strain energy index, RMS BHA sideforce index, RMS BHA torque index, transmissibility index, etc. The function calls and execution of these calculations can be readily reduced to a series of programming steps in virtually any available programming language for convenient execution. The results of each of the calculations and function calls may be captured or otherwise saved to memory as screenshots or suitable image files directly from the software.

Some implementations may include the optional step of verifying and/or comparing the results for each of the BHA surrogates in the Active Evaluation Set, shown at 2224 in FIG. 22. For example, the current iteration of the batch mode operation may be compared against the prior iteration to confirm that the results are within expectations. As another example, the results for a given BHA surrogate may be evaluated to verify that the calculations and simulations converged.

FIG. 22 further illustrates that after results are calculated and optionally verified for a given BHA surrogate in the Active Evaluation Set, the program checks to determine whether all of the BHA surrogates in the Active Evaluation Set have been considered, as illustrated at 2226. If there are BHA surrogates remaining, the process returns to the calculate results step 2222 to calculate the results for another BHA surrogate. When the BHA surrogates of the Active Evaluation Set have all been considered, the batch operation process determines whether satisfactory results have been obtained, at 2228 in FIG. 22.

The graphical and/or numerical results from the calculations for the various BHA surrogates may be evaluated by a user to determine whether one or more of the results are satisfactory. Additionally or alternatively, the system may be adapted to evaluate the results from the batch mode operation. For example, the results may be evaluated to determine whether at least one of the BHA surrogates in the Active Evaluation Set indicates satisfactory vibration performance. In the event that the results are deemed unsatisfactory, a subset of the BHA surrogates may be re-run through the batch operation process to further evaluate the BHA surrogate with or without additional variations in the BHA configuration and/or the operating conditions. Additionally or alternatively, additional BHA configurations may be identified for use as the base BHA surrogate, such as indicated at 2230 in FIG. 22, and the process repeated. When satisfactory results are obtained from the batch mode operation, the process ends at 2232.

As suggested by the foregoing description of the batch mode operation, the present systems and methods can be set up to evaluate multiple BHA surrogates with minimal user interaction. Additionally or alternatively, the system may be configured to progress through the batch mode operation and present the numerous calculations and results to the user in a user-friendly interface, for example, using an interface that simultaneously presents the results for two or more BHA surrogates. Additionally or alternatively, the interface may have the results calculated and prepared in a manner that allows the user to conveniently scroll through the results without the time delay of the underlying calculations.

Measured Data and Vibration Performance Indices

Figures 23A, 23B:
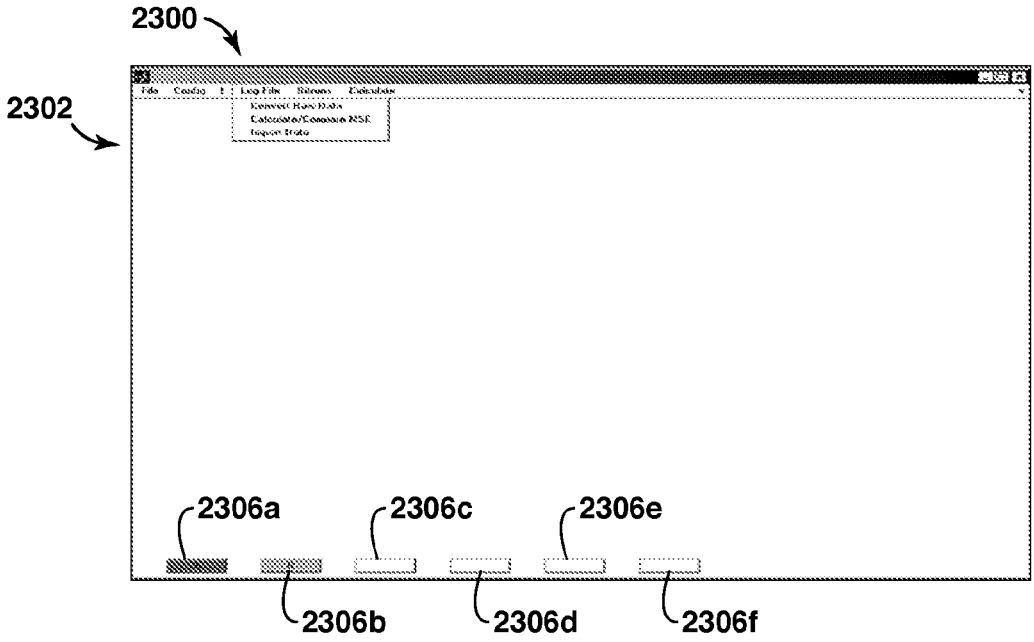
FIGS. 23A-23D are exemplary screen views provided by a modeling system.

The second application method, the "Log Mode," may be accessed from the screen view 900 by selecting the second virtual button 904 of FIG. 9. If the log mode is selected, a screen view 900 of a blank panel is presented, as shown in FIG. 23A. The menu tabs in the menu bar 2302 are a file menu tab, which is labeled "File" for printing, print setup, and exiting. The configuration menu tab, which is labeled "Config," invokes the configuration panel 1010 illustrated in FIG. 10B. As discussed above, in an alternate embodiment, the configuration information may include rate of change of inclination or azimuth angles and, more generally, wellbore survey data to evaluate drilling dynamic response for varying wellbore geometry. Menu 2302 includes: a "Log File" menu option to setup an input dataset from field operational data inputs such as that illustrated in FIG. 23B and as discussed below; a menu tab labeled "Bitruns" to invoke a panel to define BHA depth in and depth out, as shown in FIG. 23C; and a calculate menu tab, which is labeled "Calculate."

Also shown in this screen view 2300, virtual buttons 2306*a*-2306*f* may be utilized to access the different BHA surrogates, which is similar to the discussion above. In this example, two BHA surrogates, which are "A" associated with virtual button 2306*a* and "B" associated with virtual button 2306*b* are configured, while virtual buttons 2306*c*-2306*f* do not have BHA surrogates associated with them. These buttons perform the identical function as buttons 1006*a-f* of FIG. 10A.

To import log data, an input file is selected using the Log File menu tab to obtain the preformatted data. As shown in FIG. 23B, a screen view 2310 presents the log data sorted into various columns of text boxes 2312. In particular, for this example, the log data is sorted into columns of depth, WOB, RPM, ROP, and MSE text boxes. The data in these different text boxes may be organized in a specific file format, such as Microsoft Excel™. The log data may include a sequential index (depth or time), WOB, and RPM in preferred embodiments. In addition, in this screen view 2310, additional data, such as ROP (drilling rate) and Mechanical Specific Energy (MSE), are also provided. After the modeling program obtains the preformatted data, the variables (e.g., WOB, RPM, ROP, MSE, etc.) may be plotted versus depth. However it should be noted that in different implementations, different data sets of log data may be available for comparison with predicted values. For instance, the other data sets may include downhole or surface measurements of vibrations, formation or rock property data, well log data, mud log data, as well as any other parameter that is provided as a function of depth and/or time. In the preferred embodiment, the menu tabs may include menu options that access processes to directly convert raw field data from one of the vendor-supplied formats to a compatible format, calculate the MSE data from the raw inputs and compare with the MSE data generated in the field, and import a dataset that has been converted from field data to a format similar to 2310 for entry into the subject modeling program.

Figure 23C:
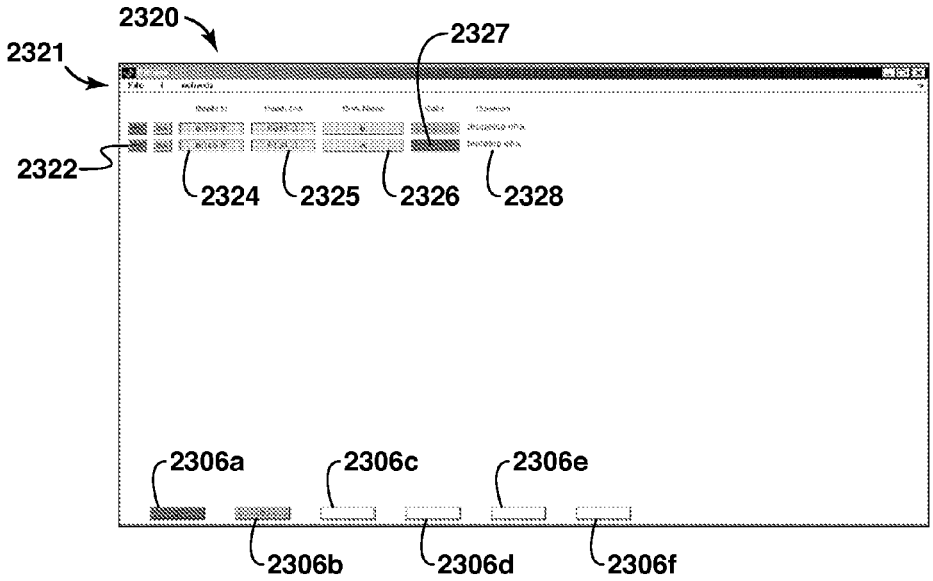

Then, the "Bitruns" menu tab of menu bar 2302 may be selected to associate the imported log data with a BHA surrogate for each depth interval, as shown in FIG. 23C. In FIG. 23C, a screen view 2320 of the "Bitruns" data panel is provided. The screen view 2320 may include a menu bar 2321 along with virtual buttons 2306*a*-2306*f*, which open BHA description panels similar to those discussed above in FIGS. 10C and 10D. Accordingly, by using these virtual buttons, each of the BHA surrogates may be viewed, updated, or created.

Screen view 2320 includes virtual buttons to add and delete bitrun line entries, such as insert virtual buttons 2322 labeled "ins" and delete virtual buttons 2323 labeled "del." The virtual buttons 2322 and 2323 provide a mechanism to modify the bitrun depth intervals, the assignment of BHA layout configurations to specific depth intervals, and otherwise control the calculations that will be conducted in the next processing step. For example, the depth range text boxes, such as depth in text boxes 2324 labeled "Depth In" and depth out text boxes 2325 labeled "Depth Out," may be entered for each of the BHA surrogates that were run in the field so that the relevant design is associated with the corresponding field operational data measurements. Further, the screen view 2320 includes buttons 2326 to select the specific BHA surrogate for each line entry, and to illustrate the designated color (e.g., "light gray" or "dark gray") as shown in color text boxes 2327. Furthermore, screen view 2320 includes an area to display the associated comment text boxes 2328. The bitrun configuration screen view 2320 may be closed by selecting an appropriate option from the File button on the menu bar 2321 to return to the screen view 2300 of FIG. 23A.

Figure 23D:
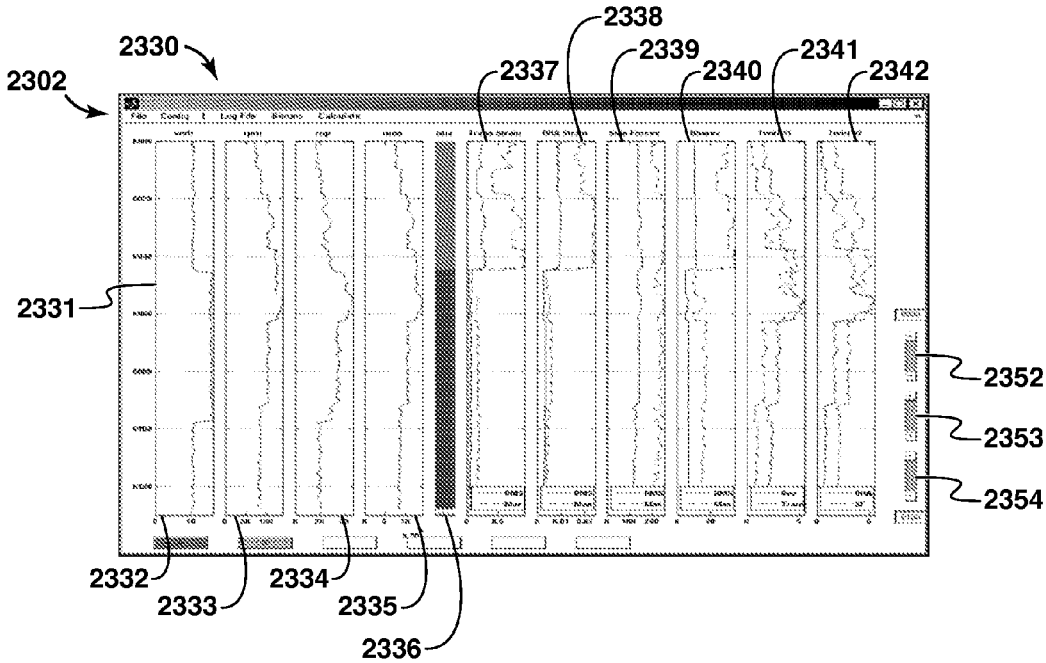

Once the bitrun is configured (i.e., the BHA surrogates are correlated to the depths at which a BHA was used that substantially corresponds to the BHA surrogate), the "Calculate" menu tab may be selected from the menu bar 2302. When the calculate menu tab is selected, the model predictions use the operating parameters from the imported log data, using the respective BHA surrogate for each interval. The resulting dynamic vibration performance indices may be displayed when the calculations have been completed or as they are generated. An example of this graphical display is provided in FIG. 23D. In FIG. 23D, a screen view 2330 presents predicted model results plotted alongside other field values, with a solid colored bar 2336 to illustrate the BHA surrogate selected for each depth interval. That is, the log-based processing provides diagnostic displays 2332-2335 of the representative operating and measured parameters (e.g., applied WOB 2332 in klbs, applied rotary speed 2333 in RPM, ROP response 2334 in ft/hour, and MSE response 2335 in units of stress). These values are plotted versus depth, which is displayed along the vertical axis 2331. The various vibration performance indices for the flexural lateral bending mode calculations are shown to the right of the BHA selection bar 2336, such as: the Transmitted Strain Energy Index 2337, the BHA Strain Energy Index 2338, the BHA Sideforce Index 2339, and the End-Point Curvature Index (i.e., "Bharez") 2340. The four corresponding index values for the twirl mode calculations are displayed in 2341 and 2342. The virtual slider bars 2352-2354 allow the depth interval in the displays to be adjusted.

Plotting the predicted results in a log format provides insight into the vibration status of the drilling assemblies and facilitates understanding of the model results versus the measured log data. Accordingly, it models conditions experienced within a wellbore that increase or decrease vibrations. In addition, the present techniques provide graphical displays of vibration levels that are reflected in changes in parameters, such as ROP, MSE, and any vibration measurements acquired in the field. Additional data provided may include well log data, formation properties, sonic travel times, lithology, any derived parameters such as formation hardness or stress values calculated from dipole sonic logs, etc. Additional vibration index predictions may also include axial, torsional and/or stick-slip vibration modes that may be provided by any conventional models known to the industry.

Beneficially, the modeling program in the log mode and methods described above may be utilized to provide greater insight into the operation of BHA assemblies within a wellbore. Indeed, experience gained with application of the modeling design tools described herein will provide information and insights regarding vibration control methods obtained via modification to BHA design practice. These learnings will be in the form of improved understanding of preferred configurations to avoid vibration generation, as well as practices regarding use of specialized drilling equipment such as under-reamers, roller reamers, rotary steerable equipment, bi-center and other types of new bits, new stabilizers, different material compositions, and other improved drilling equipment. Application of these quantitative design techniques will allow the industry to progress beyond educated guesses of BHA dynamic performance to evolve practices using comparative analysis of alternative BHA designs.

In one embodiment, this process may be utilized with flow chart 100 of FIG. 1. As a specific example, in block 112 of FIG. 1, the measured data may be compared with calculated data for a selected BHA surrogate. Then, a redesign of the BHA surrogate may be performed with one or more additional BHA surrogates. These additional BHA surrogates may include various enhancements that are tailored to address certain limiters indicated from the measured data, such as the MSE data, ROP, WOB, stick-slip, or vibrational data. Then, one of the BHA surrogates may be selected for use in drilling the well. In this manner, the limiter may be removed or reduced to increase the ROP of drilling operations.

Figure 24:
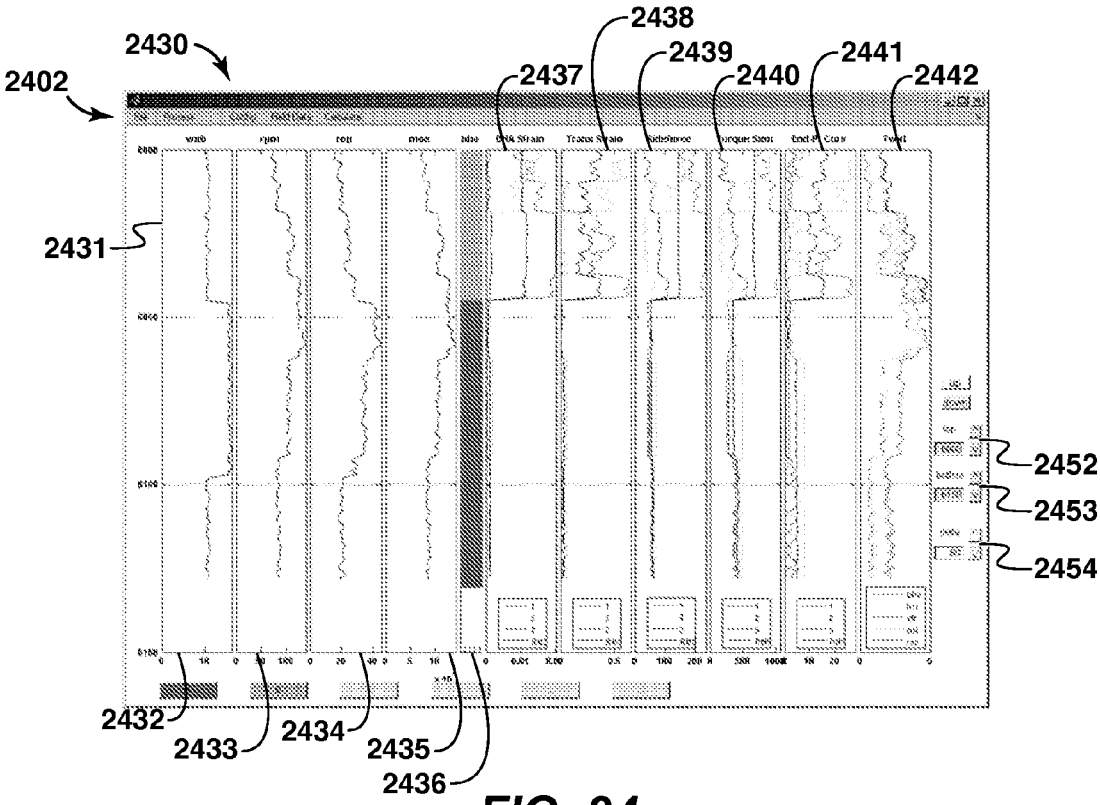
FIG. 24 provides an exemplary screen view provided by a modeling system.

As described above in connection with FIG. 12, the vibration performance indices of the present disclosure may be calculated as combined indices (e.g., RMS averages) and/or as distinct indices for each variable parameter, such as each rotary speed multiple. FIG. 24 provides an exemplary screen view 2410 of a screen view similar to FIG. 23D showing the measured data 2432-2435 in the same view as the calculated data 2437-2442 for the vibration performance indices based on the measured data. As indicated in FIG. 24 however, the calculated data in plots 2437-2442 includes multiple vibration performance indices in each of the plots, with each data set corresponding to distinct rotary speed multiples. As discussed above, the ability to view the calculated indices together with the measured data may facilitate the identification of the rotary speed multiple most directly related to the performance results of the measured data.

Figure 25:
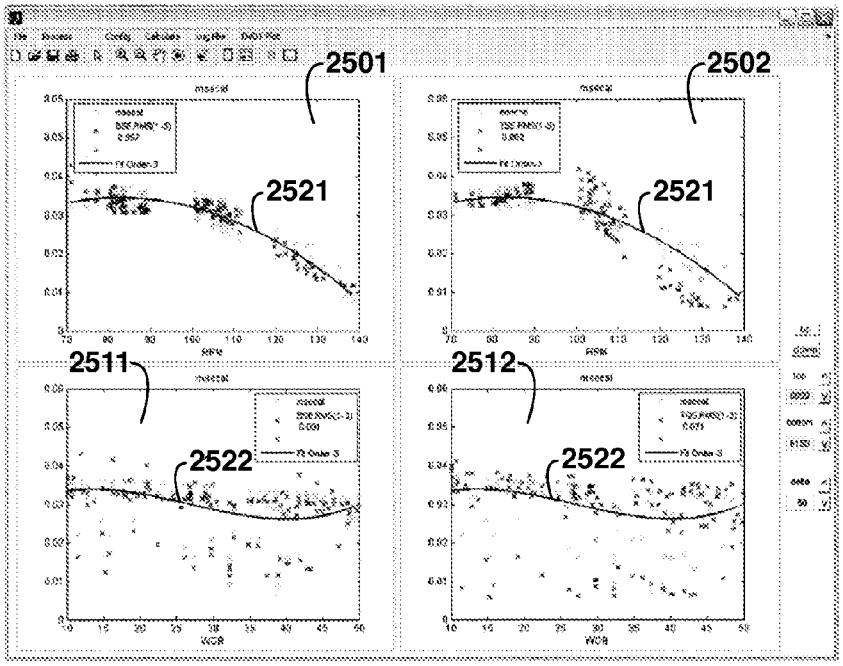
FIG. 25 provides an exemplary screen view provided by a modeling system to compare measured data with model results.

An alternative means to FIGS. 23C and 24 for the purpose of comparing measured data with model results is provided in FIG. 25. In this figure, there are optionally four quadrants of plots 2510, 2502, 2511, and 2512 to facilitate multiple comparisons on the same visual display. The plot type may be an RPM plot (2501 and 2502), WOB plot (2511 and 2512), 3-dimensional plot with WOB and RPM, actual versus predicted plot, or another plot selection. Measured drilling variables may be plotted on the vertical axis (shown as circles, typically in red), and one or more vibration performance index values may be scaled and plotted on the same axes to provide a direct comparison (shown as "x" marks, typically in black or blue). The measured data tends to scatter more than model results, so trend curves may be calculated and displayed versus RPM 2521 or WOB 2522 for visual analysis. The index values are calculated for the specific BHA model operating at the actual drilling parameters and are then scaled such that, for example, the mean value of the model data equals the mean value of the measured data. Other plot normalization procedures may also be used.

Figure 26:
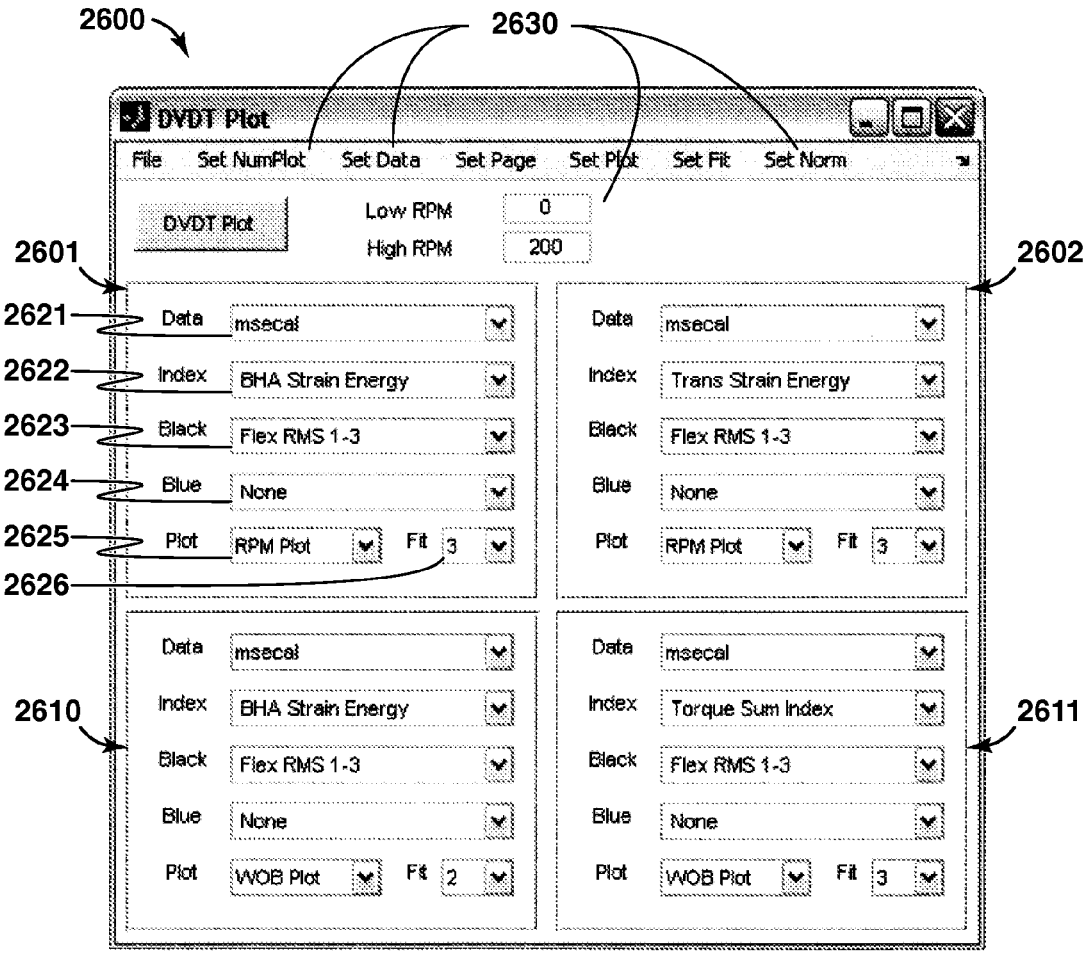
FIG. 26 provides an exemplary screen view of means to control the output in the display of FIG. 25.

As illustrated in FIG. 26, a control panel may be used to specify and customize the plots in FIG. 25. The quadrants 2601 and 2602 have RPM selected as the horizontal axis, whereas quadrants 2610 and 2611 have WOB selected as the plot axis. Referring to quadrant 2601, the upper left area, control 2621 is used to specify the drilling data to be plotted (as circles in FIG. 25), 2622 is used to select the type of vibration performance index to display, controls 2623 and 2624 determine which specific indices are shown as black and blue "x" marks in FIG. 25, control 2625 indicates the plot axis selection, and 2626 indicates the order of the polynomial fit to the data to be illustrated as the curve in the plot. The controls for the other quadrants function identically. Controls 2630 are used to set global initial values for the parameters, low and high RPM range, and other menu item features to customize the display provided in FIG. 25.

With reference to the forgoing discussion of virtual sensors that can be associated with BHA surrogates, the bottom hole assembly configurations selected to be used in drilling operations may be configured to include an actual sensor at substantially the same location and/or orientation as the virtual sensor in the surrogate. By utilizing a bottom hole assembly configuration in drilling operations, the measured results and the vibration performance indices based on measured data can be better compared against the simulated BHA surrogate states and the calculated indices, and these data may be displayed in charts such as those provided in FIGS. 23C, 24, and 25. For example, a virtual acceleration sensor may be associated with a BHA surrogate and the bottom hole assembly embodying the BHA surrogate may be provided with an accelerometer disposed in substantially the same location as the virtual sensor. States and vibration performance indices related to the acceleration, such as the transmissibility index described above, may be compared between the modeled and calculated values and the measured and calculated values.

The transmissibility index of the measured data may be calculated according to equation (e96).

$$T_{12}(\omega_o) = \frac{|FT[A_1(t)]|}{|FT[A_2(t)]|} \tag{e96}$$

where FT[ ] is the Fourier transform and $A_1(t)$ and $A_2(t)$ are the measured acceleration histories at sensor positions 1 and 2, respectively. While accelerometers and virtual acceleration sensors are described here as examples, similar comparisons may by made for sensors and indices based on other states.

Recent advances in near-bit sensor technology allow accelerations of the bit to be recorded. This data may be processed to identify fundamental frequencies of vibration at the bit. This frequency response data can be used to design the bit excitation input used to calculate the vibration indices for the measured data, as described above. That is, identification of the vibrational frequencies at the bit facilitates weighting of the identified fundamental frequencies in the calculation of the predicted vibration performance indices, in lieu of the current assumption of the equal weighting of N×RPM modes.

Figure 27:
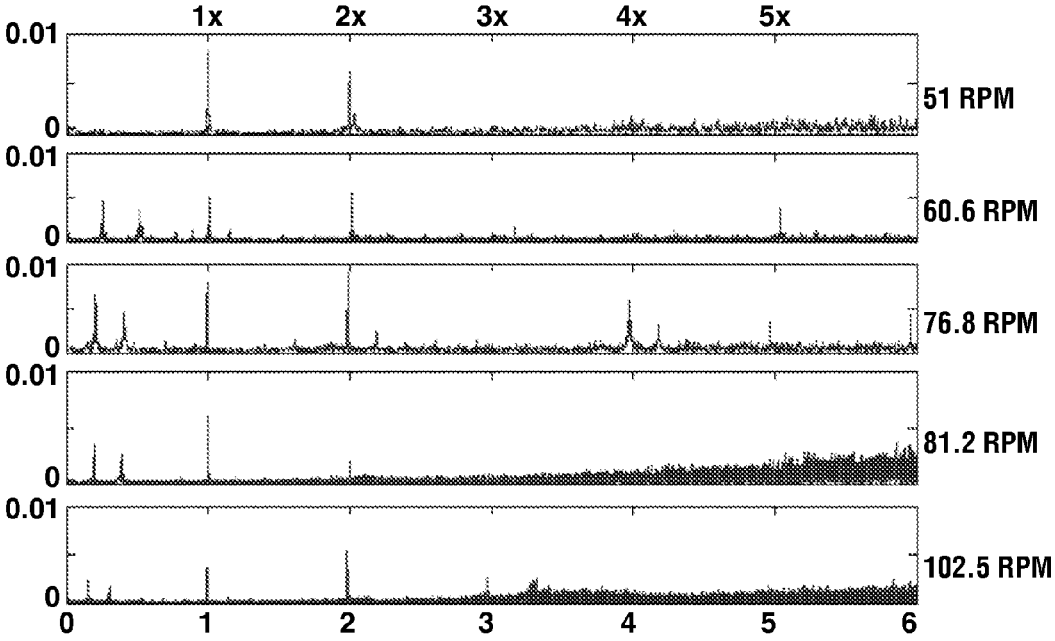
FIG. 27 shows the lateral accelerations of a BHA measured by a near-bit data recorder.

One such example is the field data displayed in FIG. 27, which shows the lateral accelerations measured by a near-bit data recorder. The measured lateral accelerations have been processed such that windows of nearly constant rotary speed are analyzed, the first window corresponding to 51 RPM, the second window corresponding to 60.6 RPM, and so forth. Additionally, each window displays the Fourier Transform of the acceleration data observed within this window as a function of the normalized frequency. The x-axis of the display is the dimensionless frequency $f/f_{RPM}$, as shown. The aligned peaks at certain dimensionless frequency units, such as at $f/f_{RPM}=1$, imply that there is lateral acceleration at those rotary speeds at the indicated frequency or multiple of the rotary speed.

These field measurements of bit excitation can be used in a variety of manners within the present systems and methods. As one example, one or more of the vibration performance indices disclosed herein may be adapted to include weighting factors for rotary speed multiples corresponding to the measured data. As described above, several of the indices are calculated as RMS averages for the plurality of rotary speed multiples considered. An exemplary vibration performance index PI can be weighted in light of the measured data as seen in equation (e102).

$$PI'(\omega_o) = \sqrt{\frac{1}{mn}\sum_{k=1}^{m}\sum_{j=1}^{n}(w_k(\omega_o)\cdot PI(k\omega_o))_{jk}^2} \tag{e102}$$

wherein PI' is the RMS average of a selected vibration performance index, $\omega_o$ represents the rotary speed, j is an element index, k is an element index, m is the number of excitation modes, n is the number of BHA end-lengths, and $(PI)_{jk}$ is one of the one or more indices for the $k^{th}$ index of the m modes and $j^{th}$ index of the n BHA end-lengths in the BHA design configuration, and wherein $w_k(\omega_o)$ is the weight for the $k^{th}$ multiple of the RPM at rotary speed $\omega_o$. The maximum value of a vibration performance index can be similarly modified as seen in equation (e103) where PI'(ρ) represents the maximum of a selected index.

$$PI'(\omega_o) = \max_{k=1}^{m}\left\{\max_{j=1}^{n}(w_k(\omega_o)\cdot PI)_{jk}\right\} \tag{e103}$$

The weighting factors in equations (e102) and (e103) may be real numbers and/or may be functions of the rotary speed. The equations described in connection with the vibration models previously described include an implied weighting factor equal to one for the multiples that are calculated and zero for all other multiples of the rotary speed. The measured data enables users of the present systems and methods to consider each of the relevant rotary speed multiples and to consider weighting the various modes to reflect the amount of energy in the Fourier analysis, based on measured drilling data. These weights will in general be a function of the rotary speed itself, as one can identify variations in the magnitudes of the RPM multiples in the figure. The weights may also be dependent on formation properties, depth, drilling fluid properties, and other parameters associated with the drilling operation.

When spikes are not present and there is a smear of energy, such as may be identified towards the higher frequencies in the 81 and 102 RPM cases, then there may be a bundling of the spectral content into bins with a center frequency to identify the bin. The total spectral energy content will be preserved, and there will be a distribution throughout the frequency band. The weighting factors can then be normalized for consistency.

The matching of the measured state data and indices with the simulated state data and indices may significantly improve the understanding of vibration behavior. As one exemplary result, the modeled and measured data may enable a user to improve one or more aspects of the models and/or equations used herein and discussed above. For example, one or more of the relationships, boundary conditions, assumptions, etc. described above may be improved from the understandings developed through comparing the measured results with the predicted results. Additionally or alternatively, the measured results may be compared with the predicted data to determine preferred operating conditions for continuing a drilling operation. For example, an operator may determine that a different bottom hole assembly configuration is preferred to overcome vibrations associated with a particular formation or that variations in weight on bit, rotary speed, or some other operating parameter can reduce the vibrations and improve the operations overall.

Another exemplary use of the measured data in log mode may facilitate or enable weighting of the various factors and parameters that are incorporated into the vibration performance indices described herein. For example, using the separate excitation multiple results for index values (BHA strain, transmitted strain, sideforce and torque indices, end-point curvature, etc.) and/or for the simulated states using the virtual sensors described above, a functional relationship may be established to relate the predicted values with the corresponding measured values. For example, linear weighting of the mode multiple results as illustrated in FIG. 24 can be compared with MSE to evaluate which of the modes may be the largest contributors to the MSE. Standard linear regression techniques or other techniques can be applied to these depth series to yield functional relationships, and nonlinear relations may be investigated as well. As an example, visual inspection of FIG. 24 shows that the twirl indices 2442 may be more highly correlated with the MSE index 2435 than the flex bending modes 2437-2441. The DVDT plot format illustrated in FIG. 25 may also be useful for this purpose.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A method of modeling drilling equipment to represent vibrational performance of the drilling equipment, the method comprising:

a) constructing at least one surrogate representing at least a portion of a bottom hole assembly;

b) associating at least two virtual sensors with each of the at least one surrogates, wherein the at least two sensors are spaced longitudinally from each other along each bottom hole assembly;

c) utilizing at least one frequency-domain model to calculate at least one state of the at least two virtual sensors during one or more simulated drilling operations for each of the at least one surrogates;

d) calculating a transmissibility index between the at least two virtual sensors for each of the at least one surrogates, wherein the transmissibility index is based at least in part on at least one of the calculated states; and e) using the calculated transmissibility index for each of the at least one surrogates to determine the transmissibility of vibrations within the bottom hole assembly.

2. The method of claim 1 wherein the calculated at least one state comprises at least one of displacement, tilt angle, bending moment, and shear force.

3. The method of claim 1 wherein the calculated transmissibility index is a ratio between calculated accelerations of the at least two virtual sensors derived from one or more of the calculated states.

4. The method of claim 1 wherein a transmissibility index greater than 1 predicts that vibrations would increase between a first virtual sensor and a second virtual sensor.

5. The method of claim 1 wherein a transmissibility index less than 1 predicts that vibrations would decrease between a first virtual sensor and a second virtual sensor.

6. The method of claim 1 wherein at least one of the virtual sensors is associated with a bit of the at least one bottom hole assembly surrogate, wherein a transmissibility index is calculated for a plurality of points along the surrogate, and wherein the usage of the calculated transmissibility indices is a plot wherein peaks of the transmissibility plot indicate locations of local peak vibration in the surrogate bottom hole assembly.

7. The method of claim 1 further comprising:

f) drilling at least a portion of a well with a bottom hole assembly at least substantially embodying a surrogate used to calculate a transmissibility index while measuring acceleration at least at two sensors disposed along the embodied bottom hole assembly;

g) calculating a measured transmissibility index using the measured accelerations; and h) comparing the measured transmissibility index with the transmissibility index of the surrogate.

8. The method of claim 7 further comprising updating the at least one surrogate to represent a different bottom hole assembly configuration and repeating steps (b)-(e).

9. The method of claim 7 further comprising modifying drilling operations on the well based at least in part on the measured transmissibility index and the surrogate transmissibility index.

10. The method of claim 7 further comprising updating one or more of the at least one surrogate, the at least two virtual sensors, the at least one frequency-domain model, and the transmissibility index calculations based at least in part on the comparison of the measured transmissibility index and the transmissibility index of the at least one surrogate.

11. A method of drilling a well for use in the production of hydrocarbons, the method comprising:

a) constructing at least one surrogate representing at least a portion of a bottom hole assembly, wherein the at least one surrogate includes at least two virtual sensors;

b) calculating a transmissibility index between the at least two virtual sensors for each of the at least one surrogates;

c) selecting an optimized bottom hole assembly configuration for a drilling operation based at least in part on the calculated transmissibility index; and d) drilling a well with drilling equipment incorporating a bottom hole assembly at least substantially embodying the selected bottom hole assembly configuration.

12. The method of claim 11 wherein drilling the well is conducted according to a drilling plan developed based at least in part on the calculated transmissibility index.

13. The method of claim 11 wherein selecting an optimized bottom hole assembly configuration comprises selecting different bottom hole assembly configurations for different portions of the drilling operation.

14. The method of claim 11 further comprising producing hydrocarbons from the well.

15. The method of claim 11 wherein calculating the transmissibility index comprises utilizing at least one frequency domain model to calculate at least one state of the at least two virtual sensors during one or more simulated drilling operations for each of the at least one surrogates; and wherein the transmissibility index is based at least in part on at least one of the calculated states.

16. The method of claim 11 wherein the calculated at least one state comprises at least one of displacement, tilt angle, bending moment, and shear force.

17. The method of claim 11 wherein the calculated transmissibility index is a ratio between calculated accelerations of the at least two virtual sensors derived from one or more of the calculated states.

18. The method of claim 11 wherein a transmissibility index greater than 1 predicts that vibrations will increase between a first virtual sensor and a second virtual sensor.

19. The method of claim 11 wherein a transmissibility index less than 1 predicts that vibrations will decrease between a first virtual sensor and a second virtual sensor.

20. A modeling system comprising:

a processor;

a memory coupled to the processor; and a set of computer readable instructions accessible by the processor, wherein the set of computer readable instructions are configured to:

a) construct at least one surrogate representing at least a portion of a bottom hole assembly, wherein the at least one surrogate includes at least two virtual sensors;

b) calculate a transmissibility index between the at least two virtual sensors for each of the at least one surrogates; and c) output the transmissibility index for use in selecting an optimized bottom hole assembly configuration for a drilling operation based at least in part on the calculated transmissibility index.

21. The system of claim 20, wherein the transmissibility index is calculated utilizing at least one frequency-domain model to calculate at least one state of the at least two virtual sensors during one or more simulated drilling operations for each of the at least one surrogates.

22. The system of claim 20, wherein the output is provided as a graphical representation of the transmissibility index of a bottom hole assembly configuration at one or more points along the bottom hole assembly configuration.

23. A method of modeling drilling equipment to represent vibrational performance of the drilling equipment, the method comprising:

constructing at least one surrogate representing at least a portion of a bottom hole assembly disposed in a well;

utilizing a frequency domain model to calculate a sideforce at least at one contact point between the bottom hole assembly and the well, wherein the sideforce is calculated as a function of rotational speed for each surrogate;

determining at least one sideforce slope index as a function of rotational speed for the at least one contact point; and displaying the calculated sideforce slope index as a function of rotational speed.

24. The method of claim 23 wherein a coefficient of friction at the least one contact point is assumed to be non-constant over the rotational speeds considered.

25. The method of claim 23 wherein the at least one sideforce slope indices are determined graphically.

26. The method of claim 23 wherein the at least one sideforce slope indices are determined numerically.

27. The method of claim 23 wherein the determined sideforce slope index is a combined index representative of a plurality of contact points between the bottom hole assembly and the well.

28. The method of claim 23 wherein a non-zero determined sideforce slope index predicts increased potential for vibration.

29. The method of claim 28 further comprising plotting the absolute value of the sideforce slope index as a function of rotational speed to determine a quantified potential for vibration.

30. The method of claim 29 further comprising identifying one or more contact points having greatest potential for vibration.

31. A method of drilling a well for use in the production of hydrocarbons, the method comprising;

constructing at least one surrogate representing at least a portion of a bottom hole assembly disposed in a well;

determining at least one sideforce slope index as a function of rotational speed for at least one contact point between the bottom hole assembly and the well;

selecting an optimized bottom hole assembly configuration for a drilling operation based at least in part on the determined at least one sideforce slope index; and drilling a well with drilling equipment incorporating a bottom hole assembly at least substantially embodying the selected bottom hole assembly configuration.

32. The method of claim 31 wherein drilling the well is conducted according to a drilling plan developed based at least in part on the determined at least one sideforce slope index.

33. The method of claim 31 wherein selecting an optimized bottom hole assembly configuration comprises selecting different bottom hole assembly configurations for different portions of the drilling.

34. The method of claim 31 further comprising producing hydrocarbons from the well.

35. The method of claim 31 wherein determining at least one sideforce slope index comprises utilizing a frequency domain model to calculate a sideforce at least at one contact point between the bottom hole assembly and the well, wherein the sideforce is calculated as a function of rotational speed for each surrogate.

36. The method of claim 31 wherein a coefficient of friction at the least one contact point is assumed to be non-constant over the rotational speeds considered.

37. The method of claim 31 wherein the at least one sideforce slope indices are determined graphically.

38. The method of claim 31 wherein the at least one sideforce slope indices are determined numerically.

39. The method of claim 31 wherein the determined sideforce slope index is a combined index representative of a plurality of contact points between the bottom hole assembly and the well.

40. The method of claim 31 wherein a non-zero determined sideforce slope index predicts increased potential for vibration.

41. The method of claim 40 further comprising plotting the absolute value of the sideforce slope index as a function of rotational speed to determine a quantified potential for vibration.

42. The method of claim 41 further comprising identifying one or more contact points having greatest potential for vibration.

43. A modeling system comprising:

a processor;

a memory coupled to the processor; and a set of computer readable instructions accessible by the processor, wherein the set of computer readable instructions are configured to:

construct at least one surrogate representing at least a portion of a bottom hole assembly disposed in a well;

determine at least one sideforce slope index as a function of rotational speed for at least one contact point between the bottom hole assembly and the well; and output the at least one sideforce slope index for use in selecting an optimized bottom hole assembly configuration for a drilling operation based at least in part on the determined at least one sideforce slope index.

44. The system of claim 43, wherein the sideforce slope index is determined utilizing at least one frequency-domain model to calculate a sideforce at least at one contact point.

45. The system of claim 43, wherein the output is provided as a graphical representation of the sideforce slope index of a bottom hole assembly configuration at one or more points along the bottom hole assembly configuration.

46. A method of modeling drilling equipment to represent vibrational performance of the drilling equipment, the method comprising:

identifying two or more fundamental excitation modes for a drilling bottom hole assembly; wherein each fundamental excitation mode is weighted relative to at least one other fundamental excitation mode; and wherein the excitation modes are related to at least one vibration-related drilling parameter;

constructing at least one surrogate representing at least a portion of a bottom hole assembly;

utilizing a frequency-domain model to simulate a response of the at least one surrogate to excitations corresponding with the identified fundamental excitation modes;

determining one or more performance indices for the simulated surrogate, wherein at least one of the performance indices is based at least in part on the simulated response of the surrogate at least at two fundamental excitation modes and on the relative weight of the at least two fundamental excitation modes; and utilizing the one or more performance indices in selecting at least one of one or more bottom hole assembly configurations and one or more drilling plans for use in drilling operations.

47. The method of claim 46, wherein the one or more performance indices are selected from at least one of an end point curvature index, a BHA strain energy index, an average transmitted strain energy index, a transmitted strain energy index, a root-mean-square BHA sideforce index, a root-mean-square BHA torque index, a total BHA sideforce index, a total BHA torque index, a sideforce slope index, a transmissibility index, and any mathematical combination thereof.

48. The method of claim 46, further comprising drilling a well using at least one of a) the selected one or more bottom hole assembly configurations and b) the selected one or more drilling plans.

49. The method of claim 46, wherein the two or more fundamental excitation modes are identified from field data using a method comprising:

obtaining field-data dynamic measurements of at least one dynamic state of a drilling bottom hole assembly, wherein each of the measurements is associated with at least one node in the bottom hole assembly;

processing the field-data measurements to obtain one or more windows having frequency-domain spectra of at least one of the measured dynamic states; and identifying two or more fundamental excitation modes in the one or more windows; wherein the fundamental excitation modes correspond to regions of the frequency-domain spectra having spectral peaks; and wherein each of the two or more fundamental excitation modes is weighted relative to at least one other fundamental excitation mode.

50. The method of claim 49 wherein the at least one dynamic state is selected from one or more of rotary speed, displacement, velocity, acceleration, bending strain, bending moment, tilt angle, and force.

51. The method of claim 49, wherein the field-data is collected using one or more near-bit sensors.

52. The method of claim 49, wherein the field-data measurements are processed using one or more Fourier transforms to provide frequency-domain spectra.

53. The method of claim 49, wherein the one or more windows each present measured data for an interval in a drilling history, wherein the interval is for at least one of a period of time, a depth range, and a rotary speed applied during the drilling.

54. The method of claim 53, wherein the one or more windows present intervals of nearly constant rotary speed, and wherein the one or more identified fundamental excitation modes is associated with one or more multiples of the rotary speed having spectral peaks.

55. The method of claim 49, further comprising drilling a well using at least one of a) the selected one or more bottom hole assembly configurations and b) the selected one or more drilling plans.

56. The method of claim 46, wherein the two or more fundamental excitation modes are identified from simulated data and field data using a method comprising:

obtaining measurements of at least one parameter of a drilling bottom hole assembly indicative of vibrational performance, wherein the measurements relate to one or more nodes on the drilling bottom hole assembly;

constructing a surrogate representing at least a portion of the drilling bottom hole assembly;

utilizing a frequency-domain model to simulate a response of the surrogate to dynamic excitations at one or more reference nodes corresponding to the nodes on the drilling bottom hole assembly, wherein a response is simulated for each of at least two excitation modes;

determining a vibrational performance index for each of the at least two excitation modes based at least in part on the response of the surrogate to the dynamic excitations;

comparing the at least two determined vibrational performance indices with the obtained measurements to determine the relative contribution of each excitation mode to the measured vibration performance; and weighting each of the excitation modes according to the respective relative contributions to determine at least two fundamental excitation modes.

57. The method of claim 56, wherein the at least one parameter is selected from one or more of rate of penetration, mechanical specific energy, measured downhole acceleration, measured downhole velocity, bending moment, bending strain, shock count, and stick-slip vibrations.

58. The method of claim 56, wherein the dynamic excitations of the surrogate are applied by perturbing at least one model state selected from displacement, tilt angle, moment, and force.

59. The method of claim 56, wherein the at least two determined vibrational performance indices are summed with multiplicative non-negative coefficients to obtain a combined surrogate performance index for comparison with the obtained measurements; wherein comparing the surrogate vibrational performance index with the obtained measurements comprises varying the non-negative coefficients for each performance index until differences between the combined performance index and the obtained measurements are at least substantially minimized to establish excitation coefficients corresponding to at least two weighted fundamental excitation modes.

60. The method of claim 56, further comprising drilling a well using at least one of a) the selected one or more bottom hole assembly configurations and b) the selected one or more drilling plans.

61. The method of any one of claims 48, 55, and 60 further comprising producing hydrocarbons from the well.

62. A method of drilling a well for use in the production of hydrocarbons, the method comprising;

identifying two or more fundamental excitation modes for a drilling bottom hole assembly; wherein each fundamental excitation mode is weighted relative to at least one other fundamental excitation mode; and wherein the excitation modes are related to at least one vibration-related drilling parameter;

constructing at least one surrogate representing at least a portion of a bottom hole assembly;

utilizing a frequency-domain model to simulate a response of the at least one surrogate to excitations corresponding with the identified fundamental excitation modes;

determining one or more performance indices for the simulated surrogate, wherein at least one of the performance indices is based at least in part on the simulated response of the surrogate at least at two fundamental excitation modes and on the relative weight of the at least two fundamental excitation modes;

utilizing the one or more performance indices in selecting at least one of one or more bottom hole assembly configurations and one or more drilling plans for use in drilling operations; and drilling a well with at least one of 1) drilling equipment incorporating a bottom hole assembly at least substantially embodying the selected one or more bottom hole assembly configurations and 2) the selected one or more drilling plans.

63. The method of claim 62 wherein selecting a bottom hole assembly configuration comprises selecting different bottom hole assembly configurations for different portions of the drilling.

64. The method of claim 62 further comprising producing hydrocarbons from the well.

65. The method of claim 62 wherein the two or more fundamental excitation modes are identified from field data.

66. The method of claim 62 wherein the two or more fundamental excitation modes are identified from simulated data and field data.

* * * * *